US010161657B2

(12) United States Patent
Ilercil

(10) Patent No.: US 10,161,657 B2
(45) Date of Patent: Dec. 25, 2018

(54) THERMO-ELECTRIC HEAT PUMP SYSTEMS

(71) Applicant: AMBASSADOR ASSET MANAGEMENT LIMITED PARTNERSHIP, Mesa, AZ (US)

(72) Inventor: Alp Ilercil, Scottsdale, AZ (US)

(73) Assignee: Ambassador Asset Management Limited Partnership, Mesa, AZ (US)

( * ) Notice: Subject to any disclaimer, the term of this patent is extended or adjusted under 35 U.S.C. 154(b) by 0 days.

(21) Appl. No.: 15/702,379

(22) Filed: Sep. 12, 2017

(65) Prior Publication Data

US 2018/0023865 A1 Jan. 25, 2018

Related U.S. Application Data

(63) Continuation of application No. 15/427,243, filed on Feb. 8, 2017, now Pat. No. 9,791,185, which is a continuation of application No. 14/834,260, filed on Aug. 24, 2015, now Pat. No. 9,599,376, which is a continuation of application No. 14/228,048, filed on Mar. 27, 2014, now Pat. No. 9,115,919, which is a continuation-in-part of application No. 14/176,078, filed on Feb. 8, 2014, now Pat. No. 9,151,523, which is a continuation of application No. 13/146,635, filed as application No. PCT/US2010/022459 on Jan. 28, 2010, which is a continuation-in-part of application No. 12/361,484, filed on Jan. 28, 2009, now Pat. No.

(Continued)

(51) Int. Cl.

| | |
|---|---|
| ***F25B 21/02*** | (2006.01) |
| ***F25B 21/04*** | (2006.01) |
| ***F25D 11/00*** | (2006.01) |

(52) U.S. Cl.

CPC ..... *F25B 21/02* (2013.01); *F25B 21/04* (2013.01); *F25D 11/00* (2013.01); *F25D 11/003* (2013.01); *F25B 2321/023* (2013.01); *F25B 2321/0212* (2013.01); *F25B 2321/0251* (2013.01)

(58) Field of Classification Search

CPC .. F25B 21/02; F25B 2321/00; F25B 2321/02; F25B 2321/021; F25B 2321/0212; F25B 2321/023

USPC ..... 62/3.1, 3.2, 3.3, 3.6, 3.62, 371

See application file for complete search history.

(56) References Cited

U.S. PATENT DOCUMENTS

2008/0245398 A1* 10/2008 Bell ..... F02G 1/043 136/224

2009/0049845 A1* 2/2009 McStravick ..... F25B 21/02 62/3.62

* cited by examiner

*Primary Examiner* — Jonathan Bradford

(74) *Attorney, Agent, or Firm* — Rodney J. Fuller; Booth Udall Fuller, PLC

(57) ABSTRACT

The disclosure is directed to an energy efficient thermal protection assembly. The thermal protection assembly can comprise three or more thermoelectric unit layers capable of active use of the Peltier effect; and at least one capacitance spacer block suitable for storing heat and providing a delayed thermal reaction time of the assembly. The capacitance spacer block is thermally connected between the thermoelectric unit layers. The present disclosure further relates to a thermoelectric transport and storage devices for transporting or storing temperature sensitive goods, for example, vaccines, chemicals, biologicals, and other temperature sensitive goods. The transport or storage device can be configured and provide on-board energy storage for sustaining, for multiple days, at a constant-temperature, with an acceptable temperature variation band.

20 Claims, 40 Drawing Sheets

Related U.S. Application Data

8,677,767, said application No. 14/834,260 is a continuation of application No. 14/197,589, filed on Mar. 5, 2014, now Pat. No. 9,134,055, which is a continuation of application No. 12/361,484, filed on Jan. 28, 2009, now Pat. No. 8,677,767.

(60) Provisional application No. 61/805,926, filed on Mar. 27, 2013, provisional application No. 61/148,911, filed on Jan. 30, 2009, provisional application No. 61/024,169, filed on Jan. 28, 2008, provisional application No. 61/056,801, filed on May 28, 2008.

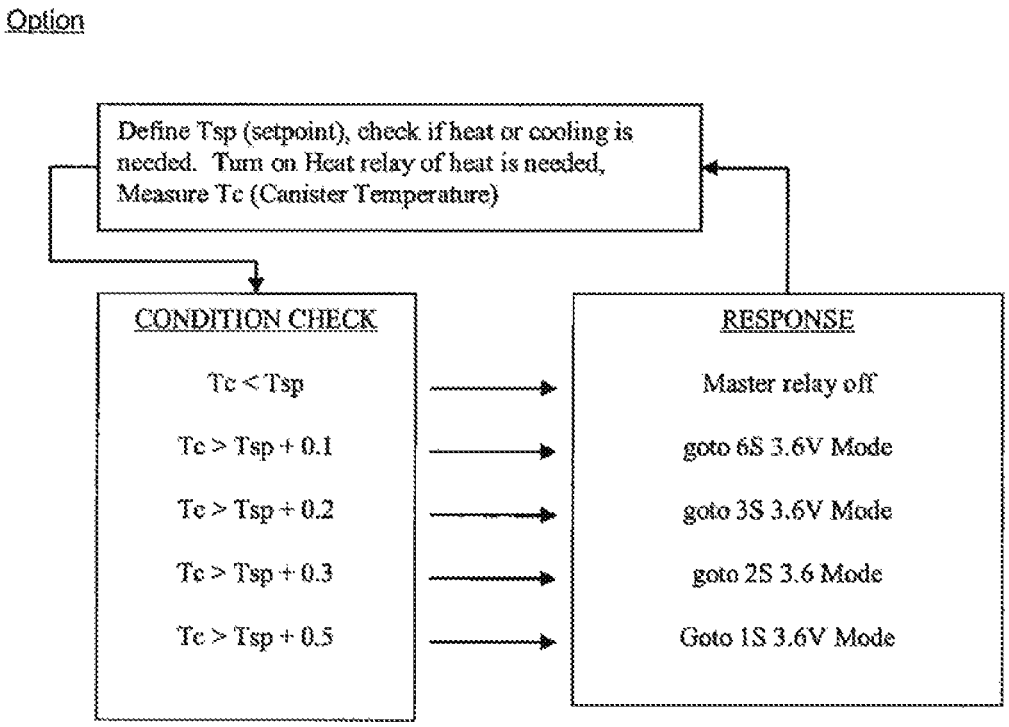
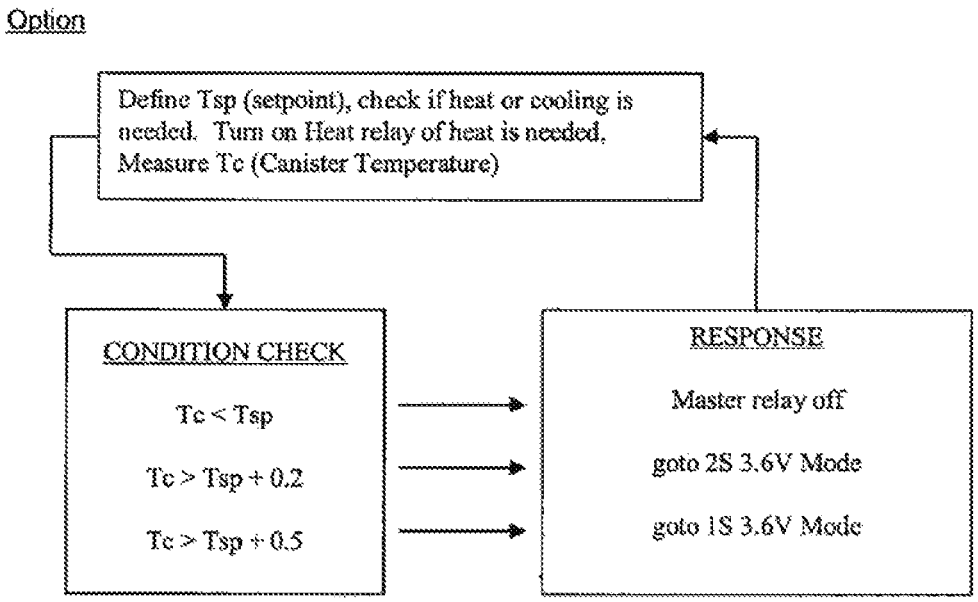
FIG. 18

| I max | DT max | Q | Delta T | V | I | I/Imax | Dt/Dtmax | Couples | | Dt/Dtmax / I/Imax | SL Dt/Dtmax / MQ I/Imax |
|---|---|---|---|---|---|---|---|---|---|---|---|
| 2.1 | 67 | 0 | 40 | 5.53 | 0.57 | 0.271 | 0.597 | 127 | Single layer | 2.20 | 3.80 |
| 2.1 | 67 | 0 | 40 | 3.10 | 0.57 | 0.271 | 0.597 | 71 | Single layer | 2.20 | 3.80 |
| 2.1 | 67 | 0 | 40 | 2.75 | 0.57 | 0.271 | 0.597 | 63 | Single layer | 2.20 | 3.80 |
| 2.1 | 67 | 0 | 40 | 1.35 | 0.57 | 0.271 | 0.597 | 31 | Single layer | 2.20 | 3.80 |
| 2.1 | 67 | 0 | 40 | 0.75 | 0.57 | 0.271 | 0.597 | 17 | Single layer | 2.20 | 3.80 |
| 2.1 | 67 | 0 | 40 | 0.31 | 0.57 | 0.271 | 0.597 | 7 | Single layer | 2.20 | 3.80 |
| 2.1 | 67 | 0 | 24 | 3.16 | 0.33 | 0.157 | 0.358 | 127 | Micro Q | 2.28 | 2.28 |
| | | | | | | | | | | | |
| 2.1 | 67 | 0 | 20 | 2.60 | 0.27 | 0.129 | 0.299 | 127 | Single layer | 2.32 | 3.92 |
| 2.1 | 67 | 0 | 20 | 1.46 | 0.27 | 0.129 | 0.299 | 71 | Single layer | 2.32 | 3.92 |
| 2.1 | 67 | 0 | 20 | 1.29 | 0.27 | 0.129 | 0.299 | 63 | Single layer | 2.32 | 3.92 |
| 2.1 | 67 | 0 | 20 | 0.64 | 0.27 | 0.129 | 0.299 | 31 | Single layer | 2.32 | 3.92 |
| 2.1 | 67 | 0 | 20 | 0.35 | 0.27 | 0.129 | 0.299 | 17 | Single layer | 2.32 | 3.92 |
| 2.1 | 67 | 0 | 20 | 0.14 | 0.27 | 0.129 | 0.299 | 7 | Single layer | 2.32 | 3.92 |
| 2.1 | 67 | 0 | 12 | 1.53 | 0.16 | 0.076 | 0.179 | 127 | Micro Q | 2.35 | 2.35 |
| | | | | | | | | | | | |
| 2.1 | 67 | 0 | 10 | 1.27 | 0.14 | 0.067 | 0.149 | 127 | Single layer | 2.24 | 3.92 |
| 2.1 | 67 | 0 | 10 | 0.71 | 0.14 | 0.067 | 0.149 | 71 | Single layer | 2.24 | 3.92 |
| 2.1 | 67 | 0 | 10 | 0.63 | 0.14 | 0.067 | 0.149 | 63 | Single layer | 2.24 | 3.92 |
| 2.1 | 67 | 0 | 10 | 0.31 | 0.14 | 0.067 | 0.149 | 31 | Single layer | 2.24 | 3.92 |
| 2.1 | 67 | 0 | 10 | 0.17 | 0.14 | 0.067 | 0.149 | 17 | Single layer | 2.24 | 3.92 |
| 2.1 | 67 | 0 | 10 | 0.07 | 0.14 | 0.067 | 0.149 | 7 | Single layer | 2.24 | 3.92 |
| 2.1 | 67 | 0 | 6 | 0.77 | 0.08 | 0.038 | 0.090 | 127 | Micro Q | 2.35 | 2.35 |
| | | | | | | | | | | | |
| Control T | Cap T | Dt | V | I | Qc | I/Imax | Dt/Dtmax | Qh | 1S Mode | | |
| -12.7 | 10.9 | 23.6 | 3.7 | 0.46 | 1.08 | 0.219 | 0.352 | 2.78 | Cold layer | | |
| 10.6 | 26.4 | 15.8 | 3.7 | 0.47 | 3.42 | 0.224 | 0.236 | 5.18 | Hot layer | | |
| | | 39.4 | | | | | | | | | |
| | | | | | | | | | | | |
| Control T | Cap T | Dt | V | I | Qc | I/Imax | Dt/Dtmax | Qh | 2S Mode | | |
| 3 | 15.1 | 12.1 | 1.84 | 0.21 | 0.68 | 0.100 | 0.181 | 1.07 | Cold layer | | |
| 14.9 | 23.7 | 8.8 | 1.84 | 0.23 | 1.65 | 0.110 | 0.131 | 2.07 | Hot layer | | |
| | | 20.9 | | | | | | | | | |

FIG. 24A

| I max | DT max | Q | Delta T | V | I | I/Imax | Dt/Dtmax | Couples | |
|---|---|---|---|---|---|---|---|---|---|
| 2.1 | 67 | 1 | 40 | 6.12 | 0.66 | 0.314 | 0.597 | 127 | Single layer |
| 2.1 | 67 | 1 | 40 | 3.70 | 0.74 | 0.352 | 0.597 | 71 | Single layer |
| 2.1 | 67 | 1 | 40 | 3.36 | 0.77 | 0.367 | 0.597 | 63 | Single layer |
| 2.1 | 67 | 1 | 40 | 2.03 | 1.02 | 0.486 | 0.597 | 31 | Single layer |
| 2.1 | 67 | 1 | 40 | 1.60 | 1.61 | 0.767 | 0.597 | 17 | Single layer |
| 2.1 | 67 | N/A | N/A | N/A | N/A | N/A | N/A | 7 | Single layer |
| 2.1 | 67 | 1 | 24 | 3.66 | 0.42 | 0.200 | 0.358 | 127 | Micro Q top layer |
| | | | | | | | | | |
| 2.1 | 67 | 0.5 | 20 | 2.83 | 0.31 | 0.148 | 0.299 | 127 | Single layer |
| 2.1 | 67 | 0.5 | 20 | 1.70 | 0.35 | 0.167 | 0.299 | 71 | Single layer |
| 2.1 | 67 | 0.5 | 20 | 1.53 | 0.36 | 0.171 | 0.299 | 63 | Single layer |
| 2.1 | 67 | 0.5 | 20 | 0.89 | 0.45 | 0.214 | 0.299 | 31 | Single layer |
| 2.1 | 67 | 0.5 | 20 | 0.61 | 0.61 | 0.290 | 0.299 | 17 | Single layer |
| 2.1 | 67 | 0.5 | 20 | 0.46 | 1.26 | 0.600 | 0.299 | 7 | Single layer |
| 2.1 | 67 | 0.5 | 12 | 1.75 | 0.20 | 0.095 | 0.179 | 127 | Micro Q top layer |
| | | | | | | | | | |
| 2.1 | 67 | 0.25 | 10 | 1.38 | 0.16 | 0.076 | 0.149 | 127 | Single layer |
| 2.1 | 67 | 0.25 | 10 | 0.82 | 0.17 | 0.081 | 0.149 | 71 | Single layer |
| 2.1 | 67 | 0.25 | 10 | 0.74 | 0.17 | 0.081 | 0.149 | 63 | Single layer |
| 2.1 | 67 | 0.25 | 10 | 0.43 | 0.22 | 0.105 | 0.149 | 31 | Single layer |
| 2.1 | 67 | 0.25 | 10 | 0.29 | 0.29 | 0.138 | 0.149 | 17 | Single layer |
| 2.1 | 67 | 0.25 | 10 | 0.20 | 0.55 | 0.262 | 0.149 | 7 | Single layer |
| 2.1 | 67 | 0.25 | 6 | 0.86 | 0.10 | 0.048 | 0.090 | 127 | Micro Q top layer |
| | | | | | | | | | |
| Control T | Cap T | Dt | V | I | Qc | I/Imax | Dt/Dtmax | Qh | 1S Mode |
| -12.7 | 10.9 | 23.6 | 3.7 | 0.46 | 1.08 | 0.219 | 0.352 | 2.78 | Top layer |
| 10.6 | 26.4 | 15.8 | 3.7 | 0.47 | 3.42 | 0.224 | 0.236 | 5.18 | Bottom layer |
| | | 39.4 | | | | | | | |
| | | | | | | | | | |
| Control T | Cap T | Dt | V | I | Qc | I/Imax | Dt/Dtmax | Qh | 2S Mode |
| 3 | 15.1 | 12.1 | 1.84 | 0.21 | 0.68 | 0.100 | 0.181 | 1.07 | Top layer |
| 14.9 | 23.7 | 8.8 | 1.84 | 0.23 | 1.65 | 0.110 | 0.131 | 2.07 | Bottom layer |
| | | 20.9 | | | | | | | |

FIG. 24B

Typical TE operating point at DT 20

Optimum TE operating point at DT 20

Micro Q operating point at DT 20

Typical TE operating point at DT 40

Optimum TE operating point at DT 40

Micro Q operating point at DT 40

40 x 40 mm, 127 couples each, 4 Layers of Thermoelectric modules Thermaly and Electrically in Series Consuming 1 Watt of Power

| Layer | Cold side | Hot side | Delta T | Voltage ( V ) | Current ( I ) | Qc | COP | I / Imax | Dt / Dtmax |
|---|---|---|---|---|---|---|---|---|---|
| (Canister ) Layer1 Temperatures | 1.4 | 7.7 | 6.3 | 1.1210 | 0.228 | 1.11 | 4.79 | 0.0648 | 0.0957 |
| Layer 2 Temperatures | 7.7 | 13.6 | 5.9 | 1.1235 | 0.228 | 1.29 | 5.65 | 0.0648 | 0.0896 |
| Layer 3 Temperatures | 13.6 | 19.1 | 5.5 | 1.1269 | 0.228 | 1.47 | 6.48 | 0.0648 | 0.0835 |
| ( Heat Sink ) Layer 4 Temperatures | 19.1 | 23.5 | 4.4 | 1.1198 | 0.228 | 1.94 | 8.24 | 0.0648 | 0.0668 |
| **Heat Pump Overall Output** | | | **22.1** | **4.4912** | **0.228** | **1.11** | **1.08** | **0.0648** | |

| Heat Pump Specifications | |
|---|---|
| Layers | 4 |
| Electrical configuration | 4 in Series |
| Total Supplied voltage ( Volt ) | 4.5 |
| Total Measured Current ( Amp ) | 0.228 |
| Total Supplied Power ( W ) | 1.026 |

| Thermolectric Module Specifications | |
|---|---|
| Size ( mm ) | 40 x 40 |
| Number of Couples | 127 |
| Power ( Q max ) Delta T =0 ( Watts ) | 26.88 |
| Delta T Max @ Qc =0 ( Celcius ) | 65.83 |
| V max ( Volts ) | 15.3 |
| I max ( Amperes ) | 3.52 |

FIG. 32A 40 x 40 mm, 127 couples each, 4 Layers of Thermoelectric modules Thermaly and Electrically in Series Consuming 3 Watts of Power

| Layer | Cold side | Hot side | Delta T | Voltage ( V ) | Current ( I ) | Qc | COP | I / Imax | Dt / Dtmax |
|---|---|---|---|---|---|---|---|---|---|
| (Canister ) Layer1 Temperatures | -7.3 | 3.1 | 10.4 | 1.8894 | 0.402 | 1.77 | 2.59 | 0.1142 | 0.1580 |
| Layer 2 Temperatures | 3.1 | 12.5 | 9.4 | 1.9038 | 0.402 | 2.30 | 3.36 | 0.1142 | 0.1428 |
| Layer 3 Temperatures | 12.5 | 20.1 | 7.6 | 1.9016 | 0.402 | 3.08 | 4.45 | 0.1142 | 0.1154 |
| ( Heat Sink ) Layer 4 Temperatures | 20.1 | 25.4 | 5.3 | 1.8637 | 0.402 | 3.93 | 5.71 | 0.1142 | 0.0805 |
| Heat Pump Overall Output | | | 32.7 | 7.5585 | 0.402 | 1.77 | 0.58 | 0.1142 | |

| Heat Pump Specifications | |
|---|---|
| Layers | 4 |
| Electrical configuration | 4 in Series |
| Total Supplied voltage ( Volt ) | 7.58 |
| Total Measured Current ( Amp ) | 0.402 |
| Total Supplied Power ( W ) | 3.05 |

| Thermolectric Module Specifications | |
|---|---|
| Size ( mm ) | 40 x 40 |
| Number of Couples | 127 |
| Power ( Q max ) Delta T =0 ( Watts ) | 26.88 |
| Delta T Max @ Qc =0 ( Celcius ) | 65.83 |
| V max ( Volts ) | 15.3 |
| I max ( Amperes ) | 3.52 |

FIG. 32B 40 x 40 mm, 127 couples each, 4 Layers of Thermoelectric modules Thermaly and Electrically in Series Consuming 5 Watts of Power

| Layer | Cold side | Hot side | Delta T | Voltage ( V ) | Current ( I ) | Qc | COP | I / Imax | Dt / Dtmax |
|---|---|---|---|---|---|---|---|---|---|
| (Canister ) Layer1 Temperatures | -12.6 | 0.7 | 13.3 | 2.3999 | 0.526 | 2.10 | 1.84 | 0.1494 | 0.2020 |
| Layer 2 Temperatures | 0.7 | 12.1 | 11.4 | 2.4248 | 0.526 | 3.00 | 2.68 | 0.1494 | 0.1732 |
| Layer 3 Temperatures | 12.1 | 20.4 | 8.3 | 2.4097 | 0.526 | 4.32 | 3.78 | 0.1494 | 0.1261 |
| ( Heat Sink ) Layer 4 Temperatures | 20.4 | 25.1 | 4.7 | 2.3260 | 0.526 | 5.59 | 4.98 | 0.1494 | 0.0714 |
| **Heat Pump Overall Output** | | | 37.7 | 9.5604 | 0.526 | 2.10 | 0.42 | 0.1494 | |

| Heat Pump Specifications | |
|---|---|
| Layers | 4 |
| Electrical configuration | 4 in Series |
| Total Supplied voltage ( Volt ) | 9.59 |
| Total Measured Current ( Amp ) | 0.526 |
| Total Supplied Power ( W ) | 5.04 |

| Thermolectric Module Specifications | |
|---|---|
| Size ( mm ) | 40 x 40 |
| Number of Couples | 127 |
| Power ( Q max ) Delta T =0 ( Watts ) | 26.88 |
| Delta T Max @ Qc =0 ( Celcius ) | 65.83 |
| V max ( Volts ) | 15.3 |
| I max ( Amperes ) | 3.52 |

FIG. 32C

THERMO-ELECTRIC HEAT PUMP SYSTEMS

CROSS-REFERENCE TO RELATED APPLICATIONS

This application is a continuation of U.S. patent application Ser. No. 15/427,243, filed Feb. 8, 2017 (published as US 20170198949), which is a continuation of U.S. patent application Ser. No. 14/834,260, filed Aug. 24, 2015 (issued as U.S. Pat. No. 9,599,376), which is a continuation of U.S. patent application Ser. No. 14/228,048, filed Mar. 27, 2014 (issued as U.S. Pat. No. 9,115,919), which is related to and claims the benefit of U.S. Provisional Application No. 61/805,926 filed Mar. 27, 2013; U.S. application Ser. No. 14/228,048 is also a continuation-in-part application of U.S. patent application Ser. No. 14/176,078, filed Feb. 8, 2014 (issued as U.S. Pat. No. 9,151,523), which is a continuation application of U.S. patent application Ser. No. 13/146,635, filed Feb. 8, 2012 (issued as U.S. Pat. No. 8,646,282), which is the U.S. National Stage of PCT/US2010/022459, filed Jan. 28, 2010, which is a continuation-in-part of U.S. patent application Ser. No. 12/361,484 filed Jan. 28, 2009 (issued as U.S. Pat. No. 8,677,767); U.S. National Stage of PCT/US2010/022459 also claims the benefit of U.S. Provisional Application No. 61/148,911 filed Jan. 30, 2009; U.S. patent application Ser. No. 14/834,260 is also a continuation of U.S. patent application Ser. No. 14/197,589, filed Mar. 5, 2014 (issued as U.S. Pat. No. 9,134,055), which is a continuation of U.S. patent application Ser. No. 12/361,484, filed Jan. 28, 2009 (issued as U.S. Pat. No. 8,677,767), which is related to and claims the benefit of U.S. Provisional Application Nos. 61/024,169, filed Jan. 28, 2008, and 61/056,801, filed May 28, 2008, the contents of each of the above applications which are incorporated herein by reference thereto in their entireties.

BACKGROUND

This disclosure relates to thermo-electric heat pump systems. In another aspect, this disclosure relates to providing a system for improved iso-thermal transport and storage systems. More particularly, this disclosure relates to providing a system for temperature regulation for transported materials requiring a stable thermal environment. There is a need for a robust shock-proof and efficient thermo-electric device that is self-sufficient and does not require external power for a period of multiple days. Further, there is a need for a thermo-electric device that is capable of safely storing and maintaining its cargo during transport and/or storage. The need has been expressed by those involved in transportation and storage of temperature sensitive and delicate goods, for example, biological or laboratory samples. Additionally, this need is further expressed by those responsible for transporting sensitive goods in extreme locations where temperature regulation may be problematic. Furthermore, a need exists for an iso-thermal storage and transport system that self-regulates temperature over pre-defined, adjustable cooling or heating profiles. Shipping weight and volume are also prime concerns.

A need exists for an iso-thermal storage and transport system that provides a self-contained means for storing energy onboard during the transport and storage of sensitive goods, such as biological materials and samples, including cell and tissue cultures, nucleic acids, bodily fluids, tissues, organs, embryos, semen, stem-cells, ovaries, platelets, blood, plant tissues, and other sensitive goods such as pharmaceuticals, vaccines and chemicals. In light of available utilities, external ambient temperature, environmental conditions and other factors, it is essential that an iso-thermal storage and transport system function reliably to protect sensitive goods from degradation.

A need exists for an iso-thermal storage and transport system that is robust and that provides a shock-proof system that withstands abuses and rough handling inherent within storage and transportation of sensitive goods.

Further, needs exist for iso-thermal storage and transport systems and other related thermo-electric heat pump systems that are reusable, reliable over an extended time period, cost-effective and dependable.

SUMMARY

The present disclosure is directed to a thermoelectric heat pump assembly having a more efficient design. As used herein, Temperature (T) is in Celsius; Voltage (V) is in Volts; current (I) is in Amps; heat (Q) is in Watts; and resistance R is in Ohms. The heat pump assembly designs described herein increases heat pump per unit of input power during overall use, with increased reliability. In an embodiment the thermoelectric heat pump assembly comprises: two or more thermoelectric unit layers (i.e., thermoelectric modules) capable of active use of the Peltier effect, each thermoelectric unit layer having a cold side and a hot side, and at least one capacitance spacer block suitable for storing heat and providing a delayed thermal reaction time of the assembly.

The heat pump assembly of the disclosure can be configured so that each thermoelectric unit layer at steady-state during operation has ratio or coefficient of performance (COP) of the heat removed divided by the input power that is prior to and less than the peak COP on a COP curve of performance (See FIGS. 25A-25C and FIGS. 26A-26C). The capacitance spacer block has a top portion and a bottom portion and is between a first thermoelectric unit layer and a second thermoelectric layer. The top portion of the capacitance spacer block is thermally connected to the hot side of the first thermoelectric unit layer and the bottom portion is thermally connected to the cold side of the second thermoelectric unit layer, forming a sandwich layer suitable to pump heat from the first thermoelectric unit layer to the second thermoelectric layer. The capacitance spacer block can be made of copper, aluminum, or other thermally conductive and capacitive alloys.

Each thermoelectric unit layer can comprise thermoelectric units electrically connected in parallel or series, but thermally connected in series. Each thermoelectric unit layers in the heat pump assembly can be separated by a capacitance spacer block. In some configurations, the thermoelectric heat pump of the disclosure would have two to nine thermoelectric unit layers (e.g., 2, 3, 4, 5, 6, 7, 8, 9). The thermoelectric unit layers are can be electrically reconfigurably connected to maintain a given temperature profile over time by switching between different configurations, e.g., electrically reconfigurable between series and parallel configurations.

At least one energy source (e.g., battery) is operably connected to each thermoelectric unit layer, wherein the energy source is suitable to provide a current to power the thermoelectric heat pump and to control the amount of heat removed by the heat pump. In certain aspects, the heat pump assembly comprises two or more energy sources (e.g., 3, 4, 5) that can be used as back up or provide alternative current configurations.

Advantageously, the heat pump assembly typically also has a heat sink associated with a fan assembly, wherein in the heat sink is thermally connected at the bottom end of the heat pump assembly. In certain aspects, the heat sink can be at least 30 W, or at least 40 W (e.g., 45 W, or 50 W).

In one aspect, the heat pump assembly is configured so that each individual thermoelectric unit layer has a ratio of input current to maximum available current (I/Imax) of 0.35 at steady-state. The heat pump assembly can also be configured so that the I/Imax of 0.09 or less (e.g. 0.076) at a steady-state, when change in temperature (ΔT) of the heat pump assembly at the top end compared to the bottom end of the heat pump assembly is about 20° C. and heat removal (Q) is about 0 Watts; and/or the ratio of input current to maximum available current (I/Imax) of each individual thermoelectric unit layer is 0.18 or less at a steady-state, when change in temperature (ΔT) of the heat pump assembly at the top end compared to the bottom end of the heat pump assembly is about 40° C. and heat (Q) is about 0 Watts.

In another aspect, the heat pump assembly is configured so that each individual thermoelectric unit layer has a maximum change in temperature (ΔTmax) potential and comprises at least 127 coupled pairs of thermoelectric units, and wherein the heat pump assembly is configured so that each thermoelectric layer operates at: (i) less than 20% of the ΔTmax at steady-state when change in temperature (ΔT) of the heat pump assembly at the top end compared to the bottom end of the heat pump assembly is about 20° C.; and/or (ii) less than 40% of the ΔTmax at steady-state when change in temperature (ΔT) of the heat pump assembly at the top end compared to the bottom end of the heat pump assembly is about 40° C.

In another aspect, the heat pump assembly further comprises a heat sink associated with a fan assembly, wherein in the heat sink is thermally connected at the bottom end of the heat pump assembly, the heat pump assembly being configured to minimize a temperature rise or drop on the heat sink at a steady-state so that the temperature rise or drop on the heat sink does not exceed 5° C., or does not exceed 4° C. or 3° C., and even 2.5° C., typically as compared to ambient temperature.

In a configuration, the thermoelectric heat pump assembly is configured so that at steady-state the heat sink has a temperature that does not exceed 30%, 25% or 20%, of the heat sink maximum temperature rating, wherein the heat sink has a rating of at least 35 Watts (e.g., 40 Watts).

Each thermoelectric unit layer can comprise at least 127 coupled pairs of thermoelectric units. Also, each thermoelectric unit layer can be configured at 3 or more Ohms at 25° Celsius, or 5 or more Ohms, (e.g. about 5.5, 6.0, or 6.5 Ohms), typically not greater than 7.5 Ohms. The thermoelectric unit layer (i.e., a thermoelectric module) can have a heat pumping capability of between 15 Watts and 20 Watts.

Each thermoelectric unit layer can have a maximum change in temperature (ΔTmax) potential and is configured so that each thermoelectric layer operates at less than 20% of the ΔTmax at steady-state when change in temperature (ΔT) of the heat pump assembly at the top end compared to the bottom end of the heat pump assembly is 20° C.; and/or operates at less than 40% of the ΔTmax at steady-state when change in temperature (ΔT) of the heat pump assembly at the top end compared to the bottom end of the heat pump assembly is 40° C.

In addition, the capacitance spacer block can typically separate the thermoelectric unit layers by at least ¼ inch, or at least about ½, 1, 2, or 3 inches. In a specific embodiment, the capacitance spacer block, is about 1.5-2.5 inches. The top portion and bottom portion of the capacitance spacer block can be substantially the same size and shape as the cold side and hot side of each thermoelectric unit layer to obtain substantial contact with the thermoelectric unit layer.

The thermoelectric heat pump assembly of the present disclosure may further comprise momentary relay based circuitry, programmable by a portable microprocessor adapted to control the temperature of the temperature sensitive goods based on a given temperature profile. In an embodiment of the disclosure, the thermoelectric heat pump assembly further comprises a microcontroller (e.g., microprocessor) operatively associated with the energy source and at least one relay, wherein the microcontroller activates the at least one relay which directs current from the energy source to at least one of the thermoelectric unit layers and wherein the at least one relay reconnects the at least one thermoelectric unit layer in series or parallel with another thermoelectric unit layer.

For example, the microcontroller: (1) defines a setpoint temperature (Tsp) and compares the Tsp to a temperature (Tc) of a container operatively associated with the thermoelectric heat pump assembly, wherein the microcontroller controls at least one relay to connect the at least one thermoelectric unit layer in series if Tc checks positive or equal against Tsp, and wherein the microcontroller deactivates the at least one relay if Tsp checks negative or equal against Tc; (2) defines a Tsp and compares the Tsp to Tc of a container operatively associated with the thermoelectric heat pump assembly, wherein the microcontroller activates the at least one relay to connect the at least one thermoelectric unit layer in parallel if Tc checks positive or equal against Tsp, and wherein the microcontroller deactivates the at least one relay if Tsp checks negative or equal against Tc; and/or (3) defines a Tsp and compares the Tsp to a Tc of a container operatively associated with the thermoelectric heat pump assembly, wherein the microcontroller activates the at least one relay to connect the at least one thermoelectric unit layer in parallel and the microcontroller activates the at least one relay to connect the at least one thermoelectric unit layer in series if Tsp checks positive or equal against Tc, and wherein the microcontroller deactivates the at least one relay if Tsp checks negative or equal against Tc. In a specific example, the Tc would check positive or equal if the Tc is greater than the Tsp plus 1° C., or 0.5° C., or 0.1° C.

The disclosure is further directed to a thermoelectric transport or storage device for thermally protecting temperature sensitive goods during transport. The thermoelectric transport and storage device can be configured so that it self-regulates temperature over pre-defined, adjustable cooling or heating profile. Advantageously, the device comprises a thermal isolation chamber for storing the temperature sensitive goods and at least one thermoelectric heat pump assembly, as described herein, thermally connected to the thermal isolation chamber and configured to control a temperature of the temperature sensitive goods during transport or storage at a selected steady-state temperature within a tolerable temperature variation for the temperature sensitive goods being transported or stored. The thermal isolation chamber can be made of thermally conductive metals and alloys, e.g., aluminum.

Non-limiting examples of temperature sensitive goods suitable for transport in the device include: semen, embryos, oocytes, cell cultures, tissue cultures, chondrocytes, nucleic acids, bodily fluids, organs, plant tissues, pharmaceuticals, vaccines, and temperature sensitive chemicals. In an embodiment the thermoelectric transport or storage device also has a robust shock proof exterior, capable of protecting sensitive goods during long periods of transport and storage.

In certain aspects of the disclosure, the transport or storage device typically also has a portable microprocessor, wherein the portable microprocessor is programmed to communicate with the thermoelectric transport or storage device upon activation. In addition, the device may also advantageously have an electrical-erasable-programmable read-only-memory (EEPROM) chip operatively associated with the thermoelectric transport or storage device. The EEPROM chip communicates with the portable microprocessor and the thermoelectric heat pump. The portable microprocessor also typically communicates with the EEPROM chip through a multi-master serial computer bus using I2C protocol and can store received time and temperature profiles related to the thermoelectric heat pump assembly.

In one exemplary configuration, the portable microprocessor communicates time and temperature profiles related to the thermoelectric heat pump to the EEPROM and also receives time and temperature profiles related to the thermoelectric heat pump from the EEPROM. The portable microprocessor can store the received time and temperature profiles related to the thermoelectric heat pump. Also, the portable microprocessor can be operatively associated with the thermoelectric transport or storage device through one or more DB connectors. In this exemplary embodiment, the portable microprocessor is often advantageously activated by the energy source of the thermoelectric transport or storage device.

The thermoelectric transport or storage device described herein, can also comprise reconfigurable circuitry suitable for a selected temperature input. In this embodiment, the thermoelectric unit layers are electrically reconfigurable to maintain a temperature profile during transport or storage. Typically, the circuitry comprises a programmable microprocessor programmed to actuate a temperature sensitive goods specific temperature profile.

The thermoelectric transport or storage device can also have at least one rotator structured and arranged to rotate the temperature sensitive goods within the thermal isolation chamber. This facilitates a uniform temperature of the goods during transport and enhances the effectiveness of maintaining the desired temperature.

The thermoelectric transport or storage device can also be configured to configured to control the temperature of the temperature sensitive goods within a selected tolerance for a specific temperature sensitive good, for example, a tolerance of less than about 10° C., less than: 8° C.; 5° C.; and/or 3° C.; and even less than: 1° C., 0.5° C. and/or 0.1° C.

Another aspect is the ability to program the thermoelectric transport or storage device with unique specific profiles suitable for the specific goods being transported and the needs of the users. For example, the device can be programmed to ship reproductive fluids at a selected and desired temperature to best preserve the fluids using very low tolerance variability levels of 0.1° C., until delivery, at which the device would be programmed to increase to a second selected and desired the temperature for clinical use.

Also with extremely sensitive temperature goods it is important to have a ramp down and/or ramp down period so as not to harm the goods due to a rapid change in temperature. To ramp down/up the temperature, the device can be programmed or configured to gradually increase or decrease the temperature over a set time period. For example, the device could be programmed to decrease/increase the temperature by 0.1 degrees every 20 minutes, down to a selected temperature. Thus, as can be seen, the device of the disclosure provides the user with the ability to specifically program the device with not just one profile, but with several temperature profiles (or sub-profiles), e.g., 3, 4, 5, etc. in accordance with parameters of the goods to be stored or transported. The activation of sub-profiles allows for increased flexibility in best protecting the specific temperature sensitive goods during transport.

The thermoelectric transport or storage device advantageously has at least one portable energy source, e.g. at least one, two, or three batteries, which is suitable to maintain the selected temperature for the temperature sensitive goods during transport of at least 72 hours, or at least 84 hours, and even 7 days, the selected temperature of the temperature sensitive goods compared to ambient temperature is at least 20° C., at least 30° C. or at least 40° C. Multiple batteries can be used to provide the necessary energy source.

Another aspect is the insulation. The insulation can be one or more vacuum insulators insulating the thermal isolation chamber. Vacuum insulators comprise at least one layer of reflective material having infrared emittance, in the infrared spectrum from about one micron to about one millimeter wavelength, of less than about 0.1. The vacuum insulators can also comprise at least one evacuated volume having an absolute pressure of less than about 10 Torr.

The thermoelectric transport or storage devices described herein can come in many sizes and shapes, e.g., 1'×2'; 4'×4', etc. As the sizes of the transport or storage device increase it can be that at least 2 thermoelectric heat pumps be incorporated therein (4, 8, 10, 15, etc.). The heat pumps can be reconfigurably connected between series and parallel configurations. Furthermore, the thermoelectric unit layers of each heat pump can also be reconfigurably connected between series and parallel providing greater control over the amount of heat generation of each thermoelectric unit layer and the heat pump in general.

The disclosure is also directed to a method of safely transporting temperature sensitive goods at a selected temperature profile during transport. The method can comprise the steps of:

(a) placing the temperature sensitive goods in a transportation device adapted to thermally isolate the temperature sensitive goods from outside environment, wherein the transportation device comprises at least one temperature control system adapted to actuate the selected temperature profile while the temperature sensitive goods are in the transportation device, the temperature control system comprising at least one thermoelectric heat pump as described above in thermal association with the temperature sensitive goods being transported; and (b) transporting the temperature sensitive goods while the transportation device is activated according to the selected temperature profile.

In certain embodiments, the disclosure further comprises loading a user-selected temperature profile specific to the temperature sensitive goods being transported by inserting a smart chip into a communication link, wherein the smart chip downloads the profile into the transport device.

In accordance with a other embodiments hereof, a thermal protection system, relating to thermally protecting temperature sensitive goods, comprising: at least one thermo-electric heat pump adapted to control at least one temperature of the temperature sensitive goods; wherein such at least one thermo-electric heat pump comprises at least one thermo-electric device adapted to active use of the Peltier effect; wherein such at least one thermo-electric heat pump comprises at least one thermal capacitor adapted to provide at least one thermal capacitance in thermal association with such at least one thermo-electric device; and wherein such at least one thermal capacitance is user-selected to provide intended thermal association with such at least one thermo-electric device, and wherein such at least one thermal capacitance can be embodied by a capacitance spacer block made of, for example, aluminum, copper, or other thermally conductive and capacitive alloys. Moreover, it provides such a thermal protection system: wherein such intended thermal association of such at least one least one thermal capacitance is user-selected to provide increased energy efficiency of operation of such at least one thermo-electric device as compared to such energy efficiency of operation of such at least one thermo-electric device without addition of such at least one least one thermal capacitor.

Additionally, it provides such a thermal protection system: wherein such intended thermal association of such at least one thermal capacitance is user-selected to allow usage of momentary-relay-based control circuitry in combination with at least one energy store to power such at least one thermo-electric device to achieve control of at least one temperature of the temperature sensitive goods. Also, it provides such a thermal protection system: wherein such control of such at least one temperature comprises controlling such at least one temperature to within a tolerance of less than about one degree centigrade. In addition, it provides such a thermal protection system: wherein such intended thermal association is user-selected to control usage of proportional control circuitry in combination with at least one energy store to power such at least one thermo-electric heat pump to control such at least one temperature of the temperature sensitive goods. And, it provides such a thermal protection system: wherein such control of such at least one temperature comprises controlling such at least one temperature to within a tolerance of less than one degree centigrade. Further, it provides such a thermal protection system: wherein such at least one thermo-electric heat pump comprises a minimum of one sandwich layer; wherein such sandwich layer comprises at least one set of such thermo-electric devices and at least one set of such thermal capacitors; wherein each such sandwich layer is suitable for thermally-conductively connecting to at least one other such sandwich layer; and wherein thermal conductance between essentially all such attached sandwich layers is greater than 10 watts per meter per degree centigrade.

Even further, it provides such a thermal protection system: wherein such at least one thermo-electric heat pump comprises at least one such sandwich layer comprising such set of such thermo-electric devices; wherein each thermo-electric device comprising such plurality is electrically connected in parallel with each other each thermo-electric device comprising such plurality; and wherein each set of such thermo-electric devices comprising such first sandwich layer is suitable for thermally-conductively connecting to at least one other such sandwich layer; and wherein thermal conductance between essentially all such attached sandwich layers is greater than 10 watts per meter per degree centigrade.

Moreover, it provides such a thermal protection system further comprising: at least one thermal isolator for thermally isolating the temperature sensitive goods. Additionally, it provides such a thermal protection system: at least one thermal isolator for thermally isolating the temperature sensitive goods, wherein such at least one thermal isolator comprises at least one vessel structured and arranged to contain the temperature sensitive goods; and wherein such at least one vessel comprises at least one heat-transferring surface structured and arranged to conductively exchange heat to and from such at least one temperature controller.

Also, it provides such a thermal protection system: wherein such at least one vessel comprises at least one re-sealable surface structured and arranged to ingress and egress the temperature sensitive goods to and from such at least one thermal isolator. In addition, it provides such a thermal protection system: wherein such at least one re-sealable surface comprises at least one seal structured and arranged to exclude at least one microorganism from such at least one vessel. And, it provides such a thermal protection system: wherein such at least one thermal isolator comprises at least one insulator for insulating the temperature sensitive goods. Further, it provides such a thermal protection system: wherein such at least one insulator comprises at least one layer of reflective material; and wherein infrared emittance of such reflective material is less than about 0.1, in the infrared spectrum from about one micron to about one millimeter wavelength.

Even further, it provides such a thermal protection system: wherein such at least one insulator comprises at least one evacuated volume; and wherein absolute pressure of such least one evacuated volume is less than about 10 Torr. Moreover, it provides such a thermal protection system: wherein such at least one thermal isolator comprises at least one goods rotator structured and arranged to rotate the temperature sensitive goods within such at least one thermal isolator. Additionally, it provides such a thermal protection system: wherein such at least one goods rotator is structured and arranged to self-power from at least one energy storage device.

Also, it provides such a thermal protection system: wherein such at least one energy storage device comprises at least one battery. In addition, it provides such a thermal protection system: wherein such thermo-electric heat pump comprises from about two to about nine vessel sandwich layers, each such vessel sandwich layer comprising at least one vessel set of such thermo-electric devices; and wherein such at least one vessel set comprises at least two thermo-electric devices. And, it provides such a thermal protection system: wherein such at least one vessel set comprises at least ten thermo-electric devices.

In accordance with another embodiment, a method is provided relating to use of at least one thermal protection system, relating to thermally protecting temperature sensitive goods, comprising the steps of: delivery, by at least one provider, of such at least one thermal protection system to at least one user, relating to at least one use, relating to at least one time period; wherein such at least one thermal protection system comprises at least one thermo-electric device adapted to active use of the Peltier effect to effect such control of at least one temperature; wherein such at least one thermo-electric device comprises at least one thermal capacitor adapted to provide at least one thermal capacitance in thermal association with such at least one thermo-electric device; and wherein such at least one thermal capacitor is user-selected to provide intended thermal association with such at least one thermo-electric device presetting of at least one set-point temperature of such at least one thermal protection system, by such at least one provider, prior to such delivery; and receiving value from at least one party benefiting from such at least one use. Further, it provides such a method, further comprising: providing re-use of such at least one thermal protection system, by such at least one provider; wherein such step of providing re-use comprises at least one cleaning step, and at least one set-point re-setting step. Even further, it provides such a method, further comprising: permitting other entities, for value, to provide such method.

In accordance with another embodiment hereof, the disclosure provides a method of engineering design of thermoelectric heat pumps, relating to designing toward maximizing heat pumped per unit of input power, comprising the steps of: accumulating at least one desired range of variables for each at least one design-goal element of such thermoelectric heat pump to be designed; discovering such maximum heat pumped per unit of input power; and finalizing such engineering design; wherein such step of discovering such maximum heat pumped per unit of input power comprises providing at least one desired arrangement of a plurality of thermo-electric devices, wherein essentially each thermoelectric device of such plurality of thermoelectric devices is associated with at least one user selectable thermal capacitance, holding each such at least one design-goal element within a respective such at least one desired range of variables, incrementally trial raising each such at least one user selectable thermal capacitance while performing such holding step, and essentially maximizing such at least one user selectable thermal capacitance while remaining within each respective such at least one desired range of variables; wherein at least one essentially maximum heat pumped per unit of input power may be achieved.

In accordance with another embodiment hereof, the disclosure provides a method, applied to shipping perishables: wherein such design-goal elements comprising ambient temperature, shipping container cost, shipping container weight, shipping container size, maximum variation of temperature of perishables required; wherein the shipping container cost, shipping container weight, shipping container size, variation of temperature of perishables are minimized while achieving essentially maximum heat pumped per unit of input power; wherein such shipping container comprises at least one arrangement of a plurality of thermo-electric devices; wherein essentially each thermo-electric device of such plurality of thermo-electric devices is associated with at least one user selectable thermal capacitance; wherein thermal capacitance of each such at least one user selectable thermal capacitance is determined by holding each such at least one design-goal element within a respective such at least one desired range of variables, incrementally trial raising each such at least one user selectable thermal capacitance while performing such holding step, and essentially maximizing such at least one user selectable thermal capacitance while remaining within each respective such at least one desired range of variables; and wherein at least one essentially maximum heat pumped per unit of input power is achieved.

In accordance with another embodiment hereof, the disclosure provides a method, applied to providing temperature conditioning of perishables in recreational vehicles: wherein such design-goal elements comprise ambient temperature, perishable cold storage container cost, perishable cold storage container weight, perishable cold storage container size, maximum variation of temperature of perishables required; wherein the cold storage container cost, perishable cold storage container weight, perishable cold storage container size, variation of temperature of perishables are minimized while achieving essentially maximum heat pumped per unit of input power; wherein such shipping container comprises at least one arrangement of a plurality of thermo-electric devices; wherein essentially each thermo-electric device of such plurality of thermo-electric devices is associated with at least one user selectable thermal capacitance; wherein thermal capacitance of each such at least one user selectable thermal capacitance is determined by holding each such at least one design-goal element within a respective such at least one desired range of variables, incrementally trial raising each such at least one user selectable thermal capacitance while performing such holding step, and essentially maximizing such at least one user selectable thermal capacitance while remaining within each respective such at least one desired range of variables; and wherein at least one essentially maximum heat pumped per unit of input power is achieved.

In accordance with another embodiment hereof, the disclosure provides a method, relating to protectively transporting equine semen, comprising the steps of: providing at least one transportation vessel adapted to seal such horse semen in isolation from outside environment; providing at least one temperature control system adapted to control temperature of the horse semen while in such at least one transportation vessel; and providing that such at least one temperature control system comprises at least one thermoelectric heat pump; wherein such at least one thermo-electric heat pump is adapted to controlling temperature of such horse semen to remain in at least one temperature range assisting viability of such horse semen. Moreover, it provides such a method wherein such at least one thermoelectric heat pump comprises at least one Peltier thermoelectric device in thermal association with at least one thermal capacitor having at least one thermal capacitance designed to provide intended to provide intended operational features of such at least one thermo-electric heat pump.

In accordance with another embodiment, a thermoelectric heat pump assembly may comprise at least three identical thermoelectric units arranged electrically and thermally in series and configured for simultaneous use of the Peltier effect. A thermally capacitive spacer block is disposed between each of the at least three thermoelectric units. An energy source is coupled to the at least three thermoelectric units and configured to provide a current source to each of the serially connected thermoelectric units. A heat sink is coupled to the at least three thermoelectric units and thermally capacitive spacer blocks. A microcontroller is operatively associated with the energy source to direct current from the energy source to the at least three thermoelectric units.

Particular embodiments may comprise one or more of the following features. The microcontroller defines a Tsp and compares the Tsp to a Tc coupled to the thermoelectric heat pump and activates a simultaneous use of the Peltier effect for a duration to reduce a difference in temperature between the Tsp and Tc. The Tsp and Tc can be compared with a resolution of approximately 0.5 degrees Celsius. The Tsp and Tc can also be compared with a resolution of approximately 0.0625 degrees Celsius. The microcontroller compares a change of rate of the Tc and the Tsp. The microcontroller compares a change of rate of the Tc and the Tsp. The Tsp can be defined as a range of temperatures. The microcontroller is configured to receive a user defined Tsp. At least three thermoelectric units are configured for simultaneous use of the Peltier effect such that a first thermoelectric unit transfers heat to a second thermoelectric unit while the second thermoelectric unit transfers heat to a third thermoelectric unit. A thermal capacitor disposed between each of the thermoelectric units. The thermoelectric heat pump comprises four or more thermoelectric units in each thermoelectric heat pump. A fan is disposed adjacent to the heat sink and configured to aid in removal of heat from the thermoelectric heat pump. Each thermoelectric unit comprises at least 127 coupled pairs of thermocouples and a resistance of at least 3 ohms. In an embodiment, each thermocouple has a resistance of 3.75 ohms. In another embodiment, each thermoelectric unit comprises at least 287 coupled pairs of thermocouples and a resistance of at least 3 ohms. Optionally, each thermoelectric unit can also have a resistance of 8.5 ohms. The thermoelectric heat pump assembly can also be used in method of safely transporting temperature sensitive goods at a selected temperature profile during transport. Temperature sensitive goods are placed in a thermal isolation chamber within the transportation device. The thermal isolation chamber is adapted to thermally isolate the temperature sensitive goods from an outside environment. The thermal isolation chamber is coupled to the at least three thermoelectric units. A temperature of the thermal isolation control system is controlled by activating the Peltier effect of the at least three thermoelectric units.

In accordance with another embodiment, a thermoelectric heat pump assembly may comprise at least three thermoelectric units arranged electrically and thermally in series and configured for simultaneous use of the Peltier effect. A thermally capacitive spacer block is disposed between each of the at least three thermoelectric units. An energy source is coupled to the at least three thermoelectric units and configured to provide a current source to each of the serially connected thermoelectric units. A heat sink is coupled to the at least three thermoelectric units and thermally capacitive spacer blocks Particular embodiments may comprise one or more of the following features. Each of the thermoelectric units are substantially identical. Each of the thermoelectric units includes a same size. Each of the thermoelectric units is configured to transfer a same amount of heat. Each of the thermoelectric units is configured with a same resistance. An energy source is coupled to the at least three thermoelectric units and configured to provide a current source to each of the serially connected thermoelectric units. The thermoelectric units are identical. The thermoelectric heat pumps are configured to provide temperature control to at least one temperature to within a tolerance of less than about one degree centigrade.

In accordance with another embodiment, a thermoelectric heat pump assembly may comprise at least three thermoelectric units arranged electrically and thermally in series and configured for simultaneous use of the Peltier effect. A thermally capacitive spacer block is disposed between the at least three thermoelectric units.

In an aspect, a thermal protection system relating to thermally protecting temperature sensitive goods can comprise a vessel configured to contain the temperature sensitive goods. A stack of at least three identical thermoelectric modules can be thermally coupled to the vessel and arranged electrically and thermally in series and configured such that each thermoelectric module within the stack simultaneously uses the Peltier effect. A thermally capacitive spacer block can be disposed between each of the at least three thermoelectric modules. An energy source can be coupled to the stack of at least three thermoelectric modules and configured to provide a current source to each of the serially connected thermoelectric modules. A heat sink can be coupled to the stack of at least three thermoelectric modules and thermally capacitive spacer blocks opposite the vessel. A microcontroller can be operatively associated with the energy source to direct current from the energy source to the stack of at least three thermoelectric modules.

The thermal protection system can further comprise a system wherein the microcontroller defines a setpoint temperature (Tsp) and compares the Tsp to a temperature (Tc) of a container coupled to the stack of at least three identical thermoelectric modules and activates a simultaneous use of the Peltier effect for a duration to reduce a difference in temperature between the Tsp and Tc. The microcontroller can be configured to vary a voltage to the thermoelectric modules by varying a pulse-width-modulation (PWM), a pulse-frequency-modulation (PFM), or a thermal capacitance of the thermal protection system. The Tsp can be defined as a range of temperatures and the Tsp and Tc can be compared with a resolution greater than or equal to 0.01 degrees Celsius. The microcontroller can be configured to received a user defined Tsp. Each thermoelectric module can comprises at least 127 coupled pairs of thermocouples and a resistance of at least 1 ohm.

In another aspect, a thermal protection system relating to thermally protecting temperature sensitive goods can comprise a vessel configured to contain the temperature sensitive goods. A stack of at least three thermoelectric modules can be thermally coupled to the vessel and arranged electrically and thermally in series and configured such that each thermoelectric module within the stack simultaneously use the Peltier effect. A thermally capacitive spacer block can be disposed between each of the at least three thermoelectric modules. An energy source can be coupled to the stack of at least three thermoelectric modules and configured to provide a current source to each of the serially connected thermoelectric modules. A heat sink can be coupled to the stack of at least three thermoelectric modules and thermally capacitive spacer blocks opposite the vessel.

The thermal protection system can further comprise a system wherein each of the thermoelectric modules are substantially identical. Each of the thermoelectric modules can include a same number of thermocouples. The stack of at least three thermoelectric modules can comprise a delta T that increases for each thermoelectric module in a first direction along the stack and an amount of heat transferred by the thermoelectric module (Qc) that increases for each thermoelectric module in a second direction opposite the first direction. Four or more thermoelectric modules can be in each stack of at least three thermoelectric modules. The stack of at least three identical thermoelectric modules can comprises a height greater than or equal to 2.5 cm, thereby providing a space for insulation around the stack of at least three identical thermoelectric modules between the vessel and the heat sink. The stack of at least three thermoelectric modules can be configured to provide temperature control to at least one temperature to within a tolerance of less than about six degrees centigrade.

In another aspect, a thermal protection system relating to thermally protecting temperature sensitive goods can comprise a vessel configured to contain the temperature sensitive goods. A stack of at least two thermoelectric modules can be coupled to the vessel and arranged electrically and thermally in series and configured such that each thermoelectric module within the stack simultaneously use the Peltier effect. A thermally capacitive spacer block can be thermally coupled to the stack of at least two thermoelectric modules, and a heat sink can be coupled to the stack of at least two thermoelectric modules and thermally capacitive spacer block opposite the vessel.

The thermal protection system can further comprise a system wherein the thermally capacitive spacer block is disposed between the stack of at least two thermoelectric modules. At least one energy source can be operably connected to each thermoelectric module, wherein the energy source is suitable to provide a current, the thermal protection system being configured so that each individual thermoelectric module has a ratio of input current to maximum available current (I/Imax) of 0.17 or less at a steady-state when a change in temperature (ΔT) of the thermal protection system between the vessel and the heat sink is about 20° C. and heat removal (Q) is about 0 Watts. Each of the thermoelectric modules are substantially identical. Each of the thermoelectric modules can include a same size. The stack of at least two thermoelectric modules can be configured to provide temperature control to at least one temperature to within a tolerance of less than about fifteen degrees centigrade.

In yet another aspect a method of safely transporting temperature sensitive goods at a selected temperature profile during transport using a thermal protection system assembly described above can comprise placing the temperature sensitive goods in a thermal isolation chamber within the transportation device, coupling the thermal isolation chamber to the stack of at least two thermoelectric modules and controlling a temperature of the thermal isolation control system by activating the Peltier effect of the at least two thermoelectric modules. The thermal isolation chamber can be adapted to thermally isolate the temperature sensitive goods from an outside environment.

BRIEF DESCRIPTION OF THE FIGURES

FIG. 18 shows a schematic view of a possible control logic diagram.

FIGS. 24A and 24B show charts, each of which illustrate how various embodiments maximize efficiency of operation compared to previously available thermoelectric heat pump systems; the charts further illustrate how various embodiments can be configured to maximize heat pumped per unit of input power during overall use, while minimizing the ratio of input current to maximum available current at a given steady-state temperature.

FIGS. 32A-32C show charts, each of which illustrate how various embodiments maximize efficiency of operation compared to previously available thermoelectric heat pump systems; the charts further illustrate how various embodiments can be configured to maximize heat pumped per unit of input power during overall use, while minimizing the ratio of input current to maximum available current at a given steady-state temperature.

DETAILED DESCRIPTION

Steady-state, as used herein, is the state at which, during operation the heat pump assembly, the heat pump assembly reaches a selected temperature. For example, the heat pump assembly reaches a set temperature and the system is substantially balanced and is simply maintaining the set temperature.

Ambient Temperature is the temperature of the air or environment surrounding a thermoelectric cooling system; sometimes called room temperature.

COP (Coefficient of Performance) is the ratio of the heat removed or added, in the case of heating, divided by the input power.

DTmax is the maximum obtainable temperature difference between the cold and hot side of the thermoelectric elements within the module when Imax is applied and there is no heat load applied to the module.

Heat pumping is the amount of heat (Q) that a thermoelectric device is capable of removing, or "pumping", at a given set of operating parameters. For example, at a steady-state, when change in temperature ($\Delta T$) of the heat pump assembly at the top end compared to the bottom end of the heat pump assembly is 20° C. and heat (Q) is 0.5 Watts, or alternatively when change in temperature ($\Delta T$) of the heat pump assembly at the top end compared to the bottom end of the heat pump assembly is 40° C. and heat (Q) is 1.

Heat sink (also a cold sink when run in reverse) is a device that is attached to the hot side of thermoelectric module. It is used to facilitate the transfer of heat from the hot side of the module to the ambient.

Imax is the current that produces DTmax when the hot-side of the elements within the thermoelectric module are held at 300 K.

Peltier Effect is the phenomenon whereby the passage of an electrical current through a junction consisting of two dissimilar metals results in a cooling effect. When the direction of current flow is reversed heating will occur.

Qmax is the amount of heat that a TE cooler can remove when there is a zero degree temperature difference across the elements within a module and the hot-side temperature of the elements are at 300 K.

Thermal conductivity relates the amount of heat (Q) an object will transmit through its volume when a temperature difference is imposed across that volume.

Vmax is the voltage that is produced at DTmax when Imax is applied and the hot-side temperature of the elements within the thermoelectric module are at 300 K.

Figure 1A:
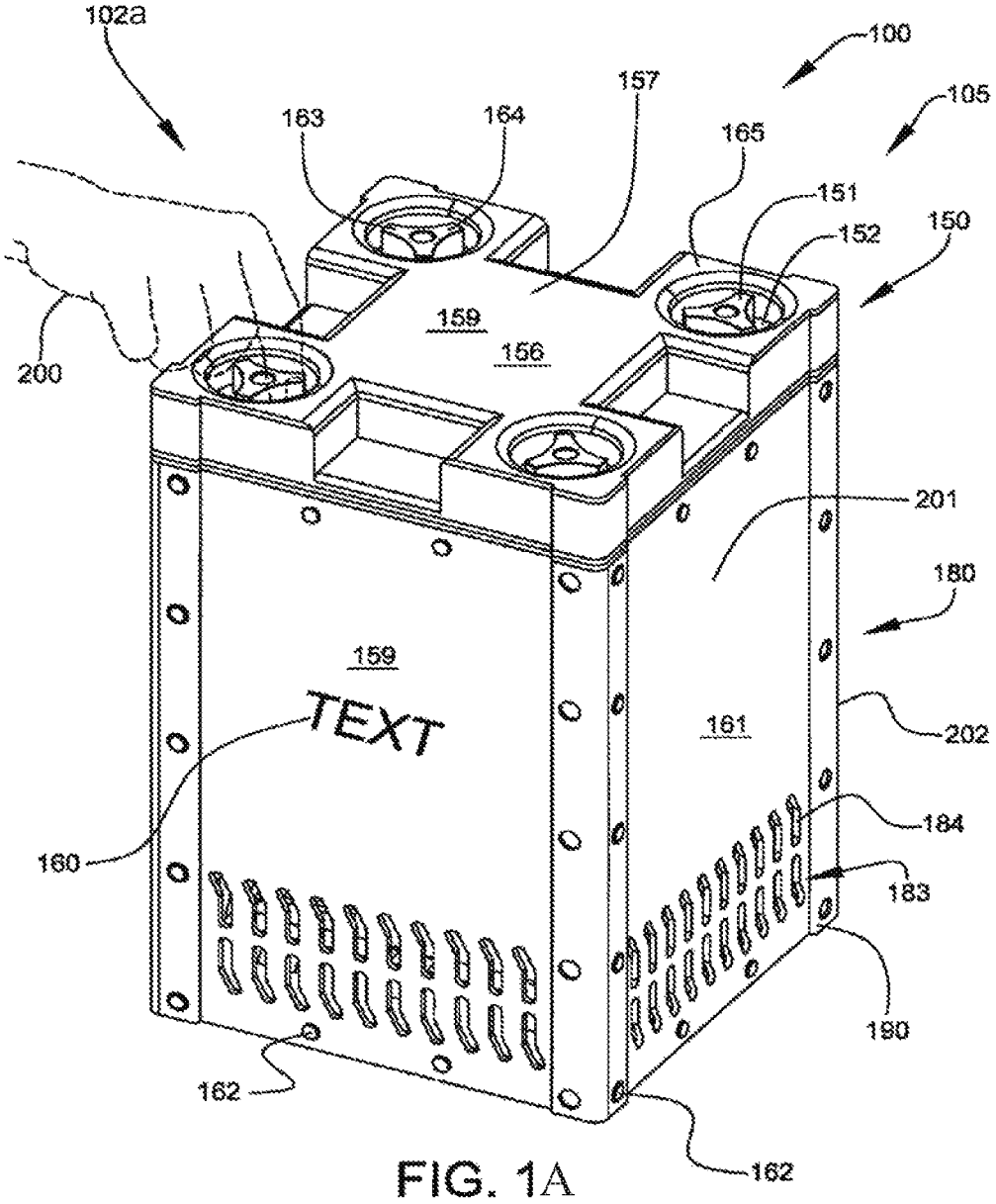
FIGS. 1A and 1B show a perspective views, illustrating various embodiments of iso-thermal transport and storage systems.
Figure 1B:
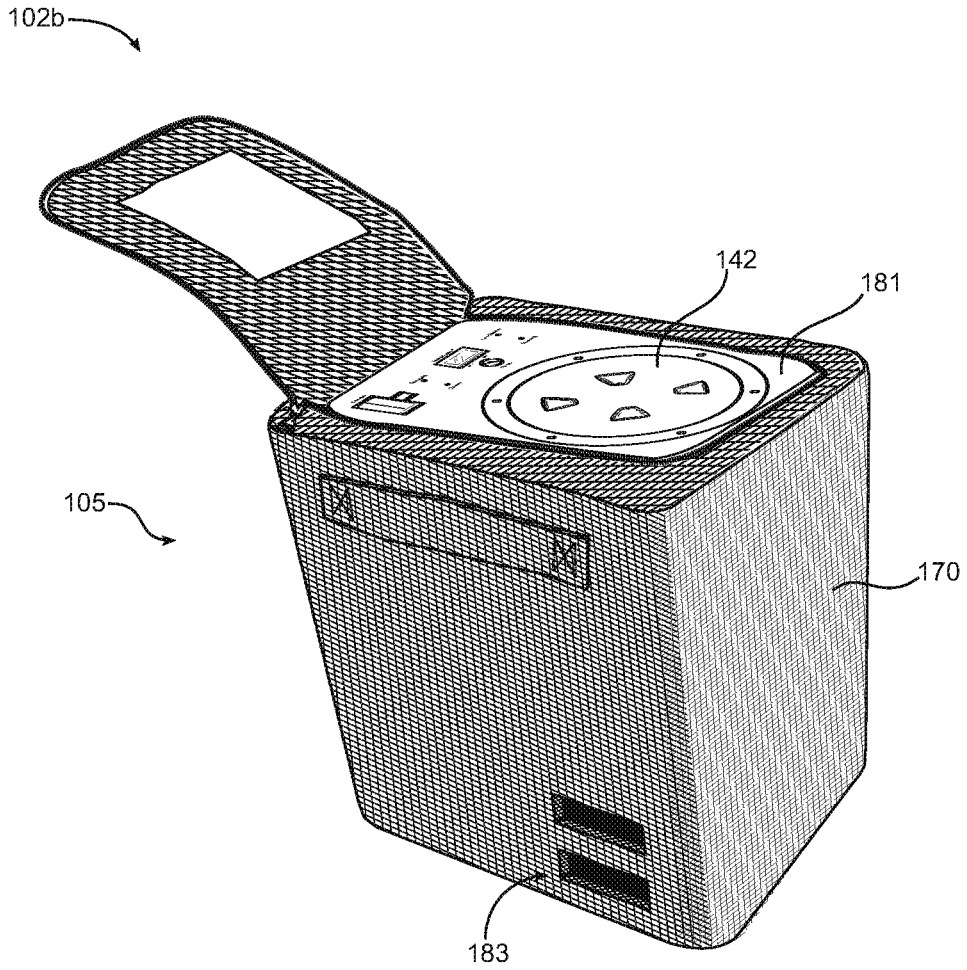

FIGS. 1A and 1B show perspective views, illustrating at least two embodiments 102 of iso-thermal transport and storage system 100, according to embodiments of the present disclosure. Iso-thermal transport and storage system 100 can be designed to protect sensitive and perishable sensitive goods 139 (see FIG. 4, FIG. 5 and FIG. 6), mammal biological matter, mammal reproductive cells and/or tissues, horse semen (at least embodying herein a thermal protection system, relating to thermally protecting temperature sensitive goods). Upon reading the teachings of this specification, those with ordinary skill in the art will now appreciate that, under appropriate circumstances, considering issues such as changes in technology, user requirements, etc., other sensitive and perishable sensitive goods, such as cell and tissue cultures, nucleic acids, semen, stem-cells, ovaries, equine reproductive matter, bodily fluids, tissues, organs, and/or embryos plant tissues, blood, platelets, fruits, vegetables, seeds, live insects and other live samples, barely-frozen foods, pharmaceuticals, vaccines, chemicals, sensitive goods yet to be developed, etc., may suffice.

Outer enclosure 105 can comprise a rectangular-box construction, as shown. Outer enclosure 105 can include lid portion 150, enclosure portion 180, and base portion 190, as shown. External dimensions of outer enclosure 105 can be about 14 inches in length with a cross-section of about 9-inches square, as shown.

Lid portion 150 can attach to enclosure portion 180, with at least one thumbscrew 151 and at least one fibrous washer 152, as shown and explained herein. When lid portion 150 attaches to enclosure portion 180, such attachment can provide an airtight seal, as shown, preventing contamination of enclosure portion 180 from external contaminants. Leakages of external contaminants, including microorganisms, into enclosure portion 180 can be prevented by applying pressure between at least one raised inner-portion 158, of lid portion 150, and threaded cap 142, as shown (also see FIG. 2 and FIG. 3) (at least herein embodying wherein said at least one vessel comprises at least one re-sealable surface structured and arranged to ingress and egress the temperature sensitive goods to and from said at least one thermal isolator) (at least herein embodying wherein said at least one re-sealable surface comprises at least one seal structured and arranged to exclude at least one microorganism from said at least one vessel). Upper-lid raised inner-portion 158 of lid portion 150 can be shaped, as shown, by milling or alternately molding. Upper-lid raised inner-portion 158 can seal to the top of threaded cap 142 (see FIG. 2 and FIG. 3).

Fibrous washer 152 can comprise an outside diameter of about ½ inch, an inner diameter of about ¼ inch, and a thickness of about 0.08 inch. Over-tightening of thumbscrew 151 may cause cracking or distortion of lid portion 150 or degradation of fibrous washer 152. Fibrous washer 152 can protect at least one lid portion 150 from at least one user 200 damaging lid portion 150, due to over-tightening of thumbscrew 151. Fibrous washer 152 can withstands high compression loads, up to 2000 pounds per square inch (psi) and can prevent vibration between mating surfaces of lid portion 150 and enclosure portion 180. Also, each fibrous washer 152 can provide sufficient friction to prevent loosening of each respective thumbscrew 151, as shown. Further, fibrous washer 152 can comprise a flat, deformable, inexpensive-to-produce, readily available, vulcanized, fibrous material, adhering to ANSI/ASME B18.22.1 (1965 R1998). Upon reading the teachings of this specification, those with ordinary skill in the art will now appreciate that, under appropriate circumstances, considering issues such as changes in technology, user requirements, etc., other washer materials, such as gasket paper, rubber, silicone, metal, cork, felt, Neoprene, fiberglass, a plastic polymer (such as polychlorotrifluoroethylene), etc., may suffice.

Thumbscrew 151 can feature at least one plastic grip 163, possibly comprising at least one tang 164, as shown. User 200 can grasp plastic grip 163 to tighten or loosen thumbscrew 151, using at least three fingers. User 200 can use tang 164 to apply rotary pressure to plastic grip 163 for tightening or loosening of thumbscrew 151, as shown. Upon reading this specification, those skilled in the art will now appreciate that, under appropriate circumstances, considering such issues as future technology, cost, application requirements, etc., other grips, such as, for example, interlocking heads, wings, friction, etc., may suffice.

Thumbscrew 151 can comprise at least one 300-series stainless-steel stud with about ¼-20 inch threads, mounted in phenolic thermosetting resin (possibly reinforced laminate produced from a medium weave cotton cloth impregnated with a phenolic resin binder, MIL-i-24768/14 FBG). Plastic grip 163 can have about a 1½ inch wide top, can be about ⅝ inch thick, and can have about a ¼-inch offset between top portion of screw thread 148 and plastic grip 163. Screw thread 148 can be about ¾ inch long. Thumbscrew 151 can comprise part number 57715K55 marketed by McMaster-Carr. Upon reading the teachings of this specification, those with ordinary skill in the art will now appreciate that, under appropriate circumstances, considering issues such as changes in technology, user requirements, etc., other thermosetting composites, such as polyester, epoxy, vinyl ester matrices with reinforcement fibers of glass, carbon, aramid, etc., may suffice.

Stainless steel possesses wear resistance properties appropriate to withstand rough treatment during commercial transport and storage. Stainless steel also provides corrosion proofing to ensure longevity of thumbscrew 151 for applications when embodiment 102 of iso-thermal transport and storage system 100 experiences moisture or corrosive environments. Upon reading this specification, those skilled in the art will now appreciate that, under appropriate circumstances, considering such issues as future technology, cost, application requirements, etc., other screw materials, such as, for example, plastics, other metals, cermets, etc., may suffice.

Upon reading the teachings of this specification, those with ordinary skill in the art will now appreciate that, under appropriate circumstances, considering issues such as changes in technology, user requirements, etc., other fastening means, such as adhesives, fusion processes, other mechanical fastening devices including screws, nails, bolt, buckle, button, catch, clasp, fastening, latch, lock, rivet, screw, snap, and other fastening means yet to be developed, etc., may suffice.

At least one raised section 165 of lid portion 150 can surrounds thumbscrew 151, as a protective guard, to protect thumbscrew 151 from damage or accidental adjustment, as shown. Raised section 165 can be about 1¼ inch tall, about 3¼ inches wide, and about 3¼ inches long, and can be located at each of the four corners of lid portion 150, as shown. Upon reading the teachings of this specification, those with ordinary skill in the art will now appreciate that, under appropriate circumstances, considering issues such as changes in technology, user requirements, etc., other protective guards, such as, for example, protective rims, gratings, handles, blocks, buffers, bulwarks, pads, protections, ramparts, screens, shields, wards and other such protective guards yet to be developed, etc., may suffice.

Figure 3:
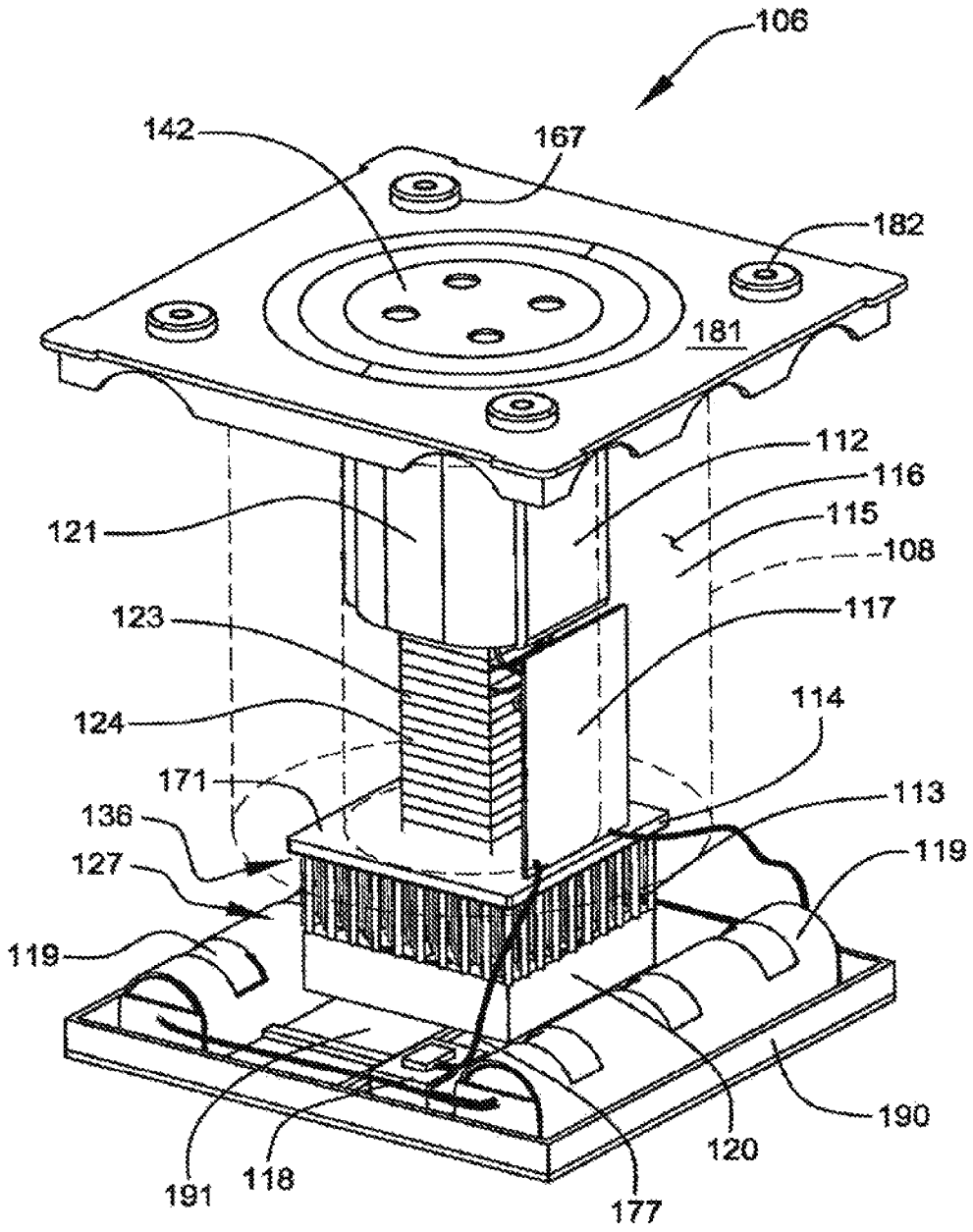
FIG. 3 shows a partially disassembled perspective view, illustrating arrangement of interior components of the embodiment of iso-thermal transport and storage system.
Figure 4:
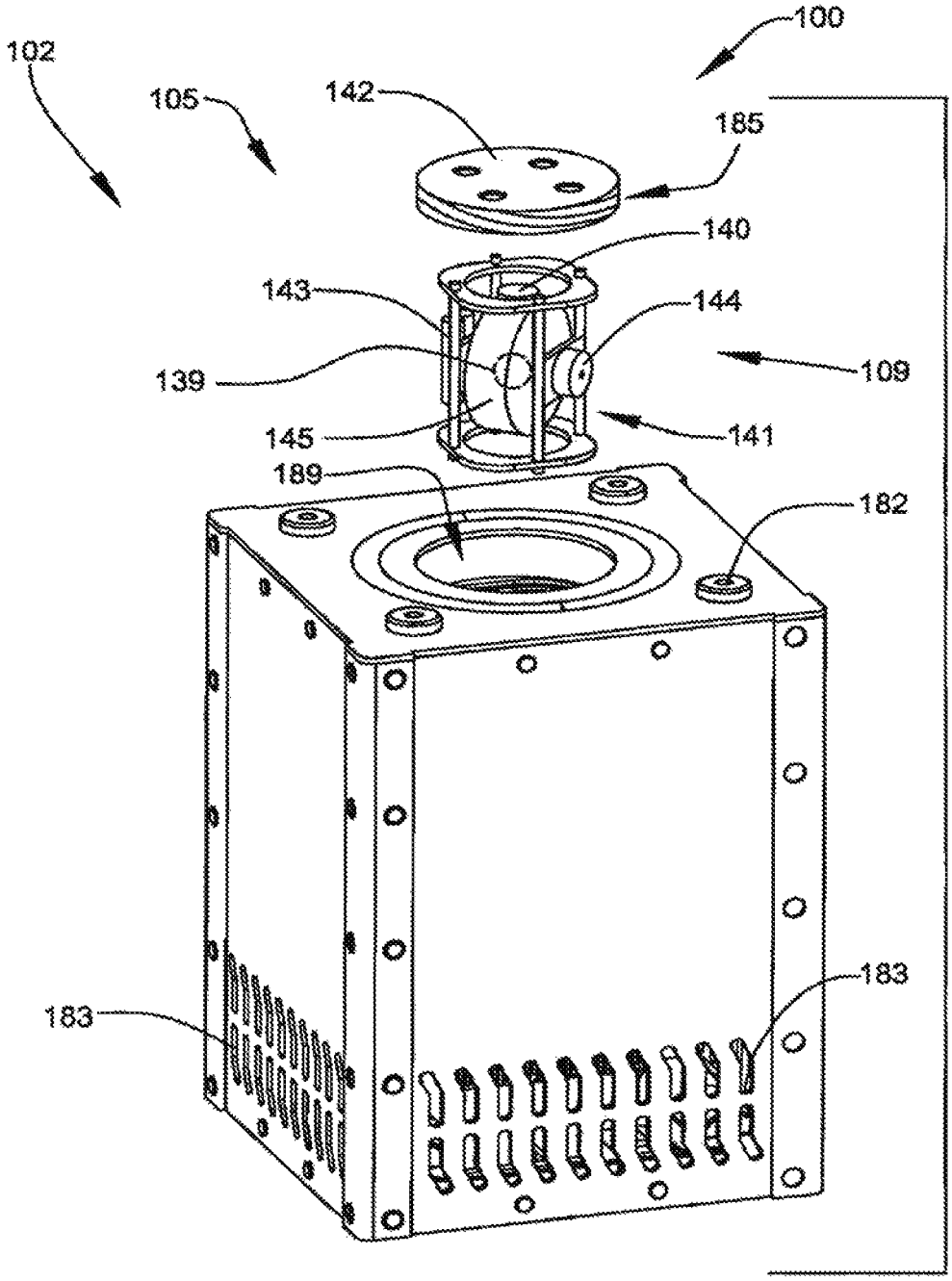
FIG. 4 shows an exploded perspective view, illustrating a mating assembly relationship between a sample rotating assembly and the outer enclosure of the iso-thermal transport and storage system.

Enclosure portion 180 can contain a means to accept at least one screw thread 148 on thumbscrew 151, threaded insert 182, as shown in FIG. 3 and FIG. 4. Internal thread size of threaded insert 182 can be about ¼-20 with a barrel diameter of about ⅓ inch, and a flange thickness of about 1/12 inch. Length of threaded insert 182 can be about 9/16 inch. Threaded insert 182 can be molded into, or, alternately, swaged into, enclosure portion 180, as shown in FIG. 3 and FIG. 4. Threaded insert 182 can be made of die-cast zinc to provide rust and weather resistance. Threaded insert 182, as used in embodiment 102, can comprise part number 91316A200 sold by McMaster-Carr. Upon reading the teachings of this specification, those with ordinary skill in the art will now appreciate that, under appropriate circumstances, considering issues such as changes in technology, user requirements, etc., other threaded inserts, such as self-tapping, ultrasonic inserts for use on plastic, metal, or wood-base materials yet to be developed, etc., may suffice.

Inner-layer 155, located within lid portion 150, can be formed from urethane, as shown. Inner-layer 155 can be about 1¼ inches thick. Inner-layer 155 can be formed from expanded-urethane semi-rigid foam having a density of about of 2 pounds per cubic foot (lb/cu. ft.). Inner-layer 155 can utilize part number SWD-890 as produced by SWD Urethane Company. Urethane is a thermoplastic elastomer that combines positive properties of plastic and rubber. Urethane-foam cells can be created by bubbling action of gases that create small air-filled pockets (possibly no more than 1/10 inch in diameter) that are beneficial for creating both resistance to thermal transfer and structural integrity. Further, the urethane foam can act as an impact absorber to protect components of iso-thermal transport and storage system 100 and sensitive and perishable sensitive goods 139 from mechanical shock and vibration during storage and transport, as shown. Upon reading the teachings of this specification, those with ordinary skill in the art will now appreciate that, under appropriate circumstances, considering issues such as changes in technology, user requirements, etc., other forming means, such as other urethane foaming techniques/materials, plastic or other material, for example, polyvinyl chloride, polyethylene, polymethyl methacrylate, and other acrylics, silicones, polyurethanes, or materials such as composites, metals or alloys yet to be developed, etc., may suffice.

Inner-layer 155 of lid portion 150 can be encapsulated in outer-surfacing layer 156 that can comprise a tough semi-rigid-urethane plastic, as shown. Outer-surfacing layer 156 can provide durability and protection for embodiment 102 of iso-thermal transport and storage system 100 during rough handling and incidents of mechanical shock and vibration. Outer-surfacing layer 156 can be tough and amply flexible to withstand direct impact loads associated with normal commercial storage and transportation, as defined by ASTM D3951-98 (2004) Standard Practice for Commercial Packaging. Outer-surfacing layer 156 can be about ⅛ inch thick, as shown, and can be about 7 lb/cu. ft. density. Outer-surfacing layer 156 can utilize part number SWD-890 as produced by SWD Urethane Company.

Vacuum insulated panels (VIPs) can be incorporated within lid portion 150 as VIP vacuum-panel 157 and in VIP insulation 108, as shown (also see FIG. 7) (at least embodying herein at least one thermal isolator for thermally isolating the temperature sensitive goods) (at least herein embodying wherein said at least one thermal isolator comprises at least one vacuum insulator for vacuum-insulating the temperature sensitive goods). VIPs can use the thermal insulating effects of a vacuum to produce highly efficient thermal insulation thermal insulation values (R-values) as compared to conventional thermal insulation, as shown. VIP vacuum-panel 157 and VIP insulation 108 can comprise NanoPore HP-150 core as made by NanoPore, Incorporated. NanoPore HP-150 core, which can comprises a thermal insulation for embodiment 102 of iso-thermal transport and storage system 100, has an R-value of about R-30 per inch and operates over a temperature range from about −200 degrees centigrade (° C.) to about 125° C. VIP vacuum-panel 157 and VIP insulation 108 can comprise layers of reflective film, having less than about 0.1, in the infrared spectrum from about one micron to about one millimeter wavelength, separating evacuated volumes, having pressure levels of less than 10 Torr. (at least herein embodying wherein said at least one vacuum insulator comprises at least one layer of reflective material; and at least herein embodying wherein infrared emittance of said reflective material is less than about 0.1, in the infrared spectrum from about one micron to about one millimeter wavelength; and at least herein embodying wherein absolute pressure of said least one evacuated volume is less than about 10 Torr).

VIP vacuum-panel 157, as used in the present disclosure, can be encased in urethane foam to protect VIP vacuum-panel 157 from mechanical damage during usage of embodiment 102 of iso-thermal transport and storage system 100, as shown. The thermal insulation of VIP vacuum-panel 157 becomes more effective when lid-horizontal decking-surface 153 (see FIG. 2) is in full contact with enclosure upper-horizontal decking-surface 181 (see FIG. 3), as shown.

Lid portion 150 also can provide at least one substantially flat-surface 159 that serves as a location for displaying at least one indicia 160, as shown. User 200 may place indicia 160 on at least one flat-surface 159, as shown. Indicia 160 may aid in designating ownership, advertising, or warnings for embodiment 102 of iso-thermal transport and storage system 100 and/or the contents contained in embodiment 102 of iso-thermal transport and storage system 100, as shown.

At least one rivet 162 can be used when enclosure portion 180 is formed from at least one wall section 201 and at least one corner section 202, which require a fastening means to join the sections together, as shown. Wall section 201 can be about ⅛ inch thick, made from aluminum alloy 6061, T6 tempering, and/or anodized coated. Corner section 202 can be about ⅛ inch thick, made from aluminum alloy 6061, T6 tempering, and/or anodize coated. At least one rivet 162 can be used to hold at least one wall section 201 attach to at least one corner section 202. Rivet 162 can be selected to withstand tension loads parallel to the longitudinal axis of rivet 162 and sheer loads perpendicular to the longitudinal axis of rivet 162.

Rivet 162 can comprise a blind rivet, alternately a solid rivet. Rivet 162 can be made from aluminum alloy 2024, as shown. Rivet 162 can have a head of about ⅓ inch diameter and can has a shaft of about 5⁄32 inch diameter. Rivet 162 can comprise part number 97525A470 from McMaster-Carr. Hole size (in wall section 201 and corner section 202) for rivet 162 may range from about 0.16 inch to about 0.17 inch in diameter. The shaft of rivet 162 can be about ½ inch diameter and can be upset to form a buck-tail head about ⅓ inch diameter after being inserted through holes, in wall section 201 and corner section 202, located near at least one corner of outer enclosure 105, as shown herein. Upon reading the teachings of this specification, those with ordinary skill in the art will now appreciate that, under appropriate circumstances, considering issues such as changes in technology, user requirements, etc., other securing means, such as bolts, buckles, buttons, catches, clasps, fastenings, latches, locks, rivets, screws, snaps, adapters, bonds, clamps, connections, connectors, couplings, joints, junctions, links, ties yet to be developed, etc., may suffice. User 200 may impart rough treatment to embodiment 102; thus, the design can employ plastic material capable of absorbing impact forces. The nature of the construction of embodiment 102, in combination with expandable urethane 115 as insulation, assists isolation of thermo-electric assembly 123, as shown in FIG. 3, which is prone to damage from mechanical shock and/or vibration, from mechanical shock. Upon reading the teachings of this specification, those with ordinary skill in the art will now appreciate that, under appropriate circumstances, considering issues such as changes in technology, user requirements, etc., other impact absorption materials, for example, polyvinyl chloride, polyethylene, polymethyl methacrylate, and other acrylics, silicones, polyurethanes, composites, rubbers, soft metals or other such materials yet to be developed, etc., may suffice.

Enclosure portion 180 comprises at least one vent 183, located on at least one vertical surface 161, in close proximity to base portion 190, as shown. Vent 183 can allow ambient air to freely enter and circulate throughout at least one interior portion of outer enclosure 105, using at least one fan 120, as shown (also see FIG. 7). Vent 183 can provide about a 25% free flow opening (of the lower portion of wall section 201), through which air may be drawn in or exhausted, as shown. Vent 183 can comprise about 80 slots 184, each about ⅓ inch wide and about 1 inch high, as shown. Upon reading the teachings of this specification, those with ordinary skill in the art will now appreciate that, under appropriate circumstances, considering issues such as changes in technology, user requirements, etc., other opening means, such as holes, apertures, perforations, slits, or windows yet to be developed but which are capable of ambient air ingress and egress, etc., may suffice.

Base portion 190 may use at least one rivet 162 to connect to enclosure portion 180, thereby providing structural integrity for embodiment 102, as shown (also see FIG. 3). Upon reading the teachings of this specification, those with ordinary skill in the art will now understand that, under appropriate circumstances, considering issues such as changes in technology, user requirements, etc., other fastening devices, such as bolts, buckles, clasps, latches, locks, screws, snaps, clamps, connectors, couplings, ties or other fastening means yet to be developed, or fusion welding, adhesives, etc., may suffice.

Base portion 190 further can provide a mounting surface for at least one battery system 119 and can be a means for enclosing enclosure portion 180 from the bottom, as shown (also see FIG. 3). Upon reading the teachings of this specification, those with ordinary skill in the art will now appreciate that, under appropriate circumstances, considering issues such as changes in technology, user requirements, etc., other enclosing means, such as lids, caps, covers, hoods, floors, bottoms or other such enclosing device yet to be developed, etc., may suffice.

FIG. 1B shows a perspective view of thermoelectric transport or storage device 102*b*. Thermoelectric transport or storage device 102*b* comprises outer enclosure 105, inside of which is disposed a vessel or container 121. Vessel 121 is configured to safely contain temperature sensitive and perishable goods 139 for storage, transportation, and shipping. Vessel 121 can be placed within, or accessed from, threaded cap 142, which can be disposed on or within enclosure upper-horizontal decking-surface 181. A vent 183 can be formed is a side surface of outer enclosure 105 to allow ambient air from without thermoelectric transport or storage device 102*b* to be circulated by fan 120 within storage device 102*b* to assist in controlling a temperature of temperature sensitive and perishable goods 139. In an embodiment, a carrying case 170 can optionally be disposed around outer enclosure 105 to add additional padding, covering, protection, or information to the outer enclosure. Carrying case 170 can be formed of cloth, plastic, or any other natural or synthetic material, and can include one or more handles or adjustable openings. The adjustable openings that can be temporarily opened or closed by zippers, snaps, hook and loop fasteners, buttons, latches, cords, or other suitable devices to provide or restrict access to various portions of thermoelectric transport or storage device 102*b*, including threaded cap 142, vessel 121, upper-horizontal decking-surface 181, and vent 183.

Figure 2A:
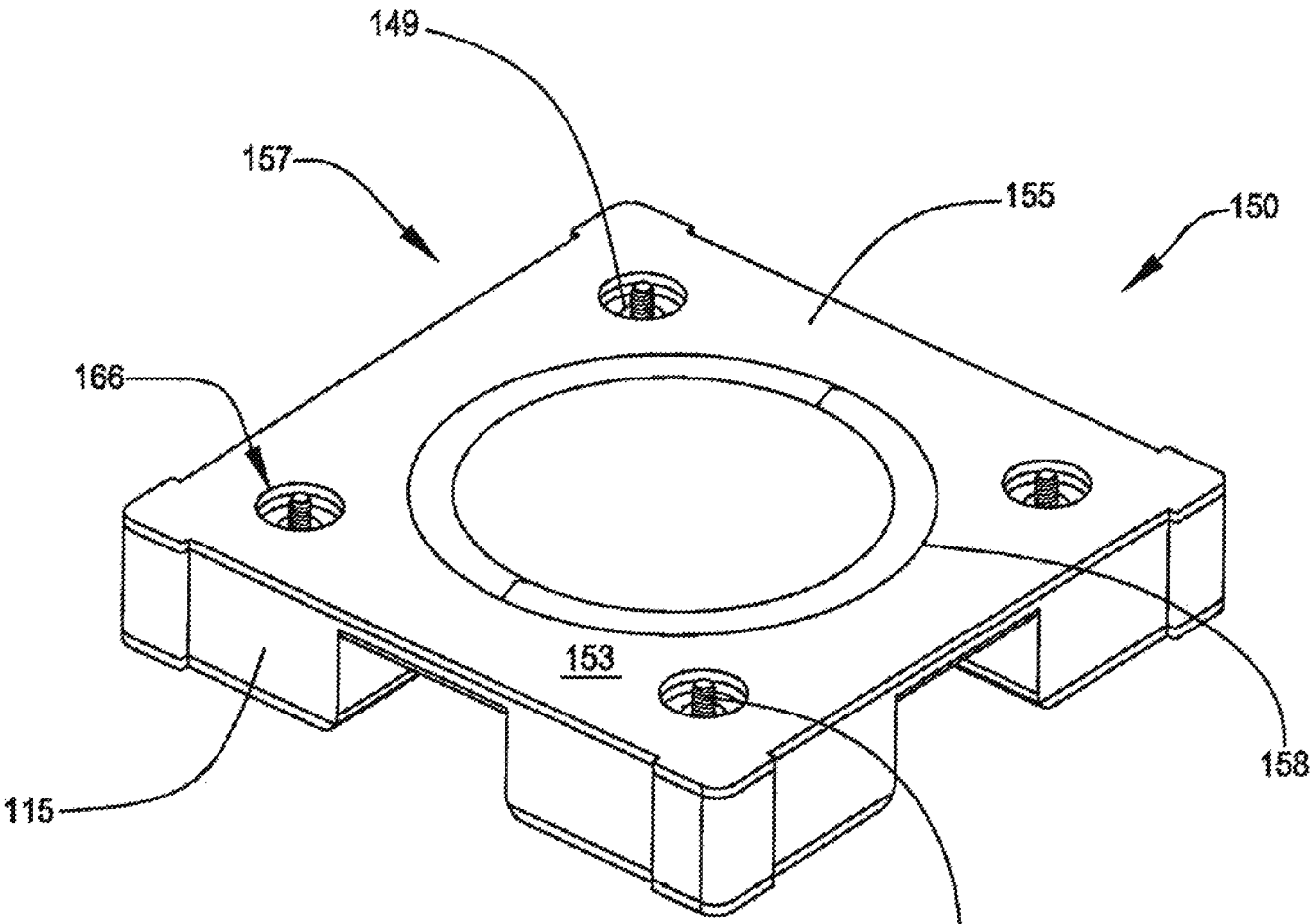
FIGS. 2A-2C show various perspective and plan views, illustrating various embodiment of a lid portion of the embodiments of the iso-thermal transport and storage system shown in FIGS. 1A and 1B.

FIG. 2A shows a bottom-side perspective view, illustrating lid portion 150 of embodiment 102*a* of iso-thermal transport and storage system 100, according to an embodiment. Lid-horizontal decking-surface 153 can be molded, alternately machined, to be a mating and sealing surface with enclosure upper-horizontal decking-surface 181, as shown (also see FIG. 3). Lid-horizontal decking-surface 153 and enclosure upper-horizontal decking-surface 181 can come into complete contact with each other, as shown in FIG. 1A, forming one of two barriers between the external environment and the contents of vessel or container 121, as shown (at least embodying herein wherein said at least one thermal isolator comprises at least one vessel structured and arranged to contain the temperature sensitive goods). Upon reading the teachings of this specification, those with ordinary skill in the art will now understand that, under appropriate circumstances, considering issues such as changes in technology, user requirements, etc., other enclosure means, such as lids, caps, covers, hoods, or floors, yet to be developed, etc., may suffice.

VIP vacuum-panel 157 can be embedded in lid portion 150 and can provide thermal insulation within embodiment 102, as shown. VIP vacuum-panel 157 can be about 4 inches wide, about 4 inches long and about 1 inch thick, as shown. Upon reading this specification, those skilled in the art will now appreciate that, under appropriate circumstances, considering such issues as future technologies, application requirements, etc., other VIP vacuum panel sizes, may suffice.

At least one retainer 149 can hold thumbscrew 151 and fibrous washer 152 from becoming detached from lid portion 150, as shown. Retainer 149 can slide smoothly down the threads when installed, such that thumbscrew 151 and fibrous washer 152 can be retained within at least one lid alignment well 166 in lid portion 150, as shown. Retainer 149 can be about 5/16 inch inner diameter, about 5/8 inch outer diameter, and can be made of black phosphate spring steel, as shown. Retainer 149 can comprise part number 94800A730 from McMaster-Carr. Upon reading the teachings of this specification, those with ordinary skill in the art will now appreciate that, under appropriate circumstances, considering issues such as changes in technology, user requirements, etc., other retaining means, such as clasps, clamps, holders, ties and other retaining means yet to be developed, etc., may suffice.

Lid alignment well 166 can align with at least one lid alignment post 167 (see FIG. 3). Lid alignment well 166 and lid alignment post 167 can allow quick alignment of lid portion 150 to enclosure portion 180.

Figure 2B:
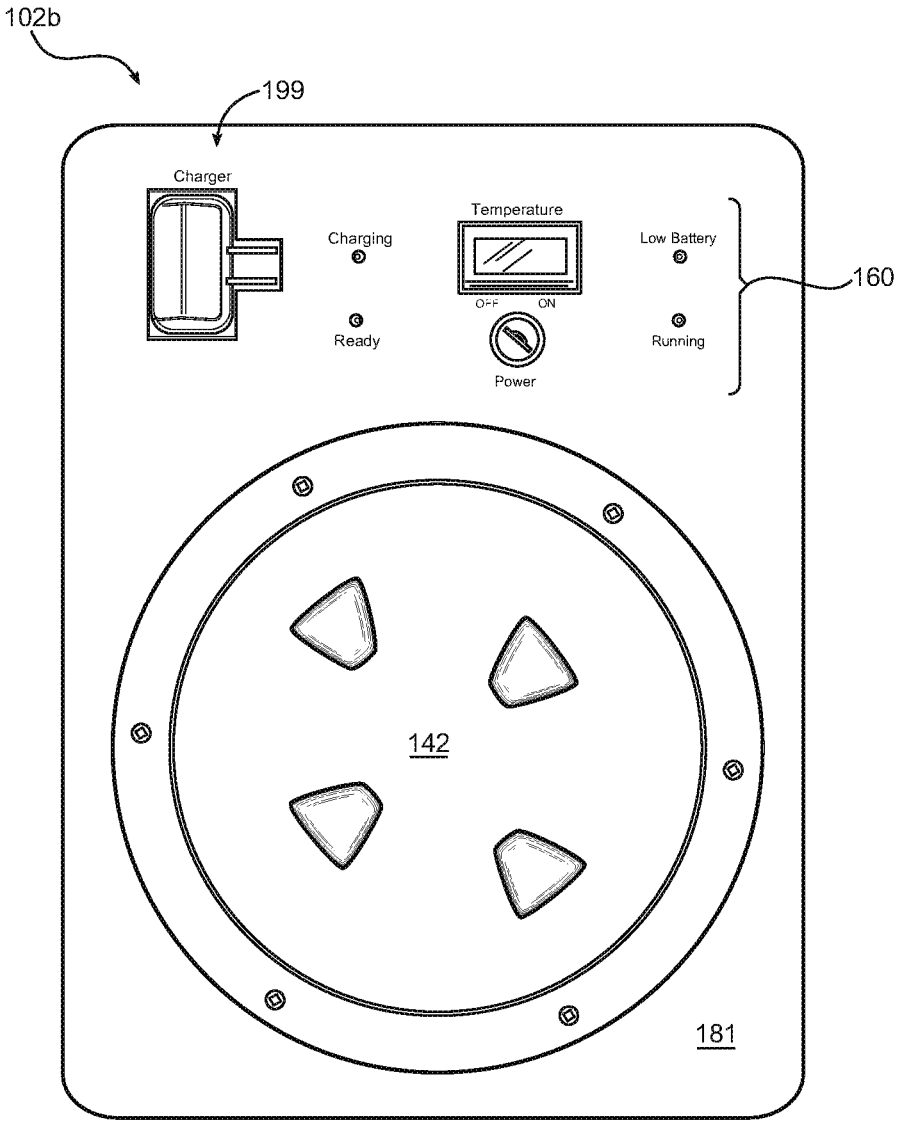

FIG. 2B shows a two-dimensional plan view of a top portion of thermoelectric transport or storage device 102*b* shown previously in the perspective view of FIG. 1B. As shown in FIG. 2B, threaded cap 142 can be disposed on or within enclosure upper-horizontal decking-surface 181 and over vessel 121. FIG. 2B shows threaded cap 142 in a closed position disposed over, securing, and enclosing vessel 121 in which temperature sensitive and perishable goods 139 can be placed, stored, and removed. A number of indicia 160 can also be optionally placed on, or within, enclosure upper-horizontal decking-surface 181. Indicia 160 can include, for example, a charging indicator and a ready indicator, such as a light, for indicating when battery system 119 is being charged through charger 199, which can include an extendable power cord and adapter to be plugged into one or more standard electrical outlets, or is fully charged and ready for storage or shipment of temperature sensitive goods 139. Indicia 160 can further include a variable message indicator such as a lighted display that can show a desired or actual temperature within vessel 121. Indicia 160 can further include a lock that can be turned with a key or other device to turn power on and off to storage device 102*b*, while a low battery indicator and a running indicator can show, such as by a light, whether the unit is running, has a low batter, or both.

Figure 2C:
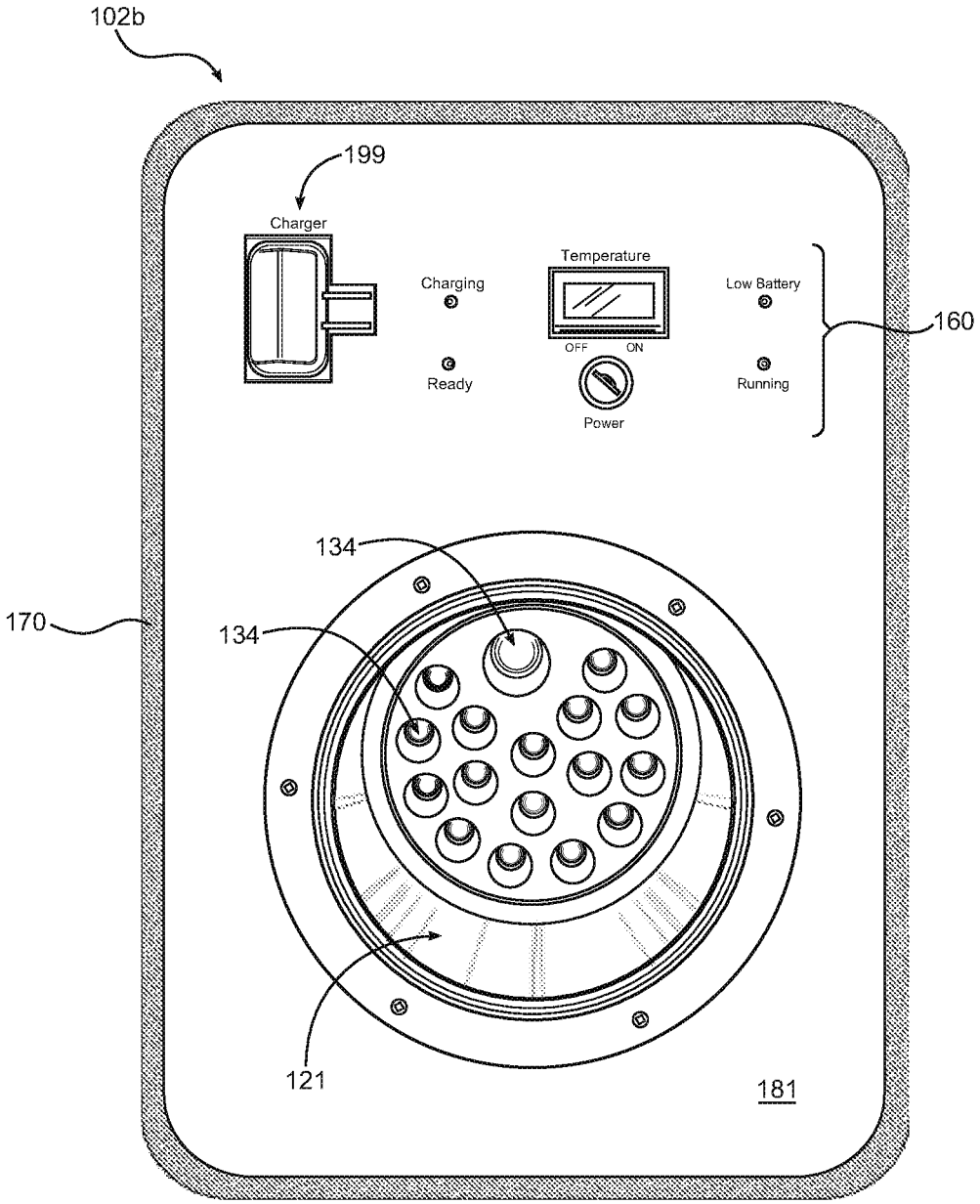

FIG. 2C shows a two-dimensional plan view of a top portion of thermoelectric transport or storage device 102*b* similar to that shown previously in FIG. 2B. FIG. 2C differs from FIG. 2B in that threaded cap 142 has been removed from enclosure upper-horizontal decking-surface 181 such that vessel 121 is open and accessible, allowing for insertion, removal, or inspection of temperature sensitive and perishable goods 139. As shown in FIG. 2C, an interior surface of vessel 121 can be optionally configured to comprise openings 134 in an interior surface of vessel 121. A size, shape, and number of openings 134 can be customizably adjusted and configured to receive one or more sample tubes 140, including vials, test tubes, or other suitable containers for containing temperature sensitive and perishable goods 139.

FIG. 3 shows a partially disassembled perspective view, illustrating an optional arrangement of inner-workings assembly 106 of embodiments 102 of iso-thermal transport and storage system 100. FIG. 3 also shows threaded cap 142, which can be about 7½ inches in diameter and about ¾ inch thick. Threaded cap 142 can assist isolation of sensitive and perishable sensitive goods 139 from its surroundings, as shown. Upon reading the teachings of this specification, those with ordinary skill in the art will now appreciate that, under appropriate circumstances, considering issues such as changes in technology, user requirements, etc., other methods of isolation, such as caps, coverings, packings, gaskets, stoppers yet to be developed, etc., may suffice.

FIG. 3 also shows at least one battery system 119, mounted on base portion 190. Battery system 119 can provide a portable, reliable power source for long durations while sensitive and perishable sensitive goods 139 are being transported in embodiment 102. At least one circuit board 117 can be wired to, and powered by, battery system 119 using at least one wire 177, as shown. Battery system 119 of the present disclosure can be about 3.6 volt DC supply. Battery system 119 can be rechargeable, can provide a source of power for thermo-electric assembly 123, and can be controlled by at least one safety on/off switch 118, as shown. Where an external power source is available, battery system 119 may be recharged while embodiment 102 is in storage or transport.

Figure 5:
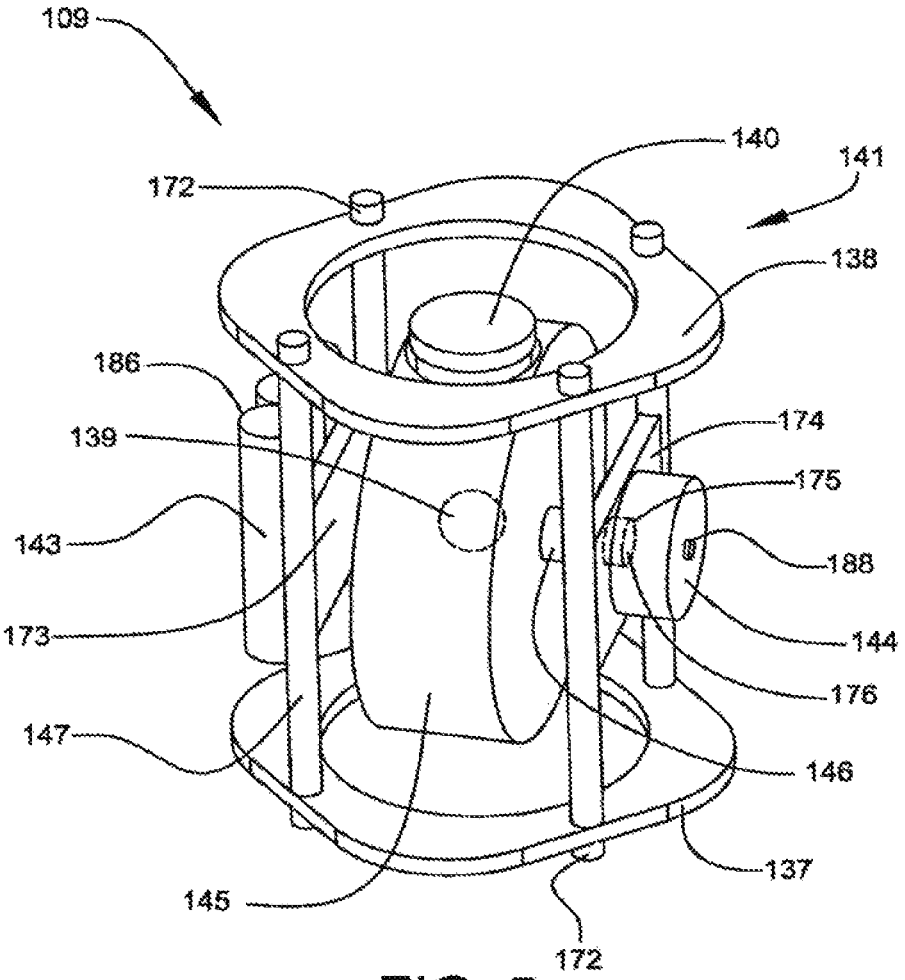
FIG. 5 shows a perspective view, illustrating the sample rotating assembly.

In addition, at least one sample battery pack 143 may be mounted on sample assembly frame 141, as shown in FIGS. 4 and 5. Upon reading the teachings of this specification, those with ordinary skill in the art will now appreciate that, under appropriate circumstances, considering issues such as changes in technology, user requirements, etc., other power sources, such as accumulators, dry batteries, secondary batteries, secondary cells, storage cells, storage devices, wet batteries or other such storage means yet to be developed, or a fixed power source, etc., may suffice.

Wire 177 as shown comprises about 16 AWG coated 26/30 gage copper stranded-conductors with an insulation thickness of about 1/64 inches and a diameter of about 1/12 inches, as shown. Operating temperature range of wire 177 can be from about −40° C. to about 105° C. Insulation covering conductors of wire 177 can be color-coded polyvinyl chloride (PVC). Voltage rating of wire 177 is about 300V. Wire 177 can be marketed by Alpha Wire Company part number 3057. Upon reading the teachings of this specification, those with ordinary skill in the art will now appreciate that, under appropriate circumstances, considering issues such as changes in technology, user requirements, etc., other wiring configurations for example parallel, other series/parallel connections, other size wire, etc., may suffice.

FIG. 3 also shows thermo-electric assembly 123, can comprise at least one thermo-electric semi-conductor node 133 (see FIG. 8) capable of being wired in at least one series and/or parallel configuration to at least one battery system 119. Thermoelectric semi-conductor node 133 can provide an incremental temperature staging means (at least embodying herein at least one thermo-electric heat pump adapted to control-at least one temperature of the temperature sensitive goods; wherein said at least one thermoelectric heat pump comprises at least one thermo-electric device adapted to active use of the Peltier effect). Thermo-electric assembly 123 can be about 7⅝ inches high, about 5 inches long and about 5 inches wide when stacked, as shown. Upon reading the teachings of this specification, those with ordinary skill in the art will now appreciate that, under appropriate circumstances, considering issues such as changes in technology, user requirements, etc., other heat-transferring effects, such as induction, thermal radiation means yet to be developed, etc., may suffice.

In embodiment 102, user 200 may select at least one set-point temperature for sensitive and perishable sensitive goods 139. Embodiment 102 can then automatically maintain the at least one set-point temperature for sensitive and perishable sensitive goods 139, for a duration necessary to store or transport sensitive and perishable sensitive goods 139 to at least one predetermined destination. Embodiment 102 can use thermo-electric assembly 123, in conjunction with fan 120, in at least one closed-loop feedback sensing of at least one thermocouple 124, as shown. Thermocouple 124 can comprise at least one temperature-sensing chip, such as produced by Dallas Semiconductor part number DS18B20. Thermocouple 124 can be used as a single-wire programmable digital-thermometer to measure temperatures at thermocouple 124, as shown. Upon reading the teachings of this specification, those with ordinary skill in the art will now appreciate that, under appropriate circumstances, considering issues such as changes in technology, user requirements, etc., other temperature tuning means, such as adjusters, dials, knobs, on/off power switches, switches, toggles, tuners, thermo-conductive means or other temperature tuning means yet to be developed, etc., may suffice.

Figure 6:
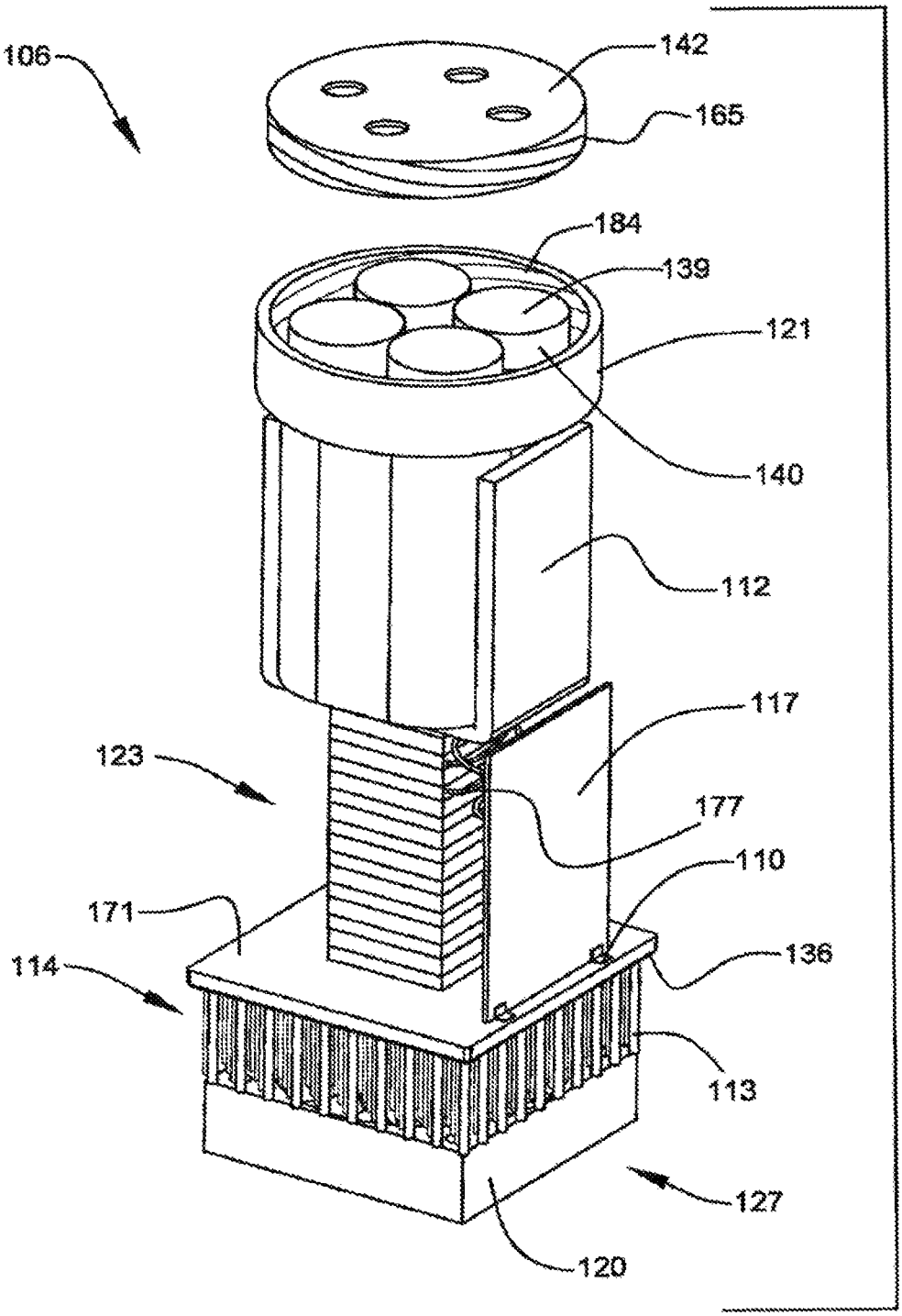
FIG. 6 shows a partially exploded perspective view, illustrating the order and arrangement of the inner working assembly and sample placements of the iso-thermal transport and storage system.

Embodiment 102 can comprise at least one vessel 121 designed to store and contain sensitive and perishable sensitive goods 139, as shown. Vessel 121 can be made from urethane or, alternately, aluminum. Upper section of vessel 121 can comprise at least one inner threaded portion 189 that permits vessel lid 122, having an external threaded portion 185, to be threaded together (also see FIG. 4). Threading together of upper section of vessel 121 and vessel lid 122, as shown in FIG. 6, can provide a seal that isolates sensitive and perishable sensitive goods 139 from the local environment. Vessel lid 122 alternately may have a friction fit sealing relationship with vessel 121, as shown. Tolerances for friction fit will depend on pressure required to be maintained within vessel 121. Upon reading the teachings of this specification, those with ordinary skill in the art will now appreciate that, under appropriate circumstances, considering issues such as changes in technology, user requirements, etc., other means of attaching, such as, clamped-lid mechanisms, bolted lids, joined by adhesives and other means yet to be developed, etc., may suffice.

Aluminum 6069-T4 may be used, due to its light weight and ability to withstand high pressure, should sensitive and perishable sensitive goods 139 need to be maintained at a high pressure. Aluminum can be used because of its high thermal conductivity of about, at about 300° Kelvin (300° K), 237 watts-per meter-degree Kelvin ($W \cdot m^{-1} \cdot K^{-1}$), manufacturability, light weight, resistance to corrosion, and relative dimensional stability (low thermal expansion rate) over a substantial working temperature range. During the heat transfer processes, materials store energy in the intermolecular bonds between the atoms. [When the stored energy increases (rising temperatures of the material), so does the length of the molecular bond. This causes the material to expand in response to being heated, and causes contraction when cooled.] Embodiment 102 can overcome this problem by using aluminum due to the relatively low thermal expansion rate of about 23.1 micro-meters per meter per degree Kelvin ($\mu \cdot m^{-1} \cdot K^{-1}$) (300° K). This property can allow embodiment 102 to effectively manage thermally induced linear, area, and volumetric expansions throughout a wide range of ambient temperatures and desired set-point temperatures for sensitive and perishable sensitive goods 139. Upon reading the teachings of this specification, those with ordinary skill in the art will now appreciate that, under appropriate circumstances, considering issues such as changes in technology, user requirements, etc., other materials, such as, for example, copper, copper alloys, other aluminum alloys, low-thermal-expansion-composite constructions, etc., may suffice.

At least one volume 116 exists between VIP vacuum-panel 157 and vessel 121 mounted above thermo-electric assembly 123, as shown. Volume 116 can be filled with expandable urethane 115, as shown. The expandable urethane 115 foam can have a density of about 2 lb/cu. ft. Expandable urethane 115 can secure all components within the upper portion of embodiment 102, as shown. Expandable urethane 115 foam can be only allowed to fill the portion shown within the illustration so as to allow ample available space for heat sink 114, at least one fan assembly 127, and at least one battery system 119 to operate in a non-restricted manner, as shown (also see FIG. 6).

Alternately, volume 116 between VIP vacuum-panel 157 and vessel 121 can be filled up to three layers of about ½ inch thick VIPs. Such VIPs can be curved around vessel 121 and thermo-electric assembly 123, creating a total minimum thickness of about 1½ inches, as shown. Square-box style VIPs may also be used depending on specific geometries associated with embodiment 102. After such VIPs are positioned around vessel 121 and thermo-electric assembly 123, the remaining cavity areas are filled with expandable urethane 115. Upon reading the teachings of this specification, those with ordinary skill in the art will now understand that, under appropriate circumstances, considering issues such as changes in technology, user requirements, etc., other surface cooling means, such as appendages, projections, extensions, fluid heat-extraction means and others yet to be developed, etc., may suffice.

All of the mentioned items within inner-workings assembly 106 lose efficiency if not cooled. Fan 120 can circulate ambient air through vent 183, impinging on at least one fin 113, as shown. Fin 113 can absorb heat from the air (in heating mode) or reject heat to the air (cooling mode). Fin 113 further can transport heat from/to its surface into heat sink 114, through conductive means. Fin 113 and heat sink 114 can be comprised of 3000 series aluminum. Aluminum alloys have the significant advantage that they are easily and cost-effectively formed by extrusion processes. Upon reading this specification, those skilled in the art will now appreciate that, under appropriate circumstances, considering such issues as future technologies, cost, available materials, etc., other fin and heat sink materials, such as, for example, other aluminum alloys, copper, copper alloys, ceramics, cermets, etc., may suffice. Heat sink 114 can be designed for passive, non-forced air-cooling, as shown.

Fan 120 can provide necessary thermal control by creating an active means of air movement onto heat sink 114 surfaces, as shown. Fan assembly 127 can be about 3⅞ inches long, about 3⅞-inches wide and about 1⅓ inches high. Fan 120 can comprise model number GM0504PEV1-8 part number GN produced by Sunon. Fan 120, can be rated at about 12 VDC, however, fan 120 can operate at 5 VDC. Airflow can be about 5.9 cubic feet per minute (CFM) at a speed of about 6000 revolutions per minute (rpm) with a power consumption of about ⅜ watts (W). Noise of fan 120 can be limited to about 26 decibels (dB). Fan 120 can weighs about 7.5 grams (g).

Fan 120 alternately can be operated at about 5 volts with a DC/DC boost converter, not shown. The DC/DC boost converter can be a step-up type, possibly comprising a start-up of less than 0.9 VDC with about 1 mill-ampere (mA) load. The DC/DC boost converter can comprise part number AP1603 as marketed by Diodes Incorporated. Upon reading the teachings of this specification, those with ordinary skill in the art will now understand that, under appropriate circumstances, considering issues such as changes in technology, user requirements, etc., other conversion means, such as, for example, buck converter or buck-boost converter yet to be developed, etc., may suffice.

Heat sink 114 can comprise at least one heat-sink plate 136, base surface 171 (at least embodying herein wherein said at least one vessel comprises at least one heat-transferring surface structured and arranged to conductively exchange heat to and from said at least one temperature controller), and fins 113. Heat sink 114 can be FH-type as produced by Alpha Novatech, Inc., as shown. A configuration of heat sink 114 can comprises about 200 individual, fins 113, shaped hexagonally, possibly comprising dimensions of about ⅛ inch wide across the flats and about 1⅓ inches long, as shown. Fins 113 can be arranged in a staggered relationship on heat-sink plate 136, as shown. Heat-sink plate 136 can be about ¼ inch thick, about 3⅞ inches wide and about 3⅞ inches long, as shown. Heat-sink plate 136 and fins 113 can comprise a one-piece extrusion. Base surface 171 of heat sink 114 can be flat and smooth to ensure adequate thermal contact with the object being cooled or heated, as shown. Upon reading the teachings of this specification, those with ordinary skill in the art will now understand that, under appropriate circumstances, considering issues such as changes in technology, user requirements, etc., other heat sink materials, such as copper, gold, silver, brass, tungsten, ceramics, cermets, or metal alloys of different sizes and configurations, etc., may suffice.

FIG. 4 shows an exploded perspective view, illustrating a mating assembly relationship between at least one sample rotating assembly 109 and outer enclosure 105 of the iso-thermal transport and storage system 100, according to an embodiment, such as thermoelectric transport or storage device 102*a* from FIG. 1A or thermoelectric transport or storage device 102*b* from FIG. 1B.

Vessel 121 may be designed to allow rotation capability, as shown. Further, vessel 121 alternately may be designed to allow at least one formed separator support sample tube 140, set in vessel 121, and spaced so as to eliminate contact with any other sample tube 140, as shown in FIG. 6. Sample tube 140 may be made of glass, alternately metal alloy, alternately plastic, alternately composite material.

Sample rotating assembly 109 can comprise a removable assembly that can allow rotation of at least one sample tube 140 while sample assembly frame 141 can remain stationary within the confines of outer enclosure 105, as shown. Sample rotating assembly 109 can be located within outer enclosure 105, as shown. Sample rotating assembly 109 can be held securely by means of threaded cap 142 that can restrict any upward motion of sample rotating assembly 109 within outer enclosure 105, as shown. Sample rotating assembly 109 can be about 11 inches in diameter and about 3⁷⁄₁₆ inches wide, as shown. User 200 may open, close, and reopen lid portion 150 during storage, or during transport, without compromising the integrity of sensitive and perishable sensitive goods 139.

Maintaining integrity of sensitive and perishable sensitive goods 139 comprises protection from, for example, contamination by foreign gases, liquids, moisture, or solids, minimizing any fluctuations in temperature, preventing any spillage or degradation by ultraviolet or other forms of radiation, as shown. If integrity is not maintained, sensitive and perishable sensitive goods 139 may die, degrade through separation, denature, deform, mold, dry out, become contaminated, or be unusable or inaccurate, i.e., if not kept within a protective isolated environment. Sensitive and perishable sensitive goods 139 can maintain integrity due to the further sealing within vessel 121, as shown. Upon reading the teachings of this specification, those with ordinary skill in the art will now appreciate that, under appropriate circumstances, considering issues such as changes in technology, user requirements, etc., other enclosing means for example caps, covers, hoods, roofs, top and others yet to be developed, or other rotational means, etc., may suffice.

As shown in FIG. 4, sample assembly frame 141 provides a structural mount for mounting at least one sample battery pack 143, as shown. Also, sample assembly frame 141 can provide a suspending mount, flat-bar 173, to suspend at least one rotating cylinder 145, as shown. Additionally, sample assembly frame 141 can provide a handle for user 200 to grasp sample rotating assembly 109 for lifting-from or lowering-into outer enclosure 105, as shown.

User 200 may remove sample rotating assembly 109 for accuracy of filling or dispensing from sensitive and perishable sensitive goods 139 into at least one sample tube 140, as also shown in FIG. 5. This feature can also permits ease of cleaning and sanitizing of embodiment 102 by user 200 at re-use intervals of embodiment 102, as shown (at least embodying herein wherein such step of providing re-use comprises at least one cleaning step). Sample rotating assembly 109 can require less space when removed from outer enclosure 105, as shown, for instances when space is limited such as in laboratory settings. Upon reading the teachings of this specification, those with ordinary skill in the art will now appreciate that, under appropriate circumstances, considering issues such as changes in technology, user requirements, etc., other portable containing means, such as bags, canisters, chambers, flasks, humidors, receptacles, or vessels yet to be developed, etc., may suffice.

FIG. 5 shows an enlarged perspective view, of a non-limiting sample-rotating assembly 109. Sample battery pack 143 can comprise at least one battery 186, three AAA-sized batteries (each can have about 7/16-inch outer diameter and being about 13/4 inches long) as shown. These batteries may be tabbed for ease of interconnection and removal, as shown. These batteries can be series connected to supply about 3.6 volts direct current (VDC) to supply power to sample rotating assembly 109, as shown. Upon reading the teachings of this specification, those with ordinary skill in the art will now appreciate that, under appropriate circumstances, considering issues such as changes in technology, user requirements, etc., other batteries, such as, for example, AA-sized batteries, unified battery packs, etc., may suffice.

Batteries 186 can comprise alkaline batteries, alternately, high capacity nickel metal hydride (NiMH) batteries, alternately lithium ion batteries, alternately lithium polymer batteries. Upon reading the teachings of this specification, those with ordinary skill in the art will now appreciate that, under appropriate circumstances, considering issues such as changes in technology, user requirements, etc., other battery materials, such as, for example, other metal hydrides, electrolytic gels, bio-electric cells, etc., may suffice.

Sample battery pack 143 can provide power for at least one gear motor 144 to turn at least one shaft 146, as shown (at least herein embodying wherein said at least one goods rotator is structured and arranged to self-power from at least one energy storage device) (at least herein embodying wherein said least one energy storage device comprises at least one battery). Shaft 146 can be connected to one end of rotating cylinder 145 and connected to at least one gear motor 144 on the opposing end of rotating cylinder 145, as shown. When at least one gear motor 144 is activated, shaft 146 can rotate rotating cylinder 145 turning about the longitudinal axis of shaft 146, as shown. The rotating motion may be enabled to one direction, or, alternately, in two directions for agitating, depending on application requirements to preserve sensitive and perishable sensitive goods 139. Shaft 146 can have an outer diameter of about ½ inch and is about 3¼ inches long, as shown. Gear motor 144 can have about 1-inch outer diameter and about ½ inch length, as shown (at least herein embodying wherein said at least one thermal isolator comprises at least one goods rotator structured and arranged to rotate the temperature sensitive goods within said at least one thermal isolator). Upon reading the teachings of this specification, those with ordinary skill in the art will now appreciate that, under appropriate circumstances, considering issues such as changes in technology, user requirements, etc., other rotating means, such as worm and pinion combinations, gearing combinations, sprockets and chains, pulleys and belts or chains and swing mechanical mechanisms yet to be developed, etc., may suffice.

Sample tube 140 can be held securely when rotating cylinder 145 to allow sensitive and perishable sensitive goods 139 to remain in a fixed position or alternately to rotate upon activation of at least one gear motor 144, as shown. Sample tube 140 (in the illustrated embodiment) can have an outer diameter of about 3⅞ inches and is about 8 inches long, as shown. Sterile centrifuge tubes as produced by Exodus Breeders Corporation code number 393 may be used, as shown. Sample tube 140, can comprise a size of about 50 milliliter (ml), is non-free standing and has a conical end.

Sample assembly frame 141 can be in a closely fitted relationship within outer enclosure 105 to minimize vibrations, as shown. Sample tube 140 may be in a closely fitted relationship with rotating cylinder 145 to minimize vibration and the possibility of physically damaging sample tube 140, as shown. This arrangement can minimize potential compromising of the integrity of sensitive and perishable sensitive goods 139, as well as lessens possible dangers of exposure to user 200. Sample assembly frame 141 can be about 5 inches high and can be made of urethane smooth-cast-roto-molded, as shown. Sample assembly frame 141 can comprise of at least one upright bar 147, possibly comprising an outer diameter of about ½ inch and a length of about 5 inches, as shown. Upright bar 147, can comprise urethane can be friction fitted through upper frame-plate 138 and possibly lower frame-plate 137, as shown. Upright bar 147 can protrude about ½ inch outwardly from upper side of upper frame-plate 138 and lower side of lower frame-plate 137, as shown. One upright bar 147 can be affixed with at least one connection flat-bar 173 to another upright bar 147, to provide structural rigidity for sample assembly frame 141, as shown. At least one connection flat-bar 174 can connect two other upright bars 147. Connection flat-bar 174 can comprise at least one shaft pass-through 175 allowing shaft 146 to pass through with at least one bearing 176 to aid rotation, as shown.

Gear motor 144 can be fit on end of shaft 146 and held in place with a hub 188, as shown. Connection flat-bar 173 can provide a mounting for sample battery pack 143, as shown. Connection flat-bar 173 can be attached to upright bar 147, by adhesive, alternately fusion welding, as shown. Connection flat-bar 173 can prevent twisting of sample assembly frame 141, as shown. Upon reading the teachings of this specification, those with ordinary skill in the art will now appreciate that, under appropriate circumstances, considering issues such as changes in technology, user requirements, materials, etc., other attachment methods, such as, for example, screws, epoxies, soldering, etc., may suffice.

FIG. 6 shows a partially exploded perspective view, illustrating an non-limiting example of an order and arrangement of inner-workings assembly 106 of iso-thermal transport and storage system 100. Embodiments 102 may be used without sample rotating assembly 109, as shown, and thereby is suitable for handling sensitive and perishable sensitive goods 139 that do not need to be rotated or agitated to preserve the required quality. Fan 120 can blow ambient air pulled in through vent 183, as shown in FIG. 1 and FIG. 4. Heat sink 114 can comprise fin 113 mounted or otherwise configured to be perpendicular to fan 120, as shown. Heat sink 114 can be configured for providing maximum surface area exposure to air currents from fan 120, to maximize the rates of cooling or heating within embodiment 102, as shown. This method of forced-convection heat-transfer can create fewer fluctuations in temperature of sensitive and perishable sensitive goods 139 over any extended time. Upon reading the teachings of this specification, those with ordinary skill in the art will now appreciate that, under appropriate circumstances, considering issues such as changes in technology, user requirements, etc., other heat sink cooling devices, such as aerators, air-conditioners, and ventilators yet to be developed, etc., may suffice.

At least one retainer 112 can be attached at its base to thermo-electric assembly 123, and can partially wrap around vessel 121 can permit user 200 to lift vessel 121 out of embodiment 102. Retainer 112 can be a means to ensure vessel 121 is held in place, as shown. Retainer 112 can be formed in a U-shape, as shown, and can be constructed of smooth-cast-roto-molded urethane as made by Smooth-On manufacturers. Smooth-Cast ROTO™ urethane is a semi-rigid plastic and can be selected for its density-control, structural and insulating characteristics. Smooth-Cast ROTO™ has a shore D hardness of about 65, a tensile strength of about 3400 psi, tensile modulus of about 90,000 psi, with a minimal shrinkage of about 0.01 in/in over a seven-day period.

Upon reading the teachings of this specification, those with ordinary skill in the art will now appreciate that, under appropriate circumstances, considering issues such as changes in technology, user requirements, etc., other retaining means, such as catches, clasps, clenches, grips, holds, locks, presses, snaps, vices, magnets, or mechanical attaching means yet to be developed, etc., may suffice.

Retainer 112 according to the present disclosure may alternately be manufactured from aluminum, due to its high thermal conductivity and low mass density. The high thermal conductivity of retainer 112 can efficiently transport heat between thermo-electric assembly 123 and vessel 121, possibly comprising a minimum of temperature difference between thermo-electric assembly 123 and vessel 121. This efficient heat conduction can support temperature stability for sensitive and perishable sensitive goods 139, contained within vessel 121, as shown. Upon reading the teachings of this specification, those with ordinary skill in the art will now appreciate that, under appropriate circumstances, considering issues such as changes in technology, user requirements, etc., other high thermal conductors, such as copper, brass, silver, gold, tungsten and other conductive element alloys yet to be developed, etc., may suffice.

Thermo-electric assembly 123 can be mounted on base surface 171 of heat sink 114 and can connect to retainer 112, as shown. Upon reading the teachings of this specification, those with ordinary skill in the art will now appreciate that, under appropriate circumstances, considering issues such as changes in technology, user requirements, etc., other retaining means, such as catches, clasps, clenches, grips, holds, locks, nippers, presses, snaps, vices, magnets, or mechanical attaching means yet to be developed, etc., may suffice.

Circuit board 117 can be mounted substantially parallel to thermo-electric assembly 123 by at least one bracket 110, as shown. Also, circuit board 117 can mount to flat upper surface of heat sink 114, as shown. Upon reading the teachings of this specification, those with ordinary skill in the art will now appreciate that, under appropriate circumstances, considering issues such as changes in technology, user requirements, cost, etc., other circuit board mountings, such as suspension in foam insulation, epoxies, snap-in, cable suspensions, etc., may suffice.

Figure 8:
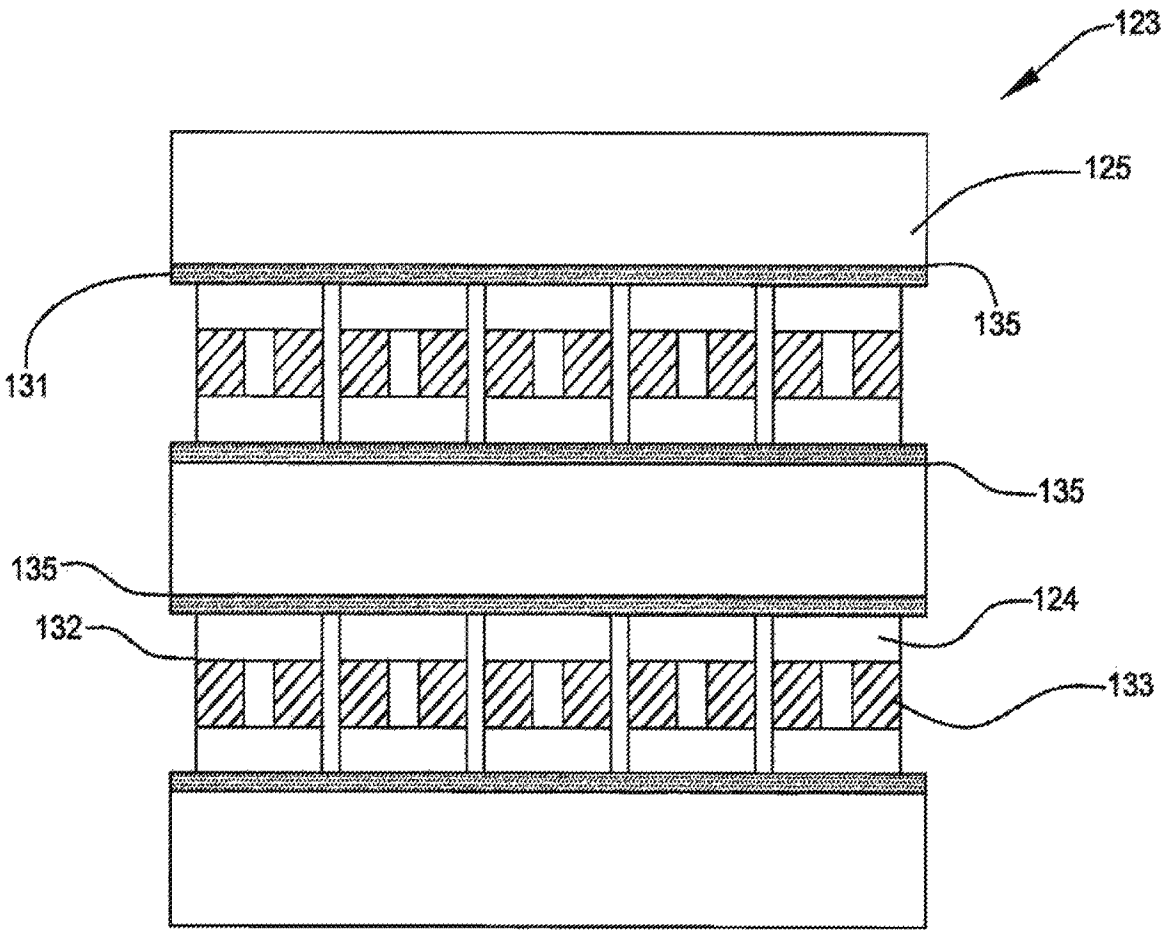
FIG. 8 shows a side profile view, illustrating a thermoelectric assembly of the iso-thermal transport and storage system.

Circuit board 117 can control and regulates the functioning of thermo-electric assembly 123, according to electronic feedback from thermocouple 124 within thermo-electric assembly 123, as also shown in FIG. 8. At least one mounting hole can be present in circuit board 117 and to allow mounting by bracket 110, as shown. Upon reading the teachings of this specification, those with ordinary skill in the art will now appreciate that, under appropriate circumstances, considering issues such as changes in technology, user requirements, etc., other mounting means for example hooks, magnets, mechanical fastening means yet to be developed, fusion means, etc., may suffice.

Figure 7:
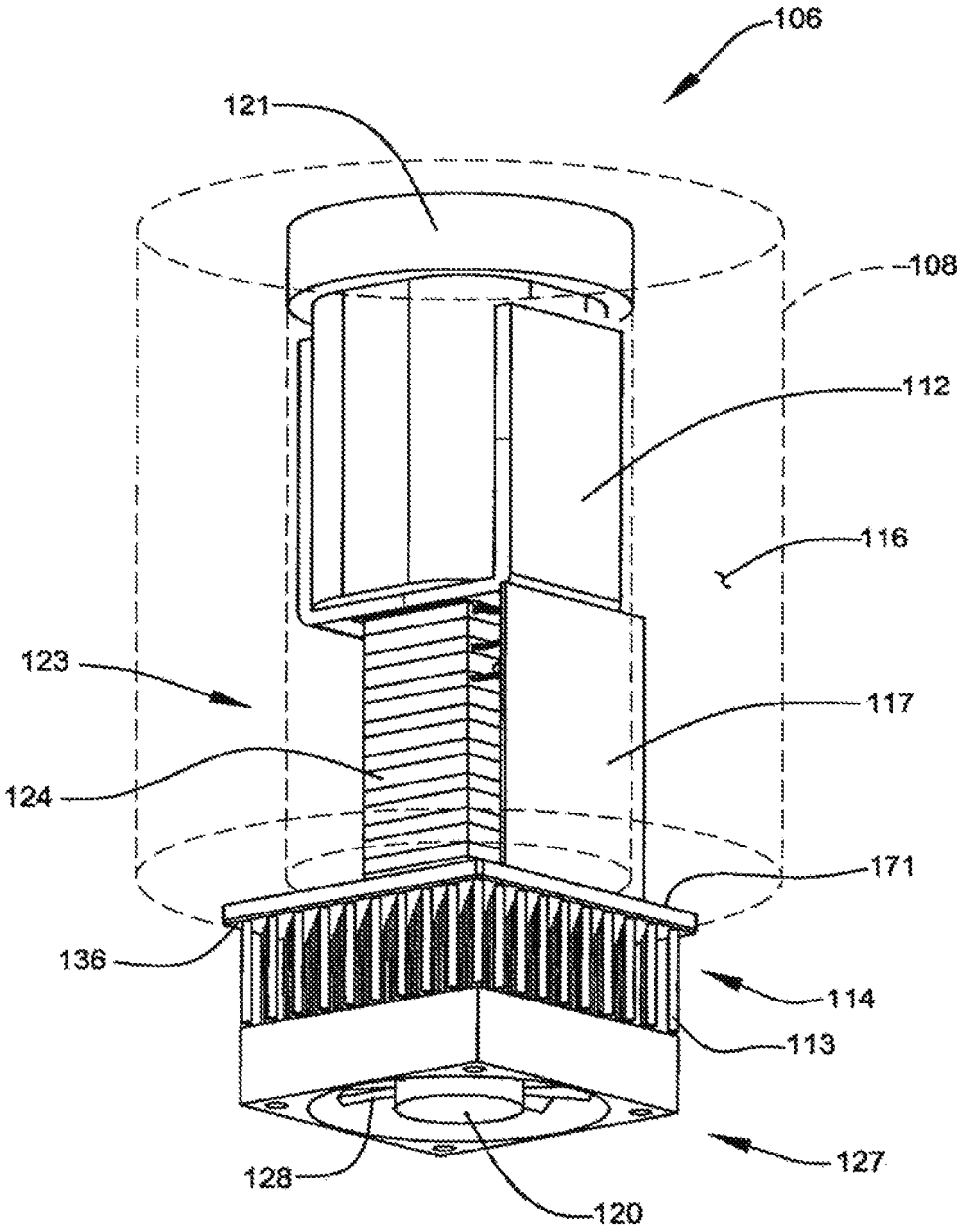
FIG. 7 shows a partially disassembled bottom perspective view, illustrating the inner working assembly of the iso-thermal transport and storage system.

FIG. 7 shows a partially disassembled bottom perspective view, illustrating inner-workings assembly 106 of iso-thermal transport and storage system 100, according to an embodiment. Excess heat can be pumped into heat sink 114 from thermo-electric assembly 123 and can convectively transfer into ambient air by forced convection from fin 113, by at least one fan 120, as shown.

During time periods when heat must be sourced from the ambient to warm sensitive and perishable sensitive goods 139, such that the temperature of sensitive and perishable sensitive goods 139 can be maintained near a desired set-point temperature, fin 113, as shown, may serve to collect heat from the ambient air. Under this alternate operational mode, at least one fan 120 can push relatively warm ambient air over fin 113, thereby allowing heat to be absorbed into fin 113. Such absorbed heat can conduct up into thermo-electric assembly 123, where the heat can be pumped, as needed, into vessel 121 and thus provides necessary heating to maintain the set-point temperature of sensitive and perishable sensitive goods 139.

Control circuit on circuit board 117 enables user 200 to re-set set-point temperature, of sensitive and perishable sensitive goods 139, to the desired temperature at which sensitive and perishable sensitive goods 139 are maintained (this arrangement at least herein embodying wherein such step of providing re-use comprises at least one set-point re-setting step). Upon reading the teachings of this specification, those with ordinary skill in the art will now appreciate that, under appropriate circumstances, considering issues such as changes in technology, user requirements, etc., other heat-sink heat exchanges, such as fluid cooling through internal flow of liquids, air cooling means and other passive or active cooling means yet to be developed, etc., may suffice.

Fan 120 can use at least one blade 128 to pull ambient air into at least one vent 183, as shown in FIGS. 1 and 4. Further, fan 120 can blow the ambient air onto heat sink 114, as shown. Embodiment 102 can either dissipate excess heat from heat sink 114 to the ambient air or alternately extract heat from the ambient air (into heat sink 114), as needed, to maintain the at least one set-point temperature of sensitive and perishable sensitive goods 139, as shown. Also, fan 120 can exhaust the ambient air out through vent 183, as shown in FIGS. 1 and 4. Fan 120 can operate at low power to pull ambient air into at least one vent 183 and can exhaust the ambient air out through at least one vent 183, as shown in FIGS. 1 and 4. Blade 128 has a steep pitch for sufficient air movement at the hottest rated ambient air temperature while maintaining the lowest rated set-point temperature for sensitive and perishable sensitive goods 139. Input voltage to fan 120 can be alternately determined by closed-loop feedback sensing of at least one thermocouple 124, as shown. Upon reading the teachings of this specification, those with ordinary skill in the art will now understand that, under appropriate circumstances, considering issues such as changes in technology, user requirements, etc., other controllers of forced air movers having for example heat-flux sensors, system voltage sensors yet to be developed, etc., may suffice.

The opening for blade 128 to rotate within fan assembly 127 can be between about 5 inches and about 8 inches in diameter, depending on volume of airflow needed. Vent 183 can be free from any obstructions to allow proper circulation to occur, as shown in FIGS. 1 and 4. Thermo-electric assembly 123 can be mounted on base surface 171 of heat sink 114, as shown. Upon reading the teachings of this specification, those with ordinary skill in the art will now understand that, under appropriate circumstances, considering issues such as changes in technology, user requirements, etc., other air movers, such as, for example, turbines, propellers, etc., may suffice.

Figure 9A:
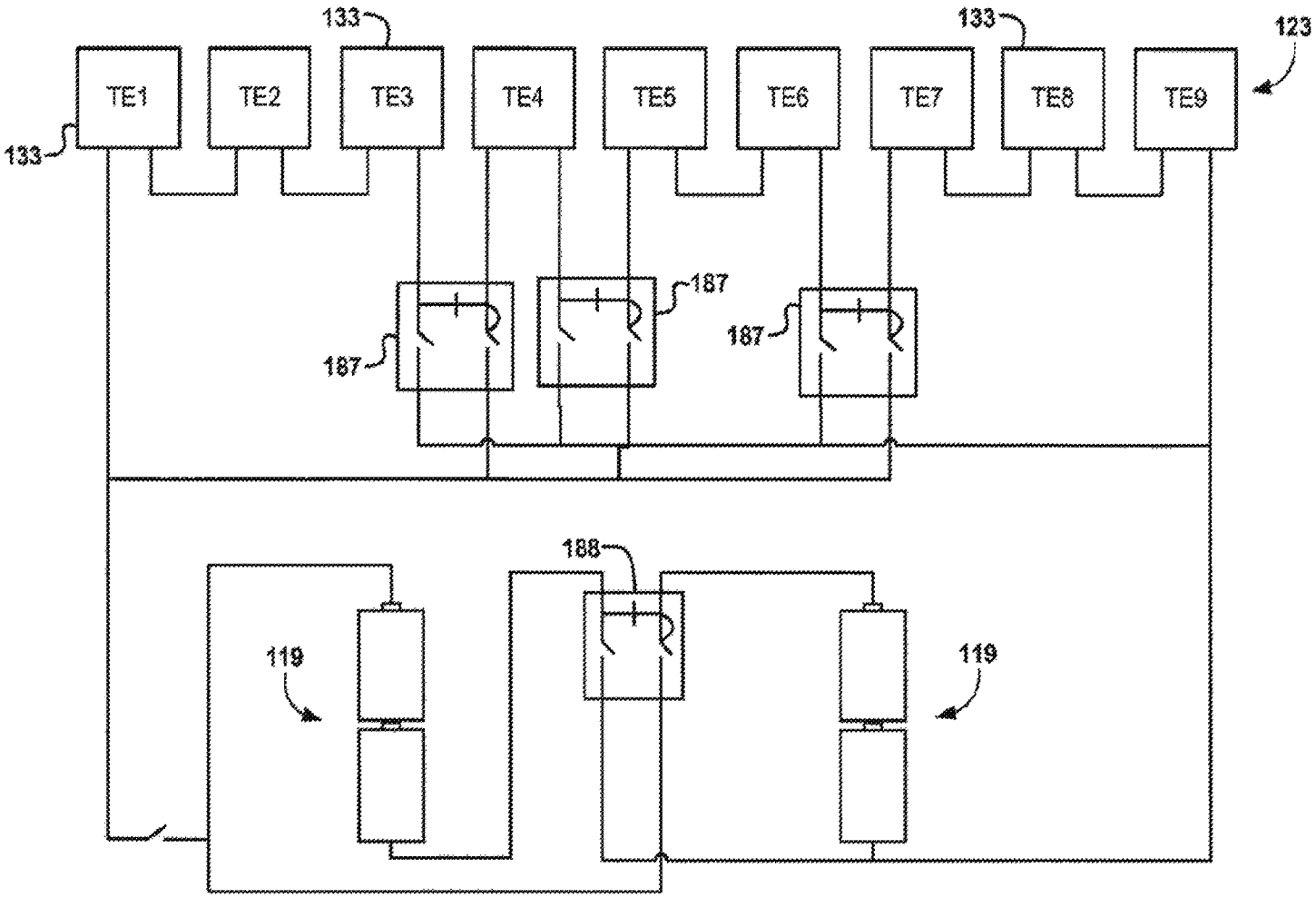
FIGS. 9A and 9B show an electrical schematic views, illustrating possible electrical control of iso-thermal transport and storage systems.

Thermo-electric assembly 123 comprises at least one thermo-electric semi-conductor node 133, as shown. Thermo-electric assembly 123 can comprises a plurality of thermo-electric semi-conductor nodes 133, as shown. Thermo-electric assembly 123 can also comprise between about six and about nine thermo-electric semi-conductor nodes 133, electrically connected in series, as shown in FIG. 9A (at least embodying herein wherein said at least one thermo-electric heat pump comprises a minimum of about three sandwich layers).

The quantity of thermo-electric semi-conductor nodes 133 can be determined by the total expected variance between a desired set-point-temperature of sensitive and perishable sensitive goods 139 and the ambient temperatures that embodiment 102 will be potentially subjected to. Once the set-point-temperature-to-ambient-temperature range of sensitive and perishable sensitive goods 139 can be defined, it is divided by a per-unit factor to determine the desired number of thermo-electric semi-conductor nodes 133 that are electrically connected in series (and thermally connected in series). The per-unit factor for bismuth-telluride (Bi.sub.2Te.sub.3) based thermo-electric semi-conductor nodes, ranges from about 3° C. to about 5° C. Thus, if the set-point-temperature of sensitive and perishable sensitive goods 139 is about 0° C. and the ambient temperature is expected to range up to about 27° C.; about six to about nine thermo-electric semi-conductor nodes 133 are needed. Thus, the thermo-electric assembly 123 can comprise about six to about nine thermo-electric semi-conductor nodes 133, that can be electrically connected in series (and thermally connected in series), as shown.

The per-unit factor for series-connected thermo-electric semi-conductor nodes 133, and can be selected to maximize the efficiency of heat pumping across thermo-electric semi-conductor nodes 133. The efficiency at which thermo-electric semi-conductor nodes 133 pump heat is largely determined by the external boundary conditions imposed on heat pumping across thermo-electric semi-conductor nodes 133. The most significant of these boundary conditions comprise the temperature gradient (change in temperature from the P-side to the N-side of the thermo-electric semi-conductor node 133) and the level of heat conductivity at the semi-conductor node boundaries.

Generally, operation that is more efficient correlates with smaller temperature gradients and with higher levels of heat conductivity at the semi-conductor node boundaries of thermo-electric semi-conductor node 133. Thus, thermo-electric assembly 123 has a sufficiently large number of thermo-electric semi-conductor nodes 133 electrically connected in series (and thermally connected in series) such that no single thermo-electric semi-conductor node 133 experiences a temperature gradient greater than from about 3° C. to about 5° C. Also, thermo-electric semi-conductor nodes 133 are configured such that the level of heat conductivity at each semi-conductor node boundary can approximate the thermal conductivity of aluminum.

The number of thermo-electric semi-conductor nodes 133 electrically connected in parallel can be determined by the total heat-rate that must be pumped from, or to, sensitive and perishable sensitive goods 139 such that the temperature of sensitive and perishable sensitive goods 139 may be maintained at, or near, the desired set-point-temperature, within from about 2 degree C. to about 8 degrees C., or within 1 degree C. The heat pumping capacity of each thermo-electric semi-conductor node 133, electrically connected in parallel (and thermally connected in parallel), depends on specific characteristics of the specific thermo-electric semi-conductor node 133, as shown. Thus, a designer of iso-thermal transport and storage system 100 can consult the manufacturer of the specific thermo-electric semi-conductor node 133 to determine its rated-heat-pumping-capacity. Additionally, the designer of iso-thermal transport and storage system 100 can determine the total heat-rate that must be pumped from, or to, sensitive and perishable sensitive goods 139. Once these factors are known to the designer of iso-thermal transport and storage system 100, the designer divides the total heat-rate by the rated-heat-pumping-capacity of a single series string of thermo-electric semi-conductor nodes 133, to determine the required number of thermo-electric semi-conductor nodes 133, which should be electrically connected in parallel (and thermally connected in parallel).

VIP insulation 108 can provide a further degree of control over gradual changes in temperature by decreasing heat convection, radiation and conduction and increasing thermal resistance. About 2 lb/cu. ft. expanded urethane foam, as produced by Smooth-On model Foam-iT!™, can be used for VIP insulation 108. VIP insulation 108 can comprise three sheets of about ½ inch thickness making a total thickness of about 1½ inches which is wrapped around inner-workings assembly 106, as shown. Height of VIP insulation 108 can be about 8½ inches, as shown. All VIPs can be encased in urethane foam to minimize damage to VIPs, making embodiment 102 more shock-resistant, as shown. Upon reading the teachings of this specification, those with ordinary skill in the art will now understand that, under appropriate circumstances, considering issues such as changes in technology, user requirements, etc., other insulating means, such as epoxies, unsaturated polyesters, phenolics, fibrous materials and foam materials yet to be developed, etc., may suffice.

FIG. 8 shows a side profile view, illustrating thermo-electric assembly 123 of iso-thermal transport and storage system 100, according to a particular embodiment. The present disclosure can attain a high coefficient of performance using the method herein described. At least one thin non-electrically conductive layer 131 can electrically separate thermo-electric capacitance spacer block 125 from thermo-electric semi-conductor nodes 133, while maintaining thermal conductivity. At least one thin-film thermal epoxy 135, fills microscopic imperfections between thin non-electrically conductive layer 131 and thermo-electric capacitance spacer block 125 (also see FIG. 8). Upon reading this specification, those skilled in the art will now appreciate that, under appropriate circumstances, considering such issues as future technology, cost, application needs, etc., other thermal conductivity maximizers, such as, for example, thermal greases, thermal dopes, molecularly smoothed surfaces, etc., may suffice.

Thermo-electric assembly 123 can comprise a plurality of thermo-electric semi-conductor nodes 133, connected physically (thermally) in series and/or parallel, and electrically in series and/or parallel, and can use at least one battery system 119 to create at least one bidirectional heat-pump, as shown. This configuration can provide progressive temperature gradients and precise temperature control (at least herein embodying wherein such control of such at least one temperature comprises controlling such at least one temperature to within a tolerance of less than about one degree centigrade). Thermo-electric assembly 123 can be used to increase the output voltage since the voltage induced over each individual thermo-electric semi-conductor node 133 is small. Upon reading the teachings of this specification, those with ordinary skill in the art will now appreciate that, under appropriate circumstances, considering issues such as changes in technology, user requirements, etc., other heating/cooling means for example, thermoelectric refrigerators, thermo-electric generators yet to be developed, etc., may suffice.

FIG. 8 shows repetitive layers of thermo-electric capacitance spacer block 125 and thermo-electric semi-conductor node 133, which comprise thermo-electric assembly 123. Thermo-electric semi-conductor node 133 can comprise bismuth-telluride that can be secured with electrically-conductive thermal adhesive, silver-filled two-component epoxy 132, as shown. Thin-film thermal epoxy 135 can fill any microscopic imperfections at the interface between each layer of thermo-electric capacitance spacer block 125 and thin non-electrically conductive layer 131, as shown.

Thermo-electric semi-conductor node 133 can comprise banks of electrically parallel-connected bismuth-telluride semiconductors that are in-turn electrically connected in series and interconnected to both power supply circuits and sensing/control circuits, as shown.

The overall efficiency of operation of thermo-electric assembly 123 can be improved with the combination of adding thermal capacitance, between each electrically series-connected (and thermally connected in series) thermo-electric semi-conductor node 133, and the ability to independently control the voltage across each series-connected thermoelectric semi-conductor node 133 (at least herein embodying wherein said at least one thermo-electric heat pump comprises at least one thermal capacitor adapted to provide at least one thermal capacitance in thermal association with said at least one thermo-electric device).

Thermo-electric capacitance spacer block 125 can be the thermal capacitance added between each electrically series-connected (and thermally series-connected) thermoelectric semi-conductor node 133, as shown. Also, the voltage, across each electrically series-connected (and thermally series-connected) thermo-electric semi-conductor node 133, can be controlled by at least one closed-feedback loop sensory circuit, as shown. Further, the voltage, across each electrically series-connected (and thermally series-connected) thermo-electric semi-conductor node 133, can be independently controlled, as shown. Still further, the independently-controlled voltage impressed across each electrically series-connected (and thermally series-connected) thermoelectric semi-conductor node 133, is integrated with adjacent such independently-controlled voltages, so as to ensure that under normal operational conditions, all electrically series-connected (and thermally series-connected) thermo-electric semi-conductor nodes 133 pump heat generally in the same direction, as shown. Even further, any short-term variation in voltage, impressed across each electrically series-connected (and thermally series-connected) thermo-electric semi-conductor node 133, can be constrained to less than about 1% of the RMS value of the voltage impressed across each electrically series-connected (and thermally series-connected) thermo-electric semi-conductor node 133.

At least one thermo-electric capacitance spacer block 125 can be about ¼ inch thick, and can be flat with parallel polished surfaces, as shown (at least embodying herein wherein such at least one thermal capacitance is user-selected to provide intended thermal association with said at least one thermo-electric device). At least one thermoelectric capacitance spacer block 125 can have slight indentations on parallel surfaces to allow the assembler to align thermo-electric capacitance spacer block 125 with thermoelectric semi-conductor node 133 while assembling thermo-electric assembly 123. Aluminum alloy 6061 can be used because of its lightweight, relatively high yield-strength of about 35000 psi, corrosion resistance, and excellent machinability. Aluminum alloy 6061 is resistant to stress corrosion cracking and maintains its strength within a temperature range of about −200° C. to about +165° C. Aluminum alloy 6061 is sold by McMaster-Carr as part number 9008K48. Alternately, thermo-electric capacitance spacer block 125 comprises copper and copper alloys, which provide needed levels of thermal conductivity, but are not as advantageous as aluminum alloys relative to structural strength and weight considerations.

Thermo-electric capacitance spacer block 125 can be 'sandwiched' between each thermo-electric semi-conductor node 133 in thermo-electric assembly 123, as shown (at least embodying herein wherein each such sandwich layer comprises at least one set of said thermo-electric devices and at least one set of said thermal capacitors). Thermo-electric capacitance spacer block 125 can, during normal operation, provides delayed thermal reaction time (stores heat), and in conjunction with controlled operation of a plurality of thermo-electric semi-conductor nodes 133, may act to minimize variations in temperature swings for sensitive and perishable sensitive goods 139 (at least herein embodying wherein said intended thermal association of such at least one least one thermal capacitance is user-selected to provide increased energy efficiency of operation of said at least one thermoelectric device as compared to said energy efficiency of operation of said at least one thermoelectric device without addition of said at least one least one thermal capacitor).

Circuit board 117 can be mounted and wired to control thermo-electric assembly 123 as shown. Circuit board 117 houses circuitry (see FIG. 11) for connecting at least one thermocouple 124 such that at least one thermocouple 124 acts as a one-wire programmable digital thermometer to measure at least one temperature at thermocouple 124, as shown. Circuitry on circuit board 117 can also provide at least one feedback loop for control of voltage and power feeds to at least one plurality of thermo-electric semi-conductor nodes 133.

Silver-filled two-component epoxy 132 can be a thermal adhesive (at least embodying herein wherein each such sandwich layer is suitable for thermally-conductively connecting to at least one other such sandwich layer; and wherein thermal conductance between essentially all such attached sandwich layers is greater than 10 watts per meter per degree centigrade; and wherein thermal conductance between essentially all such attached sandwich layers is greater than 10 watts per meter per degree centigrade). In some embodiments, thermal conductance between essentially all such attached sandwich layers can be less than 10 watts per meter per degree centigrade, and can be in a range of 5-10 watts per meter per degree centigrade, and can be, without limitation, approximately 6, 7, 8, or 9 watts per meter per degree centigrade.

Silver-filled two-component epoxy 132 can have a specific gravity of about 3.3, can be non-reactive and can be stable over the operating temperature range of embodiment 102. Silver-filled two-component epoxy 132 can be part number EG8020 from AI Technology Inc. Upon reading the teachings of this specification, those with ordinary skill in the art will now understand that, under appropriate circumstances, considering issues such as changes in technology, user requirements, etc., other materials with a high Seebeck coefficient, such as uranium dioxide, Perovskite® and other such materials yet to be developed, etc., may suffice.

Metal-to-metal contact is ideal for conducting the maximum heat transfer. However, a minute amount of thin-film thermal epoxy 135 applied provides filling of any air pockets and may increase thermal conduction between thermo-electric capacitance spacer block 125 and thermo-electric semi-conductor node 133 as shown in FIG. 8. Trapped air is about 8000 times less efficient at conducting heat than aluminum; therefore, thin-film thermal epoxy 135 can be used to minimize losses in interstitial thermal conductivity, as shown. The increase in efficiency can be realized because the effective contact-surface-area is maximized, thereby minimizing hot and cold spots that would normally occur on the surfaces. The uniformity increases the thermal conductivity as a direct result. Thin-film thermal epoxy 135 is often applied on both surfaces with a plastic spatula or similar device. Conductivity of thin-film thermal epoxy 135 is poorer than the metals it couples, therefore it can be important to use no more than is necessary to exclude any air gaps. Upon reading the teachings of this specification, those with ordinary skill in the art will now understand that, under appropriate circumstances, considering issues such as changes in technology, user requirements, etc., other conductor enhancements, such as, for example, other thermal adhesives, material fusion, conductive fluids or other such conductor enhancers yet to be developed, etc., may suffice.

FIG. 9A shows an electrical schematic view, illustrating electrical control of iso-thermal transport and storage system 100, according to a particular embodiment. According to embodiments of the present disclosure, the multiple temperature staging process can be accomplished by having at least two thermo-electric semi-conductor nodes 133 that, when wired in series, combine to form thermo-electric assembly 123, as shown. Additional thermo-electric semi-conductor nodes 133 may be electrically series-connected (and thermally series-connected) or electrically parallel connected (and thermally series-connected) to extend the heat-pumping capabilities of thermo-electric assembly 123, as shown.

Individual battery cells in at least one battery system 119 may be wired to switch between combinations of series and/or parallel depending on specific power available or if user 200 desires that particular design, as shown. At least one serial/parallel conversion relay 187 can provide switching between combinations of series and/or parallel modes. Serial/parallel conversion relay 187 can comprise double pole double throw (DPDT). Serial/parallel conversion relay 187 can further comprise a latching type of relay, which does not require continuous power to remain in either position. Upon reading the teachings of this specification, those with ordinary skill in the art will now appreciate that, under appropriate circumstances, considering issues such as changes in technology, user requirements, etc., other relay switching means, such as dual coil, non-latching, reed relays, pole and throw relays, mercury-wetted relays, polarized relays, contactor relays, solid-state relays, Buchholz relays, or other current switching means yet to be developed, etc., may suffice.

When increased voltage is supplied to selected layers of thermo-electric assembly 123 these sandwiched layers can be capable of pumping heat at higher rates, as required to ensure that the temperature of sensitive and perishable sensitive goods 139 can be maintained over a wide range of ambient conditions, as shown. This variation in heat pumping rate with each sandwiched layer of thermo-electric assembly 123 is allowed since at least one thermo-electric capacitance spacer block 125 can be provided between each thermo-electric semi-conductor node 133, as shown. Each at least one thermo-electric capacitance spacer block 125 can allow a buffering (momentary storage) of heat between adjacent thermo-electric semi-conductor nodes 133, as shown. This buffering can allow each thermo-electric semi-conductor node 133 flexibility to pump heat at varying rates while maintaining overall heating or cooling rates as required so as to maintain sensitive and perishable sensitive goods 139 at or near its desired temperature set-point. Upon reading the teachings of this specification, those with ordinary skill in the art will now understand that, under appropriate circumstances, considering issues such as changes in technology, user requirements, etc., other isolating means for example shims, blocks, chocks, chunks, cleats, cotters, cusps, keystones, lumps, prongs, tapers made of metallic and non-metallic materials yet to be developed, etc., may suffice.

Battery system 119 may comprise three each about 1.2 volt DC rechargeable batteries wired in series to thermo-electric assembly 123. Nominal capacity of this configuration of battery system 119 is about 10000 ampere-hour (Ah) with a minimum capacity of about 9500 milliampere-hour (mAh) per 1.2 VDC rechargeable battery. Maximum charging current of this configuration of battery system 119 is about of about 5 A. Battery system 119 can comprise Powerizer rechargeable battery part number MH-D10000APZ, having a maximum discharging current of about 30 A. Dimensions of each battery can be about 1.24 inches by about 2.36 inches. Each, each battery can weigh about 5.7 ounces and can have a cycle performance of above about 80% of initial capacity at 1000 cycles at about 0.1° C. discharge rate.

Heat pumping rates, between sensitive and perishable sensitive goods 139 and the ambient air surrounding iso-thermal transport and storage system 100, may be actively increased or decreased by thermo-electric assembly 123 within iso-thermal transport and storage system 100, as shown. The direction of the heat pumping within this system can be fully reversible and available upon instant demand. Changing the polarity of the voltage of battery system 119, as applied across thermo-electric assembly 123, causes heat to be pumped in opposite directions (either from the ambient surrounding iso-thermal transport and storage system 100 to sensitive and perishable sensitive goods 139, or from sensitive and perishable sensitive goods 139 to the ambient surrounding iso-thermal transport and storage system 100). Changes in the level of voltage, at which power from battery system 119 is applied across thermo-electric assembly 123, cause heat to be pumped, by thermo-electric assembly 123, at greater or lesser rates. The combination of controlling the polarity, and the magnitude, of voltage from battery system 119 can allow sensitive and perishable sensitive goods 139 can be maintained near a predetermined set-point temperature. The predetermined set-point temperature can be maintained as the ambient temperature varies widely. This allows the integrity of sensitive and perishable sensitive goods 139 can be maintained over a wide range of ambient conditions. Also, this allows the integrity of sensitive and perishable sensitive goods 139 can be maintained for long transporting-distances, or long storage-time periods, or both. The duration of the long transporting-distances or the long storage-time periods is largely determined by a combination of the total stored energy in battery system 119 and the rate at which that energy is dissipated into thermo-electric assembly 123, as shown. Upon reading the teachings of this specification, those with ordinary skill in the art will now appreciate that, under appropriate circumstances, considering issues such as changes in technology, user requirements, etc., other voltage regulating means for example multi-output pulse-width modulation power supplies, flyback-regulated converters, magnetic amplifier/switching power supplies yet to be developed, etc., may suffice.

Figure 9B:
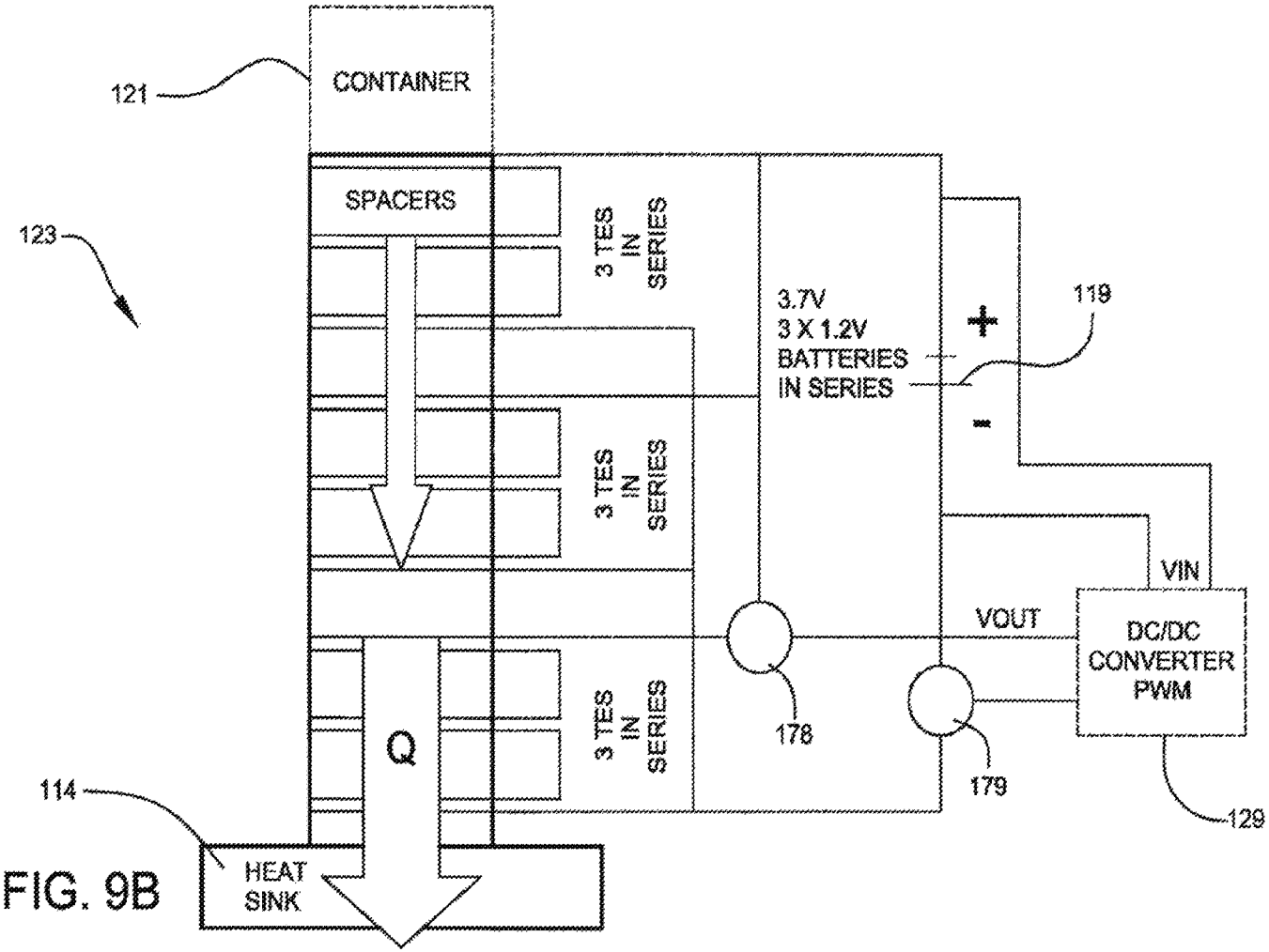

FIG. 9B shows an electrical schematic view, illustrating an alternate electrical control of iso-thermal transport and storage system 100, according to a particular embodiment.

Thermo-electric assembly 123 alternately may operate with pulse-width modulation based voltage control, as shown. Such pulse-width modulation voltage control is not limited to about 1.2, 2.4, 3.6, 4.8 or 12 VDC battery-string voltages. Rather, the pulse-width modulation based voltage control can be varied as needed to achieve intermediate voltages consistent with maintaining constant temperature within at least about 1° C., as shown in FIG. 9B (at least herein embodying wherein such control of such at least one temperature comprises controlling such at least one temperature to within a tolerance of less than one degree centigrade).

Pulse-width modulation can use a square wave, wherein the duty cycle is modulated, so as to vary the average value of the resulting voltage waveform. The output voltage of the pulse-width modulation voltage-control can be smooth, as shown. The output voltage can have a ripple factor of less than about 10% of the RMS (root mean square) output voltage, and can result in less than about 1% variation in the change in temperature across thermo-electric assembly 123 (at least herein embodying wherein said intended thermal association is user-selected to control usage of proportional control circuitry in combination with at least one energy store to power said at least one thermo-electric heat pump to control such at least one temperature of the temperature sensitive goods).

At least one DC/DC converter 129 can be a switch-mode converter, which can provide output voltages that are greater than its input voltage, as shown. Input voltage for DC/DC converter 129, as utilized in iso-thermal transport and storage system 100, can be sourced from at least one battery system 119. DC/DC converter 129 can provide output power at voltages in excess of battery system 119, as shown. This attribute of DC/DC converter 129 can allow substantial flexibility in the operation of iso-thermal transport and storage system 100, particularly the operation of fan 120, as shown. Powering fan 120 at higher input voltages, are available directly from battery system 119, results in fan 120 operating at higher speeds (revolutions per minute) and thus higher cooling rates. Thus, varying the input voltage into fan 120 can also vary the ability of iso-thermal transport and storage system 100 to dissipate heat. Increasing input voltage into fan 120, above the output voltage available from battery system 119, also can increase the highest ambient temperatures at which iso-thermal transport and storage system 100 can operate. Additionally, increasing the voltage across thermo-electric assembly 123 also can increase the rate at which thermo-electric assembly 123 pumps heat from sensitive and perishable sensitive goods 139 to the ambient (when operating in cooling mode), or from the ambient to sensitive and perishable sensitive goods 139 (when operating in heating mode). Thus, the addition of DC/DC converter 129 can be highly useful for extending the operational flexibility iso-thermal transport and storage system 100.

Power from battery system 119, entering into DC/DC converter 129 or directly into at least one thermo-electric semi-conductor node 133, exits passing through at least one relay 178 and at least one relay 179. Relay 178 and relay 179 can be momentary latching relay(s) that perform as electrical switches that open and close under of at least one control of monitoring circuitry on circuit board 117. Relay 178 and relay 179 can be latching relays, meaning they require control power only during the time that they switch from their on-to-off state or switch from off-to-on state, thus minimizing control power usage (at least embodying herein wherein said intended thermal association of such at least one thermal capacitance is user-selected to allow usage of momentary-relay-based control circuitry in combination with at least two energy stores to power said at least one thermo-electric device to achieve control of at least one temperature of the temperature sensitive goods).

Relay 178 and relay 179 can be double pole, double throw (DPDT), latching-style relays. Relay 178 and relay 179 can be digital, high-sensitivity low-profile designs, which may withstand voltage surges meeting FCC Part 68 regulation. Relay 178 and relay 179 can be a low-signal style G6A as manufactured by Omron. A standard dual-coil latching relay 178 and relay 179 can be part number G6AK-234P-ST-US. Specifications on this relay include a rated voltage of about 5 VDC, a rated current of about 36 mA and a coil resistance of about 139 ohm (.OMEGA.). A minimal power can be consumed during the latching operation of relay 178 and relay 179. Upon reading the teachings of this specification, those with ordinary skill in the art will now appreciate that, under appropriate circumstances, considering issues such as changes in technology, user requirements, etc., other relay switching means, such as dual coil, non-latching, reed relays, pole and throw relays, mercury-wetted relays, polarized relays, contactor relays, solid-state relays, Buchholz relays, or other current switching means yet to be developed, etc., may suffice.

Iso-thermal transport and storage system 100 can operate most efficiently when thermo-electric assembly 123 is electrically wired in series, as shown. However, thermo-electric assembly 123 may be wired in various combinations of series and parallel, as a means of adjusting the heat-pumping rate, as shown. Thus, iso-thermal transport and storage system 100 can operate efficiently when the wiring of thermoelectric assembly 123 can be switched as needed to mirror the heat-pumping demand, as that demand changes with time, as shown. Iso-thermal transport and storage system 100 can provide such operational efficiently by switching the input voltages into thermo-electric assembly 123 using at least one relay 178 and at least one relay 179. At least one relay 178 and at least one relay 179 can switch available voltages, from battery system 119, without continuously dissipating energy. Monitoring circuitry on circuit board 117 can monitor the status of at least one relay 178 and at least one relay 179 to prevent unnecessary energizing of outputs if at least one relay 178 and at least one relay 179 are already at a desirable position (at least herein embodying wherein said at least one thermo-electric heat pump comprises at least one first such sandwich layer comprising such set of said thermo-electric devices; wherein each thermo-electric device comprising said plurality is electrically connected in parallel with each other each thermo-electric device comprising said plurality; and wherein each of set of said thermo-electric devices comprising such first sandwich layer is thermally connected in series with each other sandwich layer). Upon reading the teachings of this specification, those with ordinary skill in the art will now appreciate that, under appropriate circumstances, considering issues such as changes in technology, user requirements, etc., other power conservation means other energy-efficient switching means, such as control devices, incremental power storage means yet to be developed, etc., may suffice.

At least one DC/DC converter 129 can utilize pulse-width modulation (hereinafter "PWM") may be incorporated into circuitry on circuit board 117 to boost voltage to thermo-electric semi-conductor nodes 133 when higher rates of heat pumping is required. Such higher voltages, applied to thermo-electric semi-conductor nodes 133, permit higher rates-of-change in temperature, thus increasing the heat transfer rate in that portion of thermo-electric assembly 123, as shown, to remove excessive heat from the portions of thermo-electric assembly 123, as shown. Once the temperature of sensitive and perishable sensitive goods 139 is normalized, the system may return to normal high efficiency operation.

Figure 10:
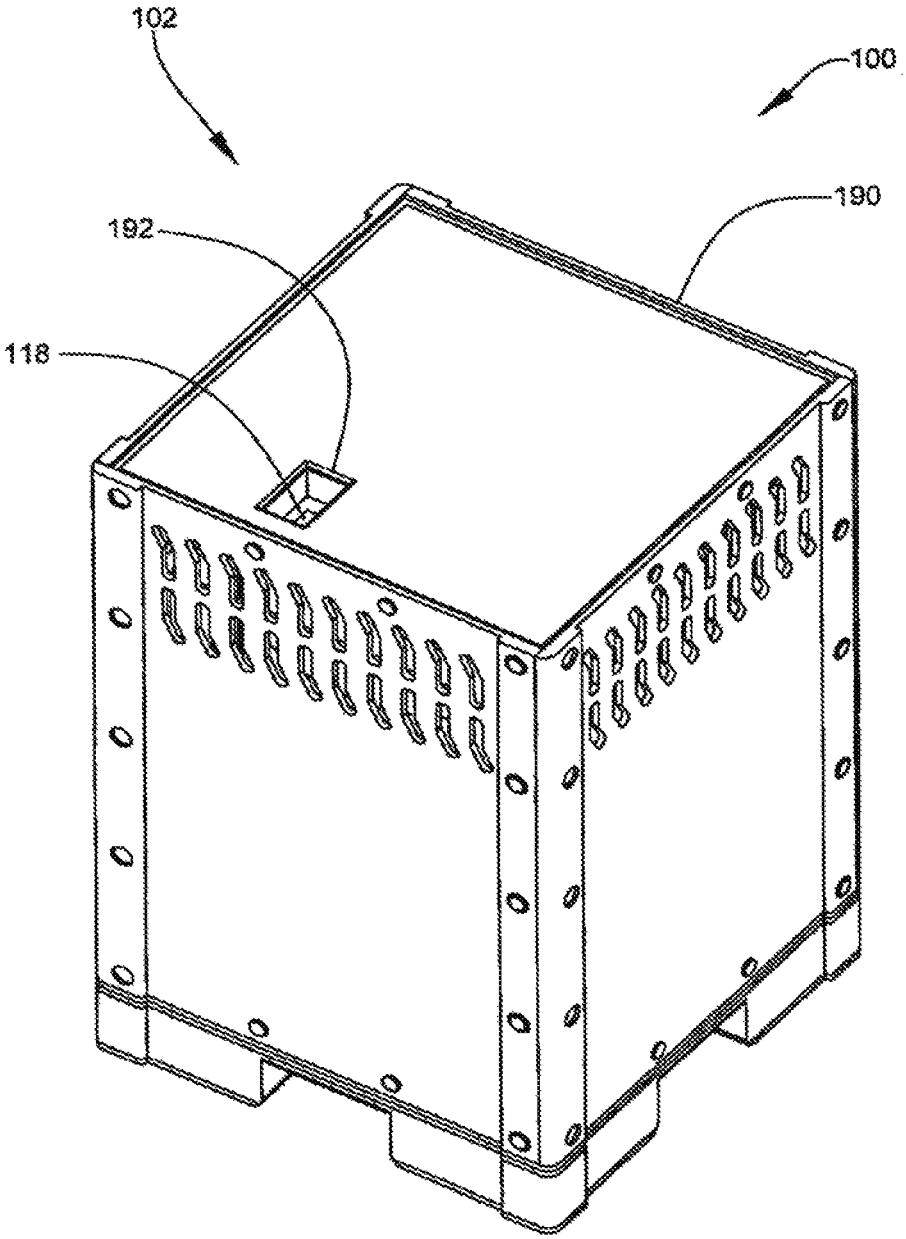
FIG. 10 shows a perspective view illustrating a possible embodiment of the iso-thermal transport and storage system as viewed from underneath.

FIG. 10 shows a perspective view illustrating embodiment 102*a*, of iso-thermal transport and storage system 100 as viewed from underneath, as shown previously in FIG. 1A. Safety on/off switch 118 can be mounted on horizontal upper-surface 191 (see FIG. 3) of base portion 190. Base portion 190 can measure about 9 inches wide by about 9 inches long. User 200 can activate or deactivate safety on/off switch 118 on iso-thermal transport and storage system 100, by moving it to the appropriate position. At least one recess 192 can be provided, as shown, to allow safety on/off switch 118 to be protected from accidental switching causing iso-thermal transport and storage system 100 to cease operation. This recessed design of safety on/off switch 118 can serve to prevent iso-thermal transport and storage system 100 from operating when not required or, more dangerously, not operating when necessary. A simple mishap such as inadvertently bumping the switch to the off position may allow iso-thermal transport and storage system 100 to return to ambient environmental temperature, which may damage or destroy sensitive and perishable sensitive goods 139. The danger in accidental shutoff of safety on/off switch 118 is that at least one required temperature-range of sensitive and perishable sensitive goods 139 protected in vessel 121 is compromised. Recess 192 can be about 1⅓ inches wide, about ⅞ inch long and about 1 inch deep. Upon reading the teachings of this specification, those with ordinary skill in the art will now appreciate that, under appropriate circumstances, considering issues such as changes in technology, user requirements, etc., other switching means for example, actuators, triggers, activators or other such switching means yet to be developed, etc., may suffice.

Embodiment 102 is designed to be hardened relative to mechanical shock, thereby creating extended expected usable-life and cost-effectiveness for user 200, during normal transport and storage conditions, as shown. Upon reading the teachings of this specification, those with ordinary skill in the art will now understand that, under appropriate circumstances, considering issues such as changes in technology, user requirements, etc., other shock protectors, such as, for example, pads, buffers, fillings, packings or other such shock protecting means yet to be developed, etc., may suffice.

Figure 11:
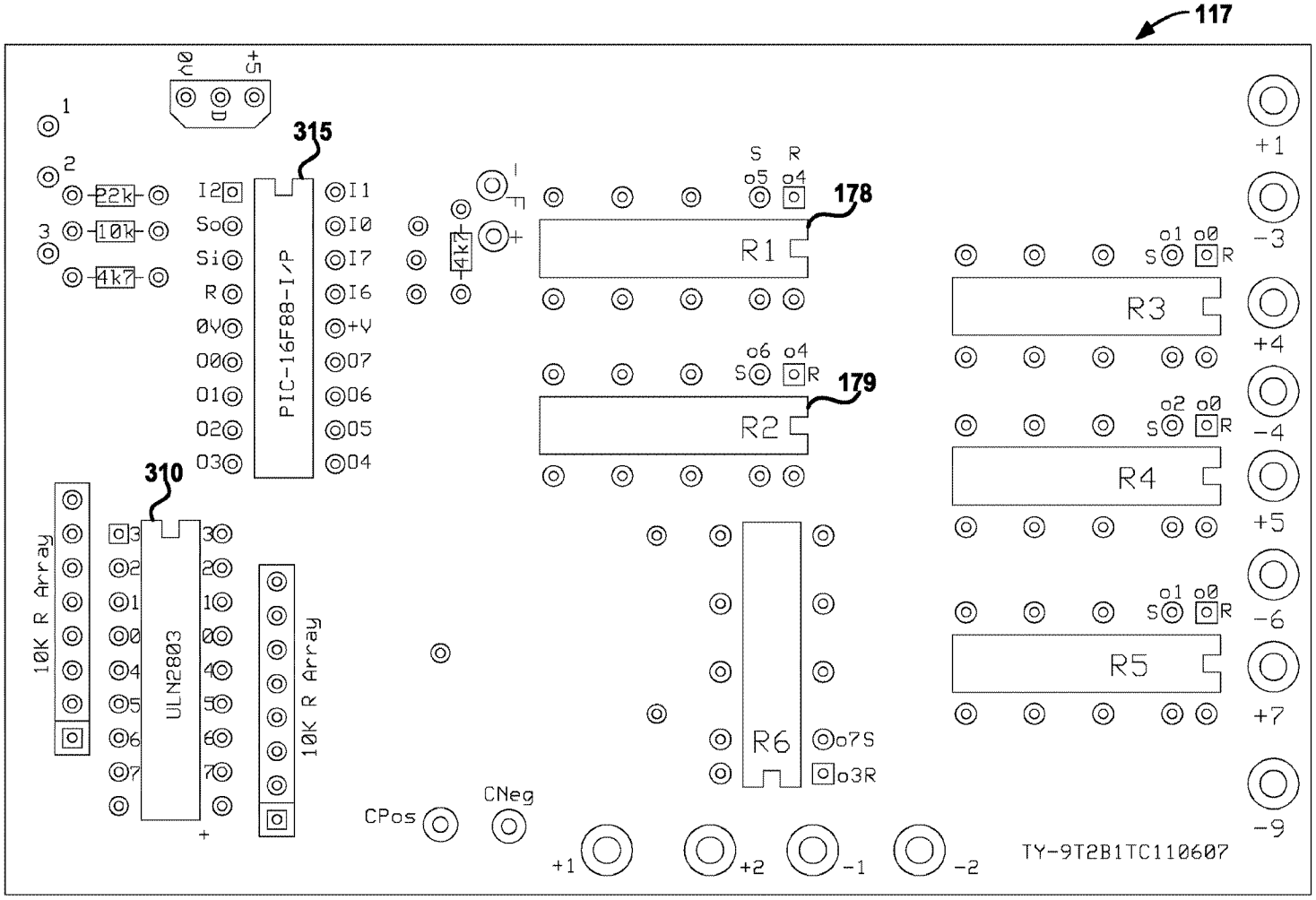
FIG. 11 shows a schematic view, illustrating a control circuit board, according to a possible embodiment.

FIG. 11 shows a schematic view, illustrating a control circuit board, according to an embodiment. Circuit board 117 can use a series P-1 linear analog controller 315, PIC-16F88-1/P, with an output of 0-5 VDC, corresponding to a thermistor range of about 0-50 thousand ohms (K.OMEGA.) or about 0-500 K.OMEGA. Series P-1 linear analog controller 315 can be provided with temperature set-point, maximum current set-point, loop gain and integral-time single-turn adjustment potentiometers. High current-levels may be applied to control actuators, relay 178 and relay 179, while maintaining low power on circuit board 117. Heat may be pumped in either direction, to or away from, sensitive and perishable sensitive goods 139, as shown in FIG. 6 according to desired temperature setting (set-point temperature of sensitive and perishable sensitive goods 139). Upon reading the teachings of this specification, those with ordinary skill in the art will now appreciate that, under appropriate circumstances, considering issues such as changes in technology, user requirements, etc., other controller means, such as other circuit boards, temperature monitors yet to be developed, etc., may suffice.

FIG. 11 shows the control circuit board physical layout for circuit board 117. FIG. 11 shows an optional pin-configuration for relay-driver device ULN2803 310. FIG. 11 also shows an optional pin-configuration for series P-1 linear analog controller 315. Additionally, FIG. 11 further shows optional pin-configurations for relay 178 and relay 179. Potential additional control relays R3, R4, R5, and R6 are also shown in FIG. 11. Upon reading this specification, those skilled in the art will now appreciate that, under appropriate circumstances, considering such issues as future technologies, cost, space limitations, etc., other circuit board layouts, such as, for example, single integrated chip layouts, size variant layouts (longer, wider, shorter, etc.), stacked layouts, multi-board layouts, etc., may suffice.

The wiring connections between thermo-electric assembly 123 and at least one battery system 119 can use soldered connections, as shown. Circuit board 117 can comprise G10 epoxy-glass board, about 1/16 inches thick, about 2½ inches wide and about 3⅞ inches long, possibly comprising one-ounce etched-copper conductors on at least one side, as shown.

Solder comprises a fusible metal alloy, possibly comprising a melting range of about 90° C. to about 450° C. Solder can be melted to join the metallic surfaces of the wire 177 to circuit board 117. Flux cored wire solder can be used, such as Glow Core, marketed by AIM. Solder can be lead-free compatible, can have excellent wetting properties, can have a wide process-time window and can be cleanable with a CFC-free cleaning solution, designed for use in ultrasonic cleaning or spray and immersion systems, total Clean 505 as manufactured by Warton Metals Limited. Alternately, other metals such as tin, copper, silver, bismuth, indium, zinc, antimony, or traces of other metals may be used within the solder mixture. Also, lead-free solder replacements for conventional tine-lead (Sn60/Pb40 and Sn63/Pb37) solders, having melting points ranging from about 118° C. to about 340° C., which do not damage or overheat circuit board 117 during soldering processes, are utilized.

Alternately, other alloys, such as, for example, tin-silver-copper solder ($SnAg_{3.9}Cu_{0.6}$) may be used, because it is not prone to corrosion or oxidation and has resistance to fatigue. Additionally, mixtures of copper within the solder formulations lowers the melting point, improves the resistance to thermal cycle fatigue and improves wetting properties when in a molten state. Mixtures of copper also retard the dissolution of copper from circuit board 117. Upon reading the teachings of this specification, those with ordinary skill in the art will now appreciate that, under appropriate circumstances, considering issues such as changes in technology, user requirements, etc., other wiring controlling means, such as boards, cards, circuit cards, motherboards yet to be developed, or other combinations of solder including $SnAg_{3.0}Cu_{0.5}$, $SnCu_{0.7}$, $SnZn_9$, $SnIn_{8.0}Ag_{3.5}Bi_{0.5}$, $SnBi_{57}Ag_1$, $SnBi_{58}$, $SnIn_{52}$ and other possible flux and alloy solder formulations, etc., may suffice.

Figure 12A:
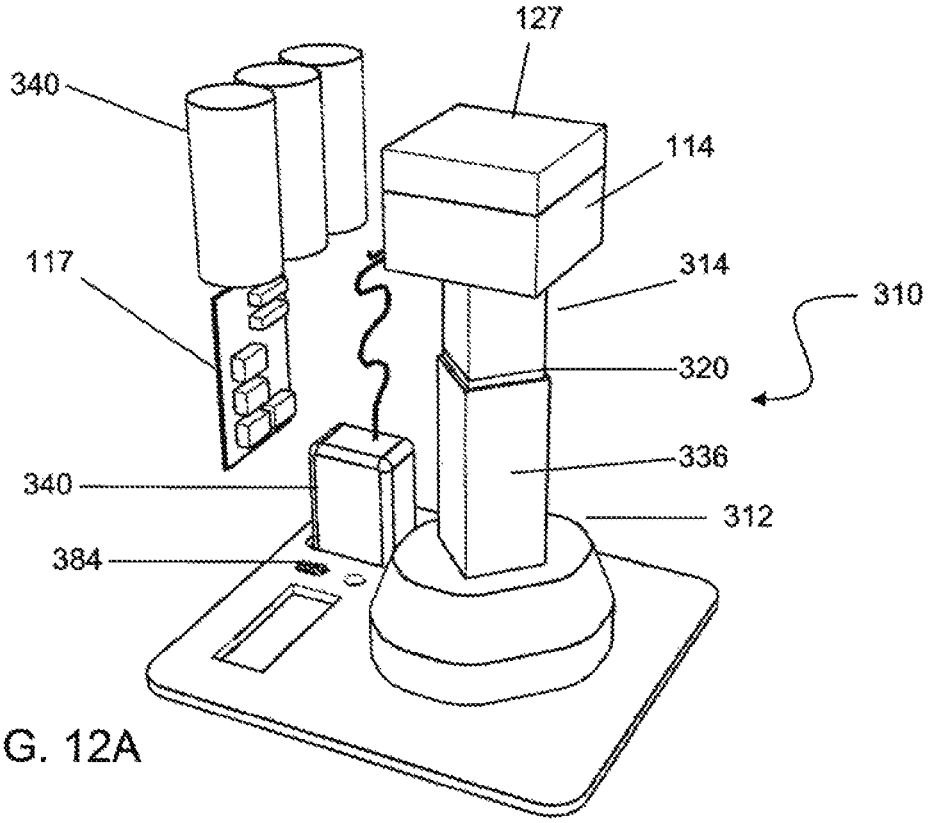
FIGS. 12A and 12B show perspective views, illustrating a thermoelectric transport and storage device.

FIG. 12A illustrates an embodiment of thermoelectric heat pump assembly 310. In this embodiment, thermoelectric heat pump assembly 310 has a top end 312 and a bottom end 314, thermoelectric heat pump assembly 310 comprising at least one thermoelectric unit layer 320 capable of active use of the Peltier effect. Thermoelectric heat pump assembly 310 further comprises a capacitance spacer block 125 suitable for storing heat and providing a delayed thermal reaction time of the assembly 310, wherein the capacitance spacer block 125 is thermally connected to thermoelectric unit layer 320. Assembly 310 further comprises: at least one energy source 340 operably connected to the at least one thermoelectric unit layer 320, wherein the energy source 340 is suitable to provide a current; a heat sink 114 associated with a fan assembly 127, wherein in the heat sink 114 is thermally connected at the bottom end of the heat pump assembly 310, the heat pump assembly 310 being thermally connected to an isolation chamber 336, and wherein the thermoelectric heat pump assembly 310 further comprises a circuit board 117.

Figure 12B:
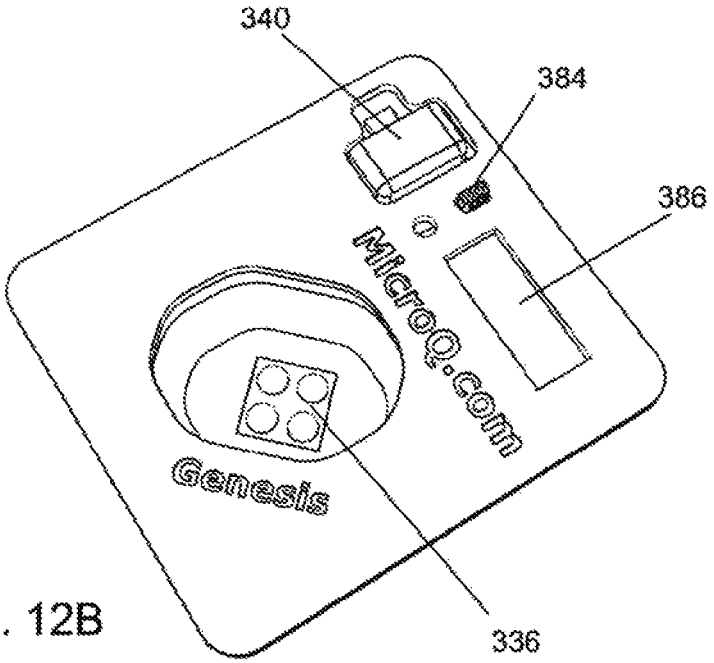

FIG. 12B shows a top view of another embodiment of thermoelectric transport and storage device 102, showing: a thermal isolation chamber 336, an LCD display 386, at least one energy source 340, and a DB connector 384.

Figure 13A:
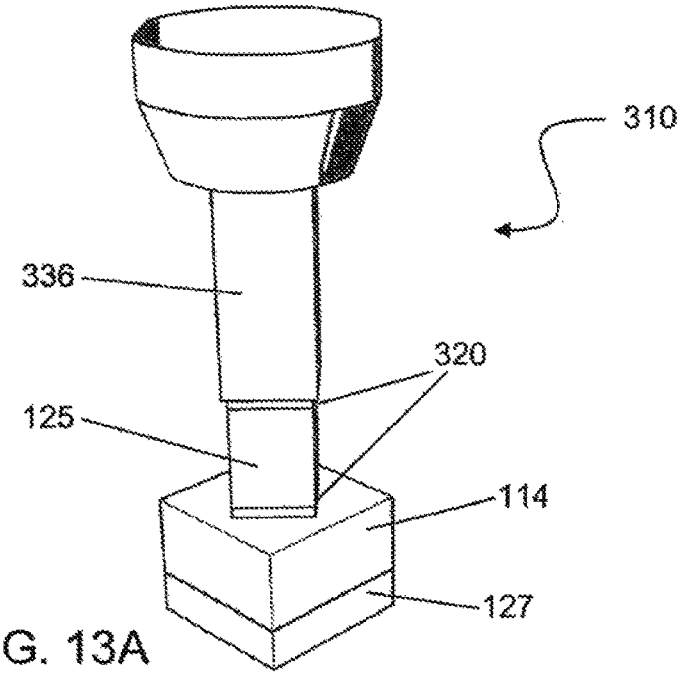
FIGS. 13A and 13B show perspective views, illustrating a thermoelectric heat pump assembly can comprise two thermoelectric unit layers and a thermoelectric transport and storage device with a robust shock proof exterior.

FIG. 13A shows another embodiment of thermoelectric heat pump assembly 310, the assembly 310 comprising: two thermoelectric unit layers 320 capable of active use of the Peltier effect, each thermoelectric unit layer 320 having a cold side 322 and a hot side 324 (See FIG. 15); at least one capacitance spacer block 125 suitable for storing heat and providing a delayed thermal reaction time of the assembly 310, the capacitance spacer block 125 being between a first thermoelectric unit layer 332 and a second thermoelectric layer 334 (See FIG. 15), wherein the top portion 326 of the capacitance spacer block 125 is thermally connected to the hot side 324 of the first thermoelectric unit layer 332 and the bottom portion 328 is thermally connected to the cold side 322 of the second thermoelectric unit layer 334 (See FIG. 15), thereby forming a sandwich layer 330 suitable to pump heat from the first thermoelectric unit layer 332 to the second thermoelectric layer 334 (See FIG. 15); and a heat sink 114 associated with a fan assembly 127, wherein the heat sink 114 is thermally connected at the bottom end 314 of the heat pump assembly 310.

Figure 13B:
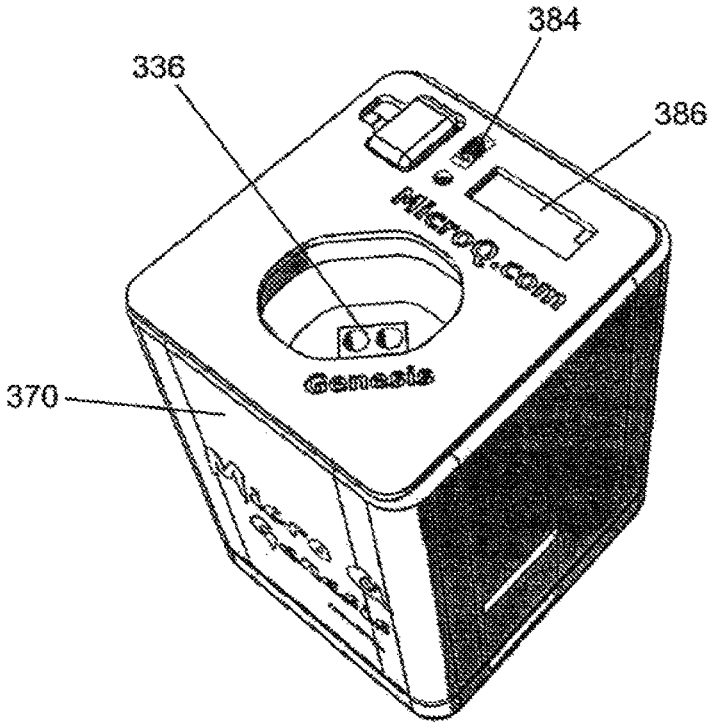

FIG. 13B shows a perspective view of another embodiment of thermoelectric transport and storage device 102, wherein the transport and storage device 102 includes: a thermal isolation chamber 336, a robust shock proof exterior 370, an LCD display 386, at least one energy source 340, and a DB connector 384.

Figure 14:
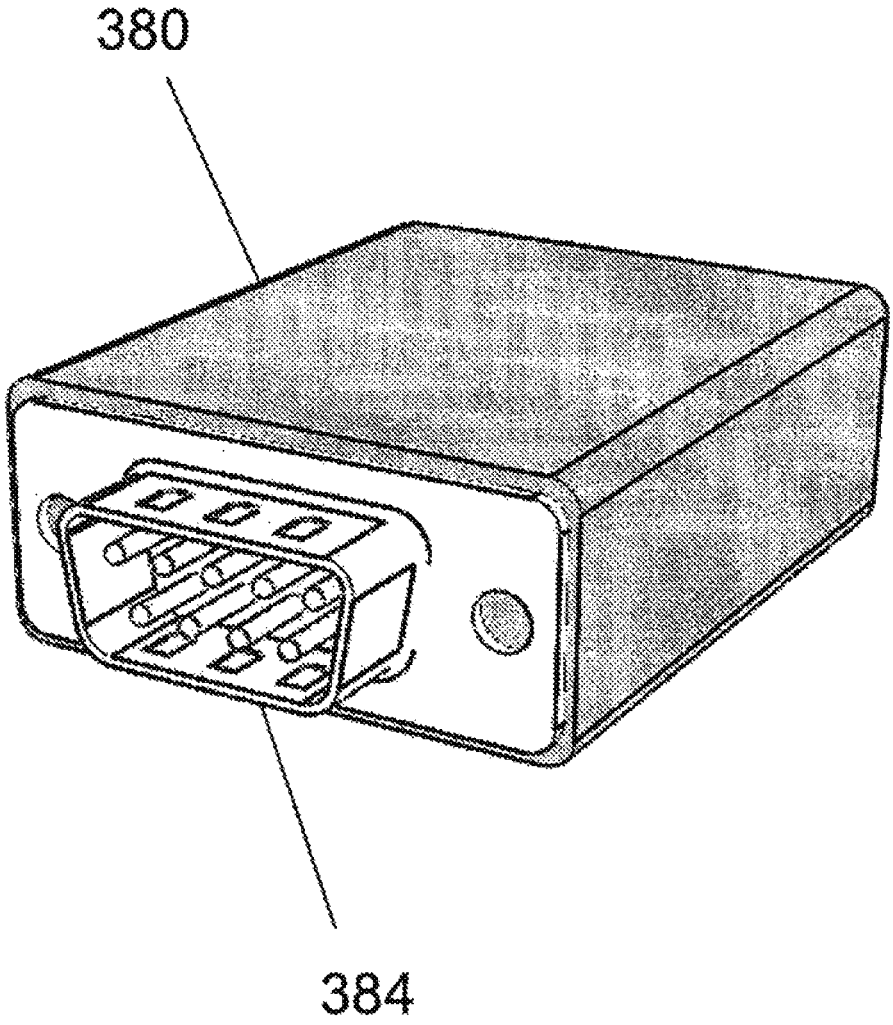
FIG. 14 shows a perspective view, illustrating a portable microprocessor.

FIG. 14 shows a perspective view, illustrating a portable microprocessor 380, according to an embodiment of the present disclosure. In one embodiment, a portable microprocessor 380 may be utilized to communicate with the thermoelectric transport or storage device 102 (See FIG. 13B) to send and receive time and temperature profiles related to the thermoelectric heat pump 310. The sending and receiving of time and temperature profiles between the portable microprocessor 380 and thermoelectric transport or storage device 102 may either be directly through DB connectors 384 or alternatively through radio-frequency identification (RFID) tags. When the portable microprocessor 380 is sending or receiving time and temperature profiles directly through the DB connectors 384 or RFID tag the thermoelectric transport or storage device's 102 energy source 340 may supply the needed power to activate the portable microprocessor 380. The amount of power generally needed to activate the portable microprocessor 380 is 5 volts. Upon activation, the portable microprocessor 380 may then communicate with an electrically-erasable programmable ROM (EEPROM) rewritable memory chip 382 operatively associated with the thermoelectric transport or storage device 102. Such communication between the portable microprocessor 380 and EEPROM rewritable memory chip 382 may be through a serial protocol by way of a multi-master serial computer bus. During communication the portable microprocessor 380 may also receive the time and temperature profiles from the EEPROM rewritable memory chip 382 and configure new time and temperature profiles for the EEPROM rewritable memory chip 382 relating to the thermoelectric heat pump 310. For instance, the portable microprocessor 380 may reconfigure the time for activating a series of thermoelectric unit layers 320 upon reaching a specified temperature.

Figure 15:
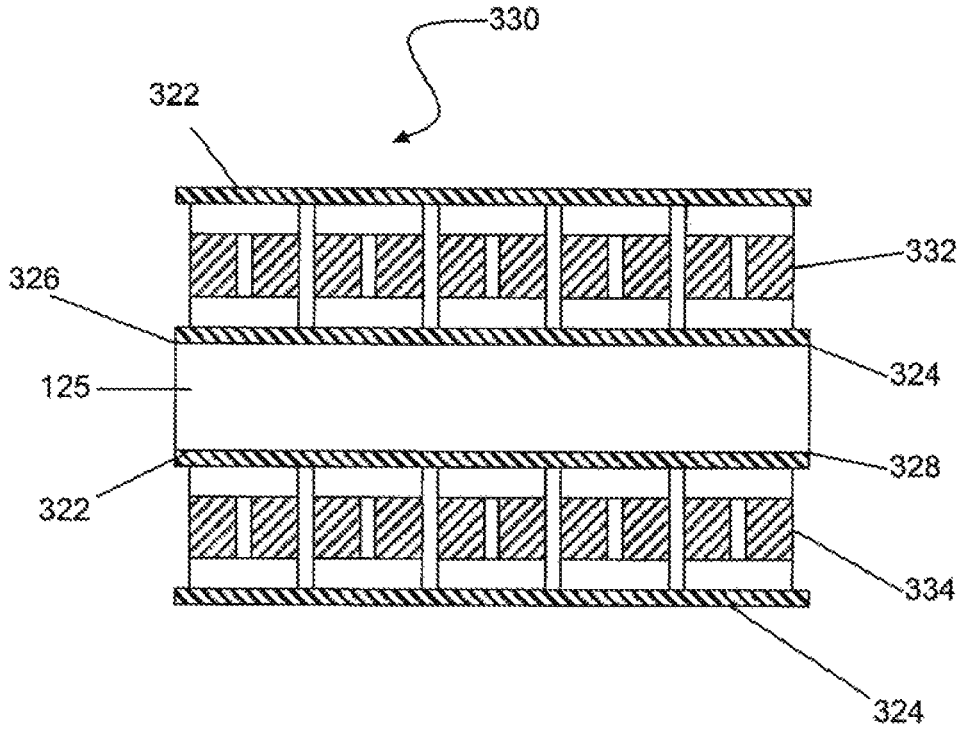
FIG. 15 shows a side profile view, illustrating a sandwich layer.

FIG. 15 shows a side profile view, illustrating a sandwich layer 330, according to an embodiment of the present disclosure. The sandwich layer 330 comprises at least one capacitance spacer block 125 suitable for storing heat and providing a delayed thermal reaction time of the assembly 310, the capacitance spacer block 125 having a top portion 326 and a bottom portion 328 and being between a first thermoelectric unit layer 332 and a second thermoelectric layer 334, wherein the top portion of the capacitance spacer block 125 is thermally connected to the hot side 324 of the first thermoelectric unit layer 332 and the bottom portion 328 is thermally connected to the cold side 322 of the second thermoelectric unit layer 334, thereby forming a sandwich layer 330 suitable to pump heat from the first thermoelectric unit layer 332 to the second thermoelectric layer 334.

Figure 16:
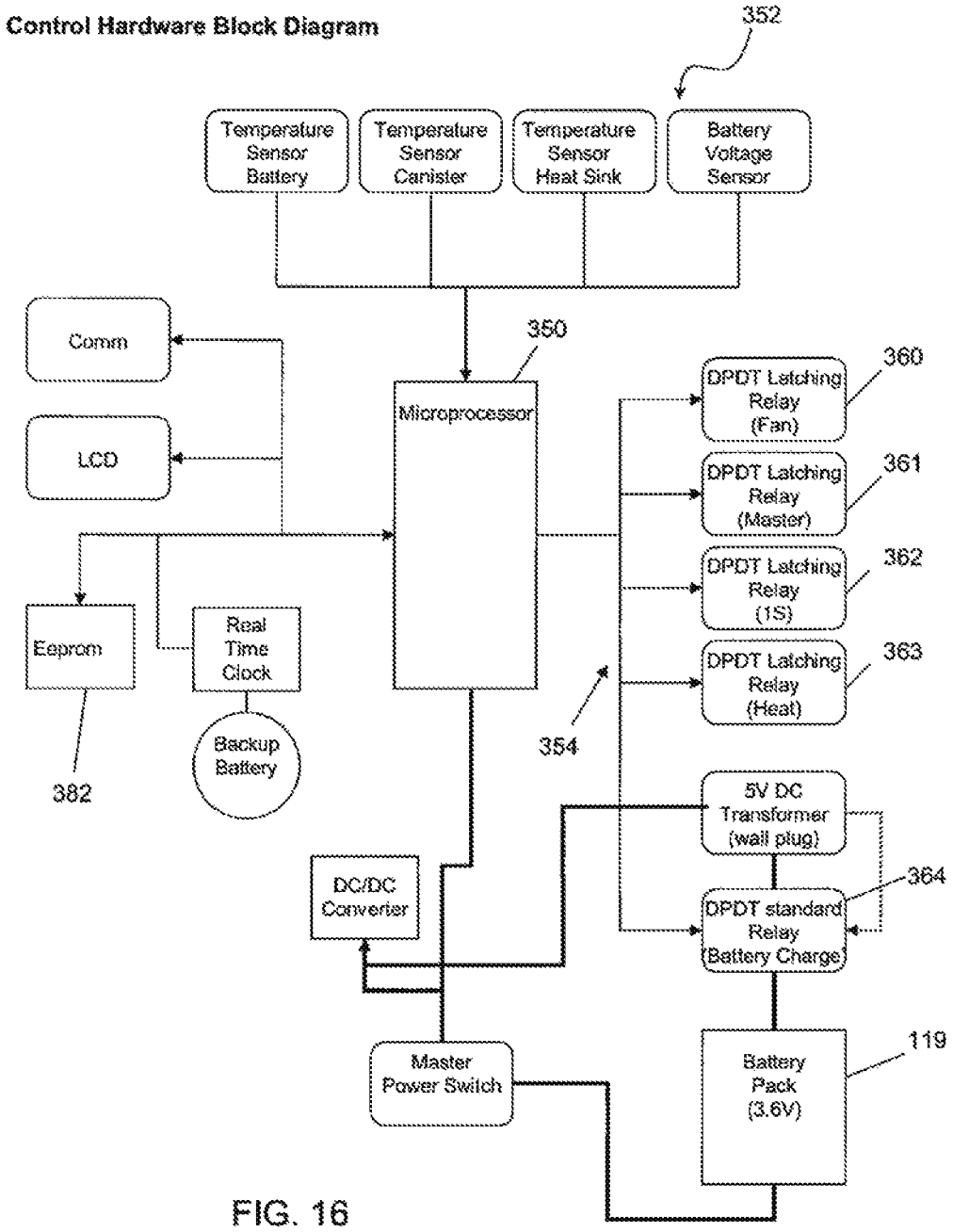
FIG. 16 shows a schematic view of a control hardware block diagram, illustrating momentary relay based circuitry programmable by a microprocessor adapted to control the temperature of temperature sensitive goods based on a desired temperature profile.

FIG. 16 shows a microprocessor 350 operatively associated with the thermoelectric heat pump assembly 310. As shown, microprocessor 350 communicates with EEPROM chip 382 to obtain instructions for operating at least one double-pole double-throw (DPDT) relay 360-364. The communication between microprocessor 350 and EEPROM chip 382 may include the sequencing of DPDT relays 360-364. For instance, microprocessor 350 may communicate with relays 360-364 to place thermoelectric unit layers 320 in series or parallel depending on the temperature of a canister, wherein the canister is comprised of the thermal isolation chamber 336 (see FIG. 12A).

Other communication between microprocessor 350 and DPDT relays 360-364 may include allocating power from battery 119 or alternative 5 volt direct-current (DC) transformer to various parts of the thermoelectric transport or storage device 102, such as fan assembly 127 (see FIG. 12A). A DC-to-DC converter, consisting of an inverter followed by a step-up or step-down transformer and rectifier may also be used to supply direct-current to microprocessor 350. In addition, microprocessor 350 communicates with LCD display 386 (see FIG. 12B) to convey information wherein microprocessor 350 is powered by a 3.6 volt battery pack which is connected by way of a master power switch.

Figure 17:
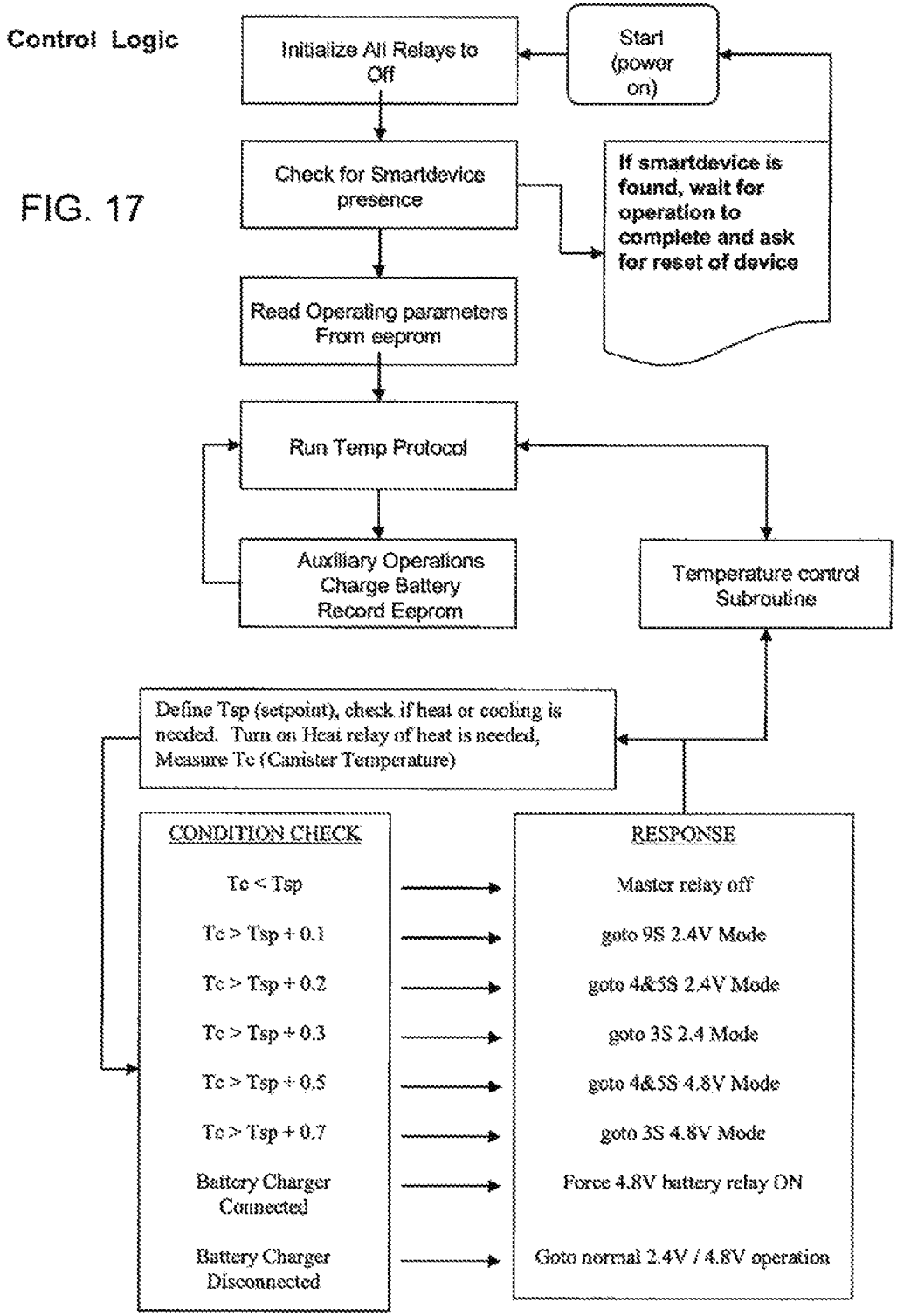
FIG. 17 shows a schematic view of a possible control logic diagram.

In another embodiment, as shown in FIG. 17, a portable microprocessor 380 i.e., "Smartdevice" (see FIG. 14) communicates with EEPROM chip 382 through a multi-master serial computer bus using I2C protocol to convey time and temperature profiles relating to the thermoelectric unit layers 320. Initially, as the power is turned on for the thermoelectric transport or storage device 102, all relays 360-364 are initially off. Next, microprocessor 350 of thermoelectric transport or storage device 102 checks for the presence of a portable microprocessor 380. If a portable microprocessor 380 is found the microprocessor 350 waits for operations to complete and ask user to reset. From this point, microprocessor 350 reads operating parameters from EEPROM chip 382. Microprocessor 350 may then receive temperature protocols and auxiliary operations of charging battery and recording EEPROM chip 382.

As shown in FIG. 17 and FIG. 18, temperature control subroutines are conveyed by microprocessor 350 to relays 360-364. The subroutines, define a setpoint temperature (Tsp) and control relays 360-364 to place thermoelectric unit layers 320 in series or parallel depending on Tsp and canister temperature (Tc), wherein the canister is comprised of the thermal isolation chamber 336 (see FIG. 12A). For instances, in one embodiment the subroutines may include the following instructions: 1) if Tc<Tsp, then turn relay off; 2) if Tc>(Tsp+0.1° C.), then switch to 9S and 2.4 volt mode; 3) if Tc>(Tsp+0.2° C.), then switch to 4&5S and 2.4 volt mode; 4) if Tc>(Tsp+0.3° C.), then switch to 3S and 2.4 volt mode; 4) if Tc>(Tsp+0.5° C.), then switch to 4&5S and 4.8 volt mode; 5) if Tc>(Tsp+0.7° C.), then switch to 3S and 4.8 volt mode; 6) if the battery charger is connected, then force 4.8 volt battery relay on; and 7) if batter charger is disconnected; then switch to normal 2.4 volt/4.8 volt operation.

As shown in FIG. 18, in another embodiment the subroutines may include the following instructions: 1) if Tc<Tsp, then turn relay off; 2) if Tc>(Tsp+0.1° C.), then switch to 6S and 3.6 volt mode; 3) if Tc>(Tsp+0.2° C.), then switch to 3S and 3.6 volt mode; 4) if Tc>(Tsp+0.3° C.), then switch to 2S and 3.6 volt mode; and 5) if Tc>(Tsp+0.5° C.), then switch to 1S and 3.6 volt mode. In yet another embodiment, the subroutines may include the following instructions: 1) if Tc<Tsp, then turn relay off; 2) if Tc>(Tsp+0.2° C.), then switch to 2S and 3.6 volt mode; and 3) if Tc>(Tsp+0.5° C.), then switch to 1S and 3.6 volt mode.

Figure 19:
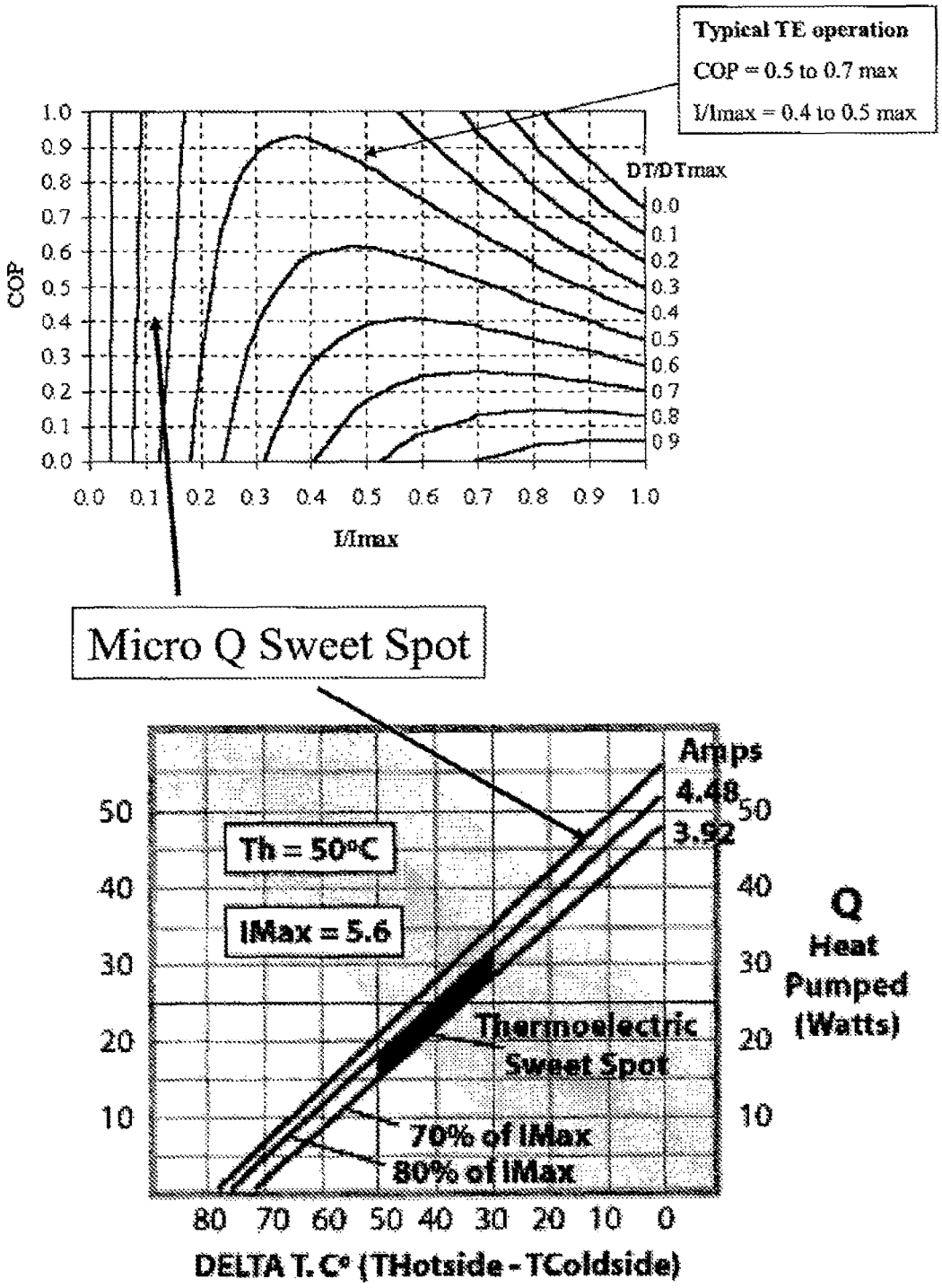
FIG. 19 shows two charts, each of which illustrate how various embodiments can be configured to maximize efficiency of operation compared to previously available thermoelectric heat pump systems; the charts further illustrate how heat pumped per unit of input power is maximized during overall use.

FIG. 19 shows two charts, each of which illustrate how embodiments of the present disclosure are configured to maximize efficiency of operation compared to previously available thermoelectric heat pump systems. For example, embodiments of the heat pump assembly can be configured so that each thermoelectric unit layer at steady-state during operation has ratio of the heat removed divided by the input power (or COP) that is prior to and less than the peak COP on a COP curve of performance (See infra FIGS. 25A-25C and FIGS. 26A-26C).

Figure 20A:
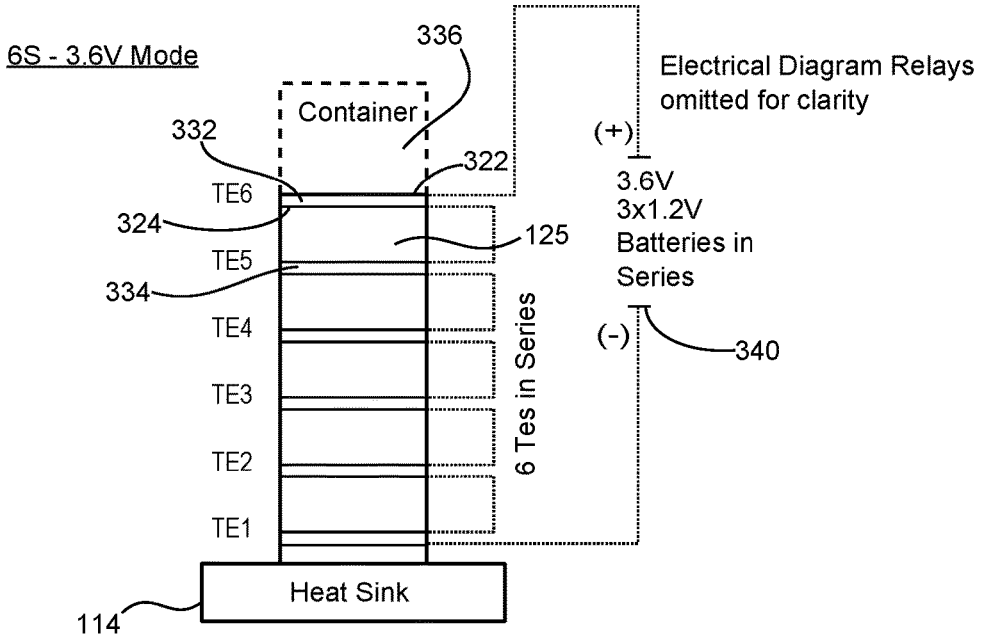
FIGS. 20A and 20B show an electrical schematic view, in which the thermoelectric heat pump assembly contains six thermoelectric unit layers, and wherein the thermoelectric unit layers can be reconfigurable between a higher power setting and a lower power setting, and series and/or parallel configurations.
Figure 20B:
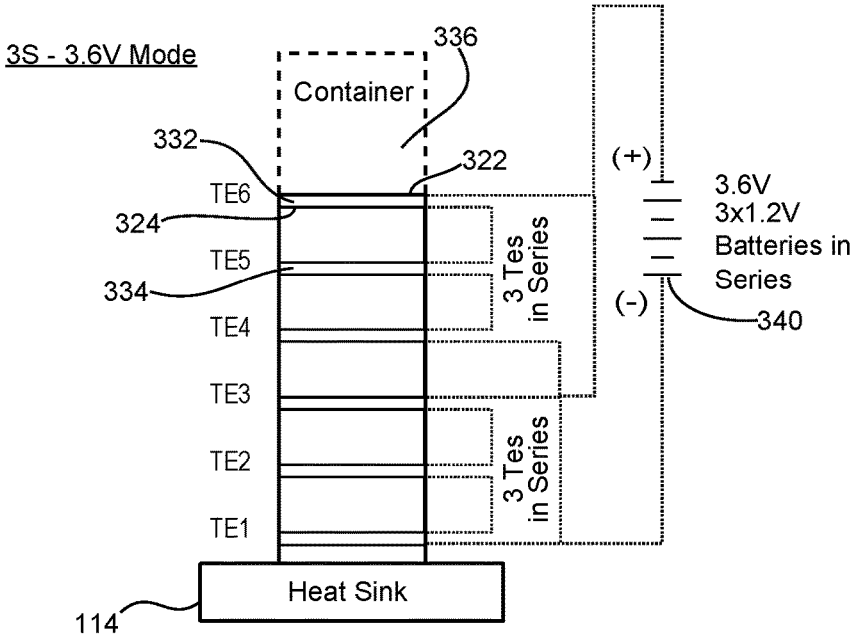

FIGS. 20A-23 show the thermoelectric unit layers 320 of thermoelectric transport or storage device 102. More specifically, FIG. 20A shows a 6 layer thermoelectric unit layer 320 in series, as well as in 6S-3.6 volt mode wherein thermoelectric unit layers 320 receive current from energy source 340 in order to create a heat pump which draws heat from thermal isolation chamber 336 to heat sink 114. Each thermoelectric layer 320 comprises capacitance spacer block 125, cold side 322 of thermoelectric unit layer 320, and hot side 324 of thermoelectric unit layer 320, wherein first thermoelectric unit layer 332 is adjacent to thermal isolation chamber 336. In the 6S-3.6 volt mode heat is transferred from thermal isolation chamber 336 to heat sink 114. Similar to FIG. 20A, FIG. 20B shows a 6 layer thermoelectric unit layer 320. However, FIG. 20B shows the 6 layer thermoelectric unit layer 320 wherein 3 thermoelectric unit layers 320 are in 2 sets of series, corresponding to a 3S-3.6 volt mode.

Figure 21A:
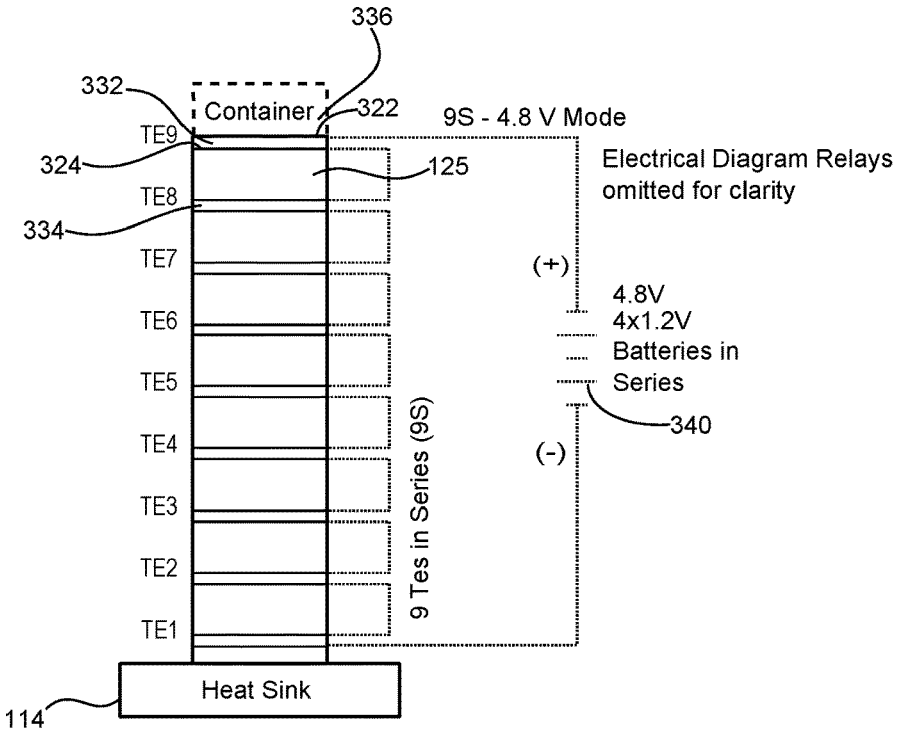
FIGS. 21A and 21B show electrical schematic views, in which the thermoelectric heat pump assembly contains nine thermoelectric unit layers, and wherein the thermoelectric unit layers can be reconfigurable between a higher power setting and a lower power setting, and series and/or parallel configurations.
Figure 21B:
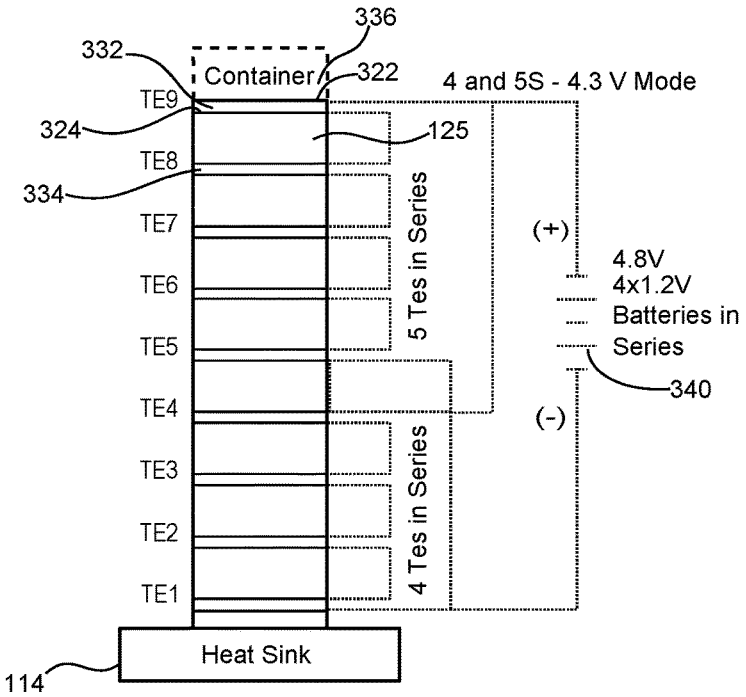
Figure 22A:
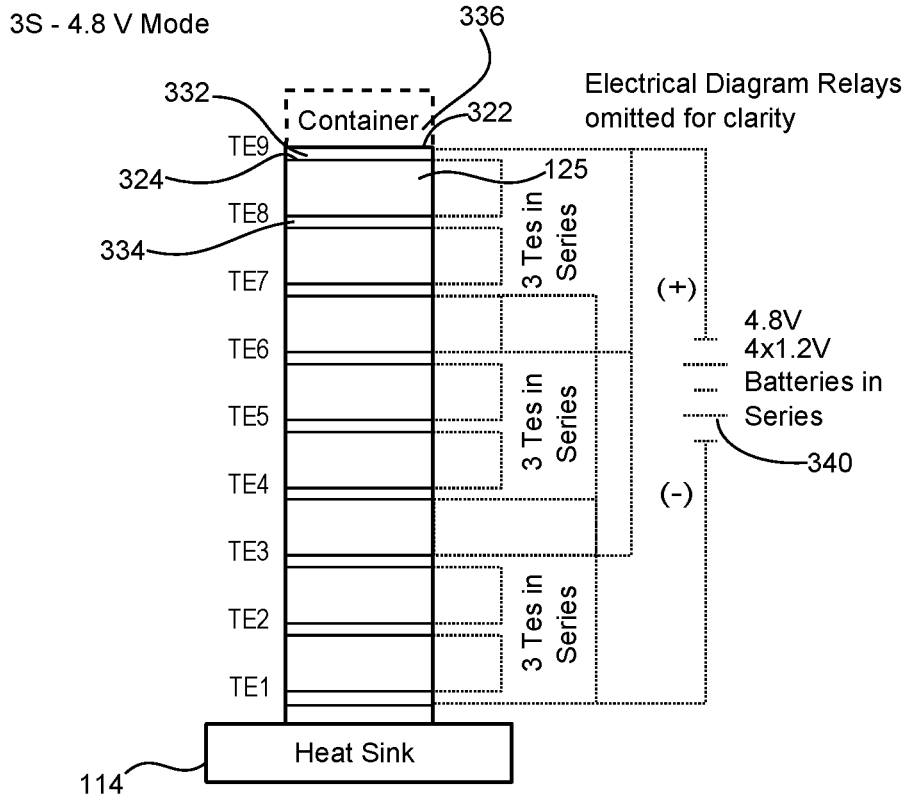
FIGS. 22A and 22B show an electrical schematic view, in which the thermoelectric heat pump assembly contains nine thermoelectric unit layers, and wherein the thermoelectric unit layers can be reconfigurable between a higher power setting and a lower power setting, and series and/or parallel configurations; and an electrical schematic view illustrating an embodiment in which the thermoelectric transport and storage device contains at least two thermoelectric heat pump assemblies.

FIGS. 21A and 21B show 9 layer thermoelectric unit layer 320 stacks. In FIG. 21A all 9 thermoelectric unit layers 320 are in series and correspond to a 9S-4.8 volt mode. In FIG. 21B the 9 layer thermoelectric unit layers 320 are broken into one set of 5 thermoelectric unit layers in series and one set of 4 thermoelectric unit layers in series, corresponding to a 4&5S-4.8 volt mode. FIG. 22A shows the 9 layer thermoelectric unit layer 320 stack in three sets of 3 thermoelectric unit layers in series.

Figure 22B:
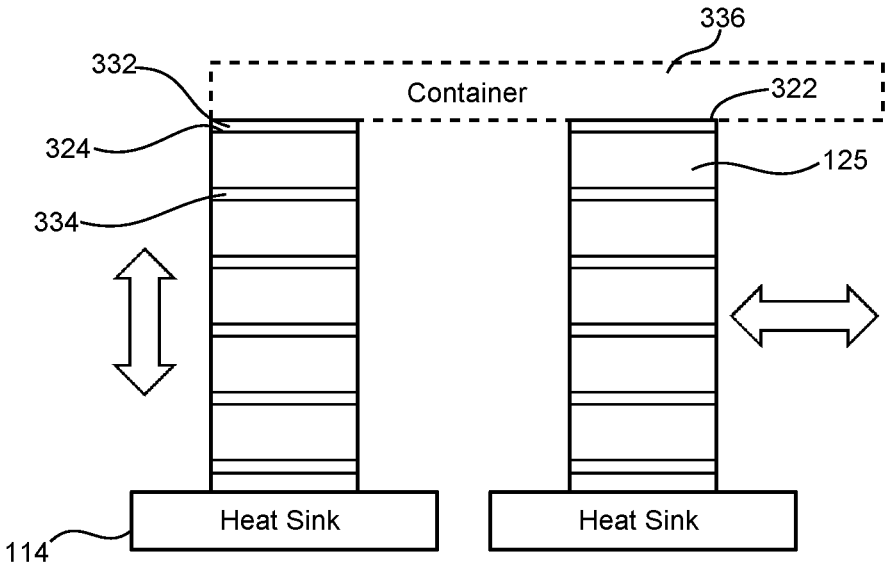
Figure 23A:
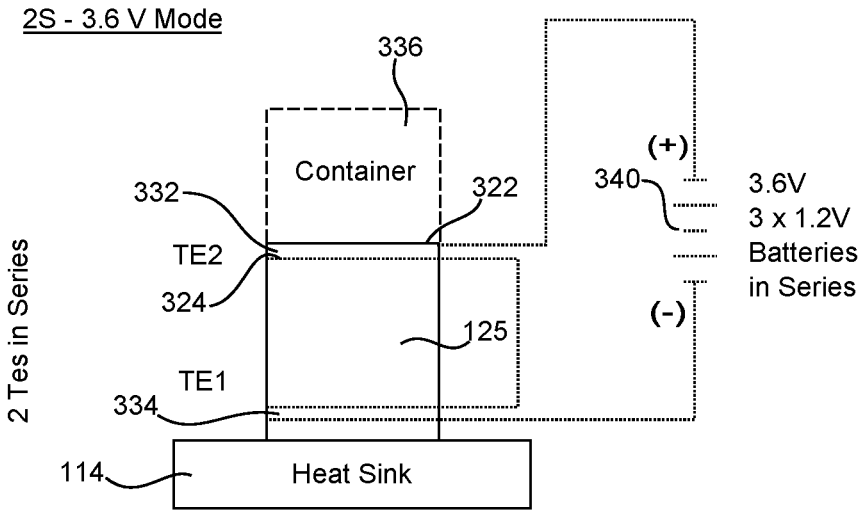
FIGS. 23A and 23B show electrical schematic views, in which the thermoelectric heat pump assembly contains two thermoelectric unit layers, and wherein the thermoelectric unit layers can be reconfigurable between a higher power setting and a lower power setting, and series and/or parallel configurations.
Figure 23B:
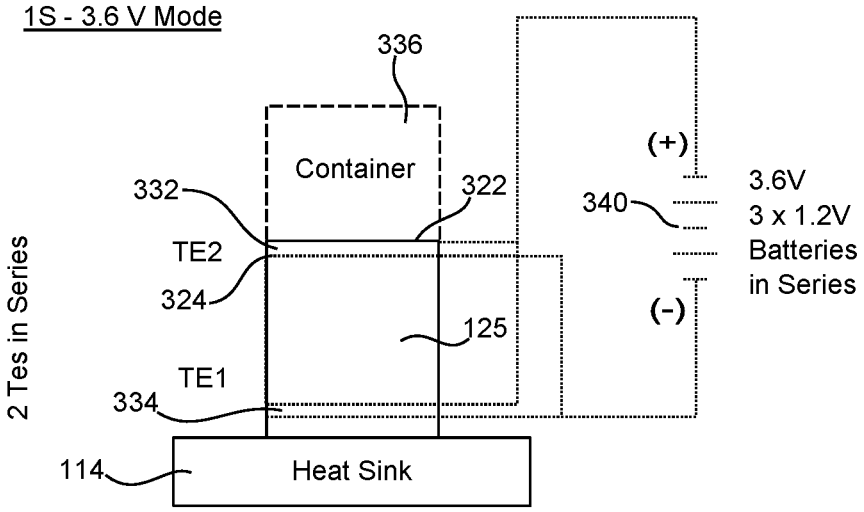

FIG. 22B shows how the thermoelectric unit layer 320 stacks may be placed in parallel when one thermoelectric unit layer 320 stack is not sufficient. FIGS. 23A and 23B show a 2 layer thermoelectric unit layer 320 wherein FIG. 23A is in 2S-3.6 volt mode and FIG. 23B is in 1S-3.6 volt mode. As previously stated, switching thermoelectric unit layers 320 between modes allow the thermoelectric transport or storage device 102 to more efficiently utilize energy source 340 while maintaining a desired Tc.

Figure 25A:
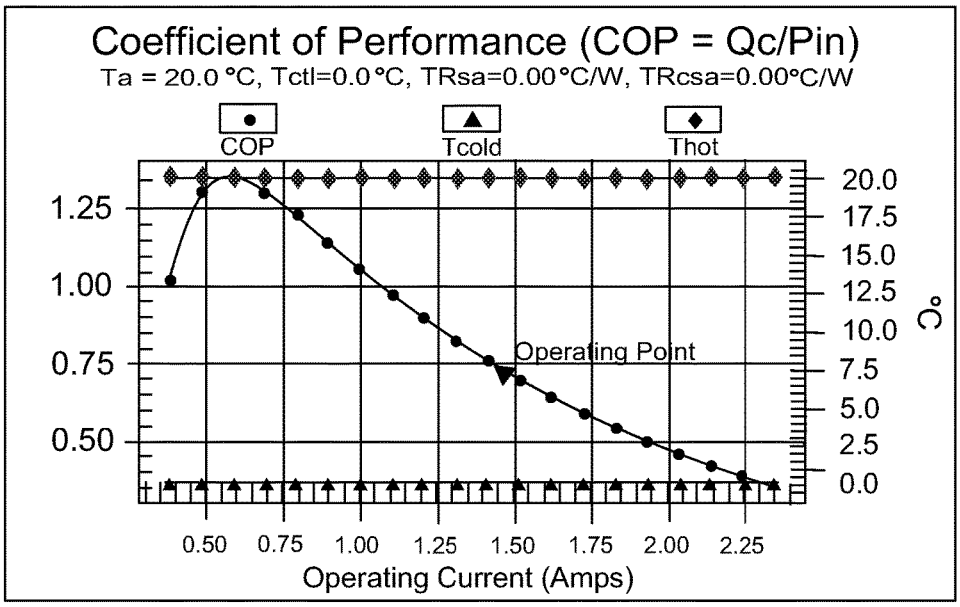
FIGS. 25A-25C show charts, illustrating how various embodiments can be configured to maximize efficiency of operation compared to typical thermoelectric heat pump systems; the charts further illustrate how the various embodiments can be configured to maximize heat pumped per unit of input power during overall use, while minimizing the ratio of input current to maximum available current at a given steady-state temperature.
Figure 25B:
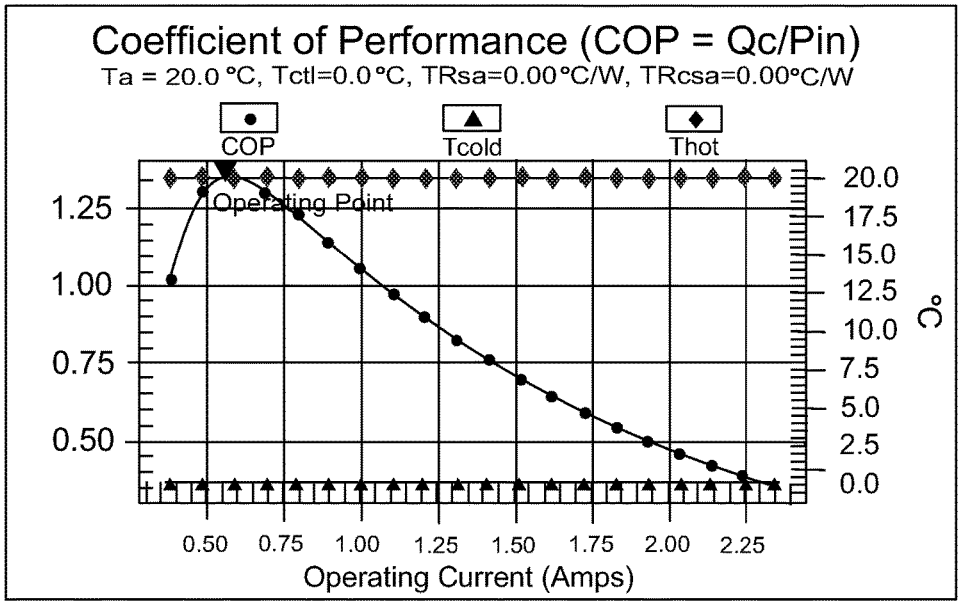
Figure 25C:
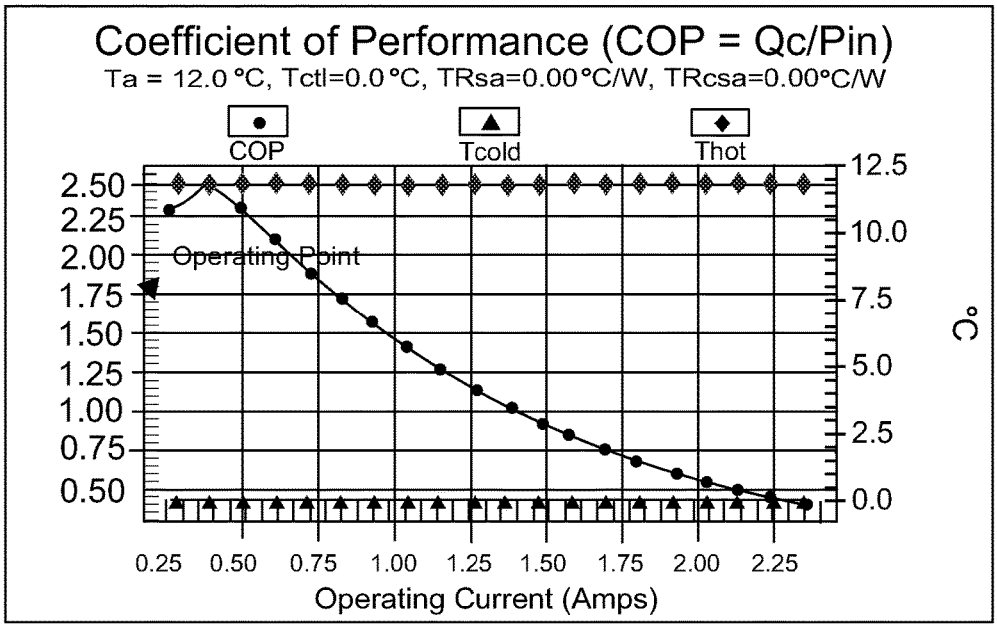
Figure 26A:
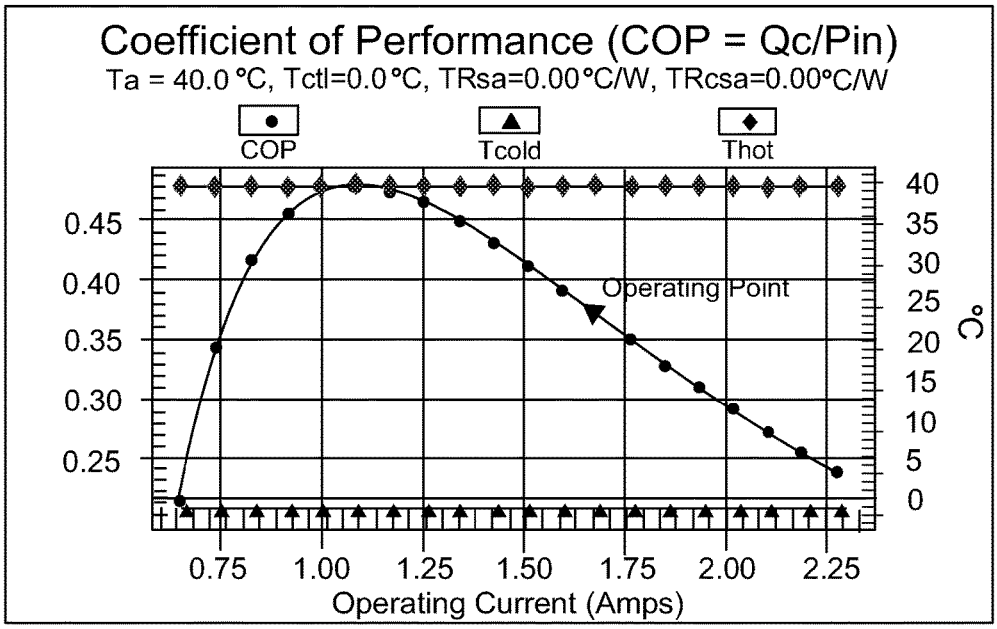
FIGS. 26A-26C show charts, illustrating how various embodiments can be configured to maximize efficiency of operation compared to typical thermoelectric heat pump systems; the charts further illustrate how various embodiments can be configured to maximize heat pumped per unit of input power during overall use, while minimizing the ratio of input current to maximum available current at a given steady-state temperature.
Figure 26B:
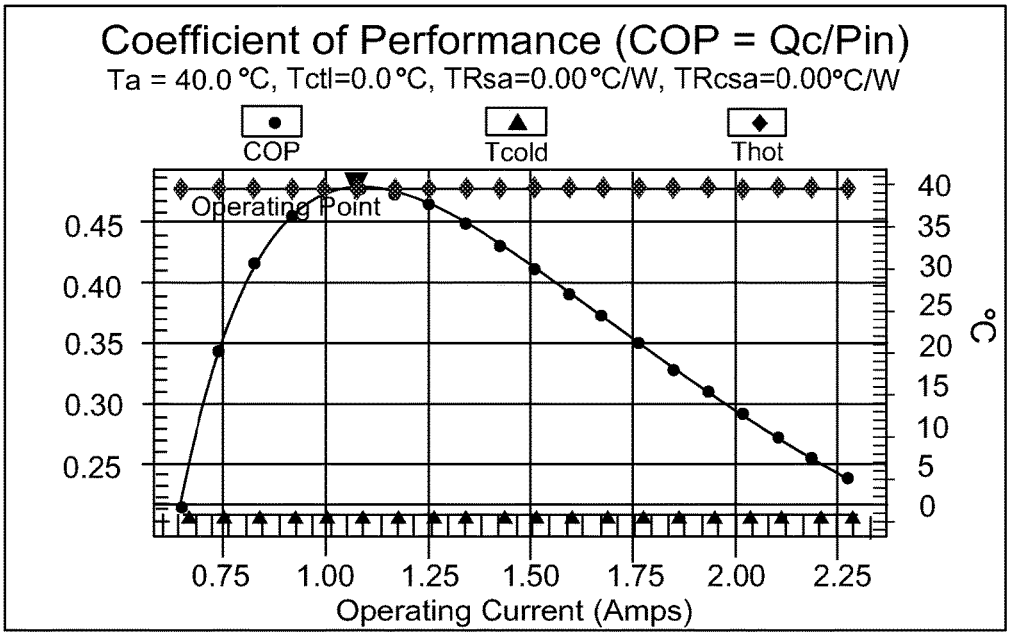
Figure 26C:
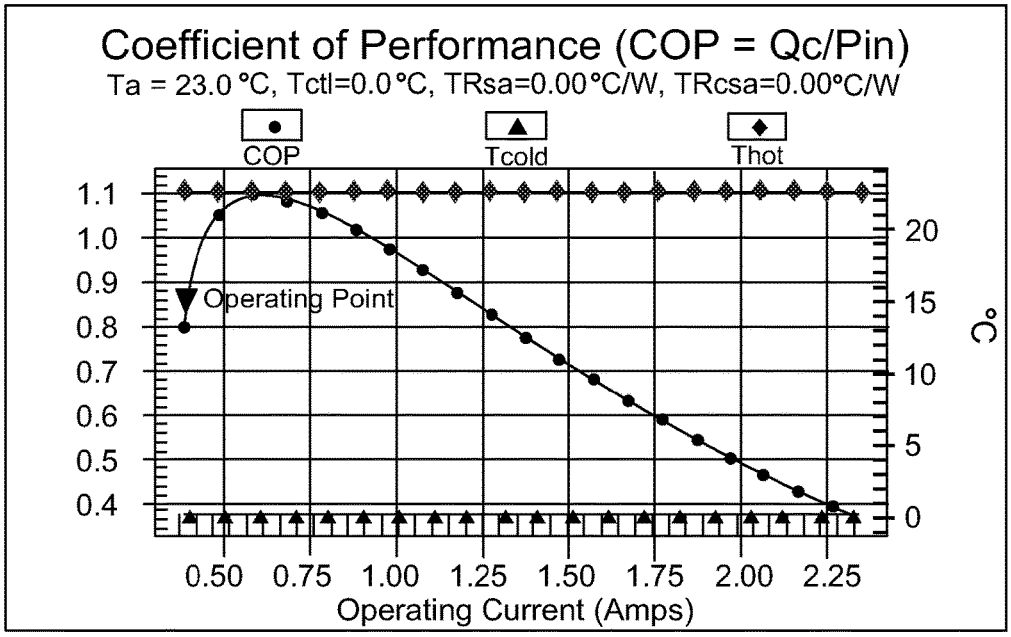

FIGS. 24A and 24B further emphasize advantages of thermoelectric transport or storage device 102, (see FIG. 13B), wherein the maximum current, current, maximum Delta-T, Delta-T, transferred heat, voltage, ratio of current to maximum current, ratio of Delta-T to maximum Delta-T, are displayed. FIG. 24A further shows the 1S mode and 2S mode at Delta-T of 20.9° C. and 39.4° C. Likewise, FIG. 24B shows a 1S and 2S mode at Delta-T of 10° C., 20° C. and 40° C. However, FIG. 24B defines values for heat transferred Q. FIG. 25A shows a graph of a typical operating point coefficient of performance at a Delta-T of 20° C., wherein Delta-T is the temperature difference between thermal isolation chamber 336 and heat sink 114. The coefficient of performance is defined as the amount of heat transferred from thermal isolation chamber 336 divided by the amount of power (voltage multiplied by current) required to operate thermoelectric transport or storage device 102. FIG. 25B further shows the optimum operating point coefficient of performance at a Delta-T of 20° C., which corresponds to FIG. 25C showing the operating point coefficient of performance of thermoelectric transport or storage device 102. As shown in FIG. 25A through FIG. 25C the operating point coefficient of performance for thermoelectric transport or storage device 102 is well above the typical operating point coefficient of performance. That is, thermoelectric transport or storage device 102 is able to pump more heat from thermal isolation chamber 336 to heat sink 114 using less current and ultimately less power than typical thermoelectric systems. Further improvements over typical thermoelectric systems was also shown in FIG. 26A through FIG. 26C at a Delta-T of 40° C.

FIGS. 27A-31 are similar to FIGS. 20A-23B in that FIGS. 27A-31 disclose various arrangements of thermoelectric heat pump assemblies or thermal protection systems 464 that include different numbers of thermoelectric modules. FIGS. 27A-31 differ from FIGS. 20A-23B in that while FIGS. 20A-23B illustrate thermoelectric modules or unit layers that are reconfigurable between higher power settings and a lower power settings by varying series configurations, parallel configurations, or both, FIGS. 27A-31 illustrate thermoelectric heat pump assemblies in which all of the thermoelectric modules of a stack can be electrically coupled and operated only in series, and do not have varying series configurations, parallel configurations, or both, to control higher power settings and a lower power settings. Instead, by providing thermoelectric heat pump assemblies in which all of the thermoelectric modules can be electrically coupled only in series, all of the thermoelectric modules for a given thermoelectric heat pump assembly can only be operated at a same time instead of having less than an entirety of the thermoelectric modules operating at a same time within the thermoelectric heat pump assembly to adjust an amount of heat being transported by the thermoelectric modules.

Figure 27A:
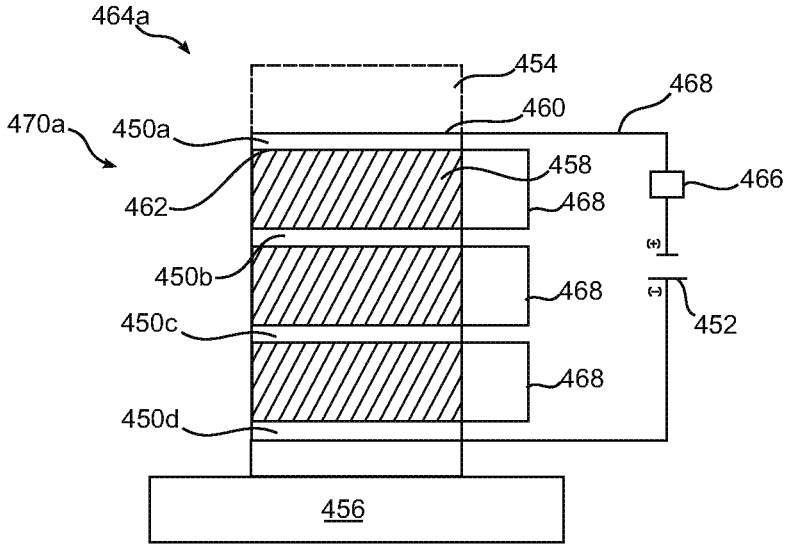
FIGS. 27A-27C show electrical schematic views, in which thermoelectric heat pump assemblies can comprises four thermoelectric units, all of which are arranged electrically and thermally in series.

FIG. 27A shows a thermoelectric heat pump assembly 464*a* comprising four thermoelectric modules or thermoelectric unit layers 450. Thermoelectric modules 450 are similar to thermoelectric unit layers 320 of thermoelectric transport or storage device 102. More specifically, FIG. 27A shows 4 layers of thermoelectric modules 450*a*-450*d* thermally and electrically coupled in series. Thermoelectric modules 450 receive current from energy source 452, similar to energy source 340 discussed in relation to FIGS. 20A-23B, in order to create a thermal protection system or heat pump which draws heat from vessel, container, or thermal isolation chamber 454 to heat sink 456, which are similar to thermal isolation chamber 336 and heat sink 114, respectively. While thermal protection system 464 is discussed, for convenience, with respect to heat being removed from vessel 454 and being transported through thermoelectric modules 450 and capacitance spacer blocks 458 to heat sink 456 to cool or decrease a temperature of vessel 454, the heat transfer can of course also operate in an opposite direction from heat sink 456 to vessel 454 to heat or increase a temperature of vessel 454 as previously described above. Thermoelectric heat pump assemblies 464 can include any number of thermoelectric modules 450 and capacitance spacer blocks 458, including without limitation, two to nine thermoelectric modules and capacitance spacer blocks, or any other number of thermoelectric modules 450 according to the operation and design of the heat pump assembly. Each stack 470 of thermoelectric modules 450 can optionally comprise one or more capacitance spacer blocks or capacitive spacer blocks 458 similar to capacitance spacer blocks 125. Each thermoelectric module 450 comprises a cold side 460 and a hot side 462, similar to cold side 322 and hot side 324 of thermoelectric unit layers 320, respectively.

As shown in FIG. 27A, thermal protection system 464*a* can comprise a stack 470*a* comprising four thermoelectric modules 450*a*-450*d* and three capacitance spacer blocks 458 interleaved with, and disposed between, the four thermoelectric modules. First thermoelectric module 450*a* can be adjacent to vessel 454, and fourth thermoelectric module 450*d* can be adjacent to heat sink 456. Heat can be transferred from vessel 454 to heat sink 456 through thermoelectric modules 450*a*-450*d* to cool the contents of vessel 454. Thermoelectric modules 450 of FIG. 27A can also include, as shown, sandwich layers similar to sandwich layer 330 shown in FIG. 15. By disposing capacitance spacer blocks 458 between thermoelectric modules 450, capacitance spacer blocks 458 can store heat and provide a delayed thermal reaction time between each adjacent thermoelectric module 450. Alternatively, as discussed in greater detail below with respect to the other embodiments shown in FIGS. 27A-31, capacitance spacer blocks 458 can be omitted from between thermoelectric modules 450, such that an entirety, or a portion less than an entirety, of the thermoelectric modules can be in direct contact with each other and not include an intervening capacitance spacer block 458. While thermoelectric modules 450 are at times, for convenience, referred to throughout the specification as being in direct contact with each other, direct contact between thermoelectric modules 450, as used herein, can include any desirable thermal interface material or adhesive, as described above, disposed between the thermoelectric modules.

Accordingly, FIG. 27A shows a thermoelectric heat pump assembly 464*a*, comprising a stack of four identical thermoelectric modules 450 arranged electrically and thermally in series and configured such that each thermoelectric module within the stack can simultaneously use the Peltier effect. As used herein with respect to thermoelectric modules 450, identical means the same in at least one material aspect of the thermoelectric module, such as an area, footprint, size, material, thermal conductivity, thermal capacity, electrical resistance, or a number of coupled pairs of thermocouples within the thermoelectric module. For example, thermoelectric modules 450*a*-450*d* can be commercially available units of a same size, such that each comprises a same number of thermocouples within the thermoelectric module, wherein each thermocouple or thermocouple pair can comprise two nodes. For example, thermoelectric modules 450*a*-450*d* can each include 63 thermocouples, 71 thermocouples, 127 thermocouples, 199 thermocouples, 254 thermocouples, 283 thermocouples, 287 thermocouples, or any other number of suitable thermocouples. Alternatively, one or more material aspects of thermoelectric modules 450 can also be similar but not identical to other thermoelectric modules, such as comprising variation among at least one aspect of the thermoelectric modules. Therefore, while thermoelectric modules 450 can be identical in at least one material aspect, the thermoelectric modules can also differ in other aspects, and can, for example, comprise an aspect that varies by a percent difference in a range of 0-30 percent, 0-20 percent, 0-10 percent, 0-5 percent, or within less than one percent difference.

As a non-limiting example, thermoelectric modules 450 can be different commercially available or custom made thermoelectric modules that are similar in size and identical in a number of thermocouples. Thermoelectric module 450*a* can, for example, include a 40 millimeter (mm) 127 thermocouple thermoelectric module while thermoelectric module 450*b* can include a 40 mm 127 thermocouple thermoelectric module. However, thermoelectric units can also comprise any suitable number of coupled pairs. In an embodiment, each thermoelectric unit comprises at least 127 coupled pairs and comprises a resistance of at least 3 ohms. In another embodiment, each thermoelectric unit can comprise a resistance of 3.75 ohms. Alternatively, each thermoelectric unit or thermoelectric module can comprise a resistance less than 3 ohms, such as a resistance greater than or equal to 1 ohm. In yet another embodiment, each thermoelectric unit can comprise at least 287 coupled pairs and a resistance of at least 3 ohms. Optionally, the thermoelectric unit can comprise a resistance of 8.5 ohms.

As indicated above with respect to FIG. 27A and thermoelectric heat pump assembly 464*a*, the stack of four identical thermoelectric modules 450 are arranged electrically and thermally in series and configured such that each thermoelectric module within the stack simultaneously uses the Peltier effect to conduct heat between vessel 454 and heat sink 456. For convenience, the term simultaneously refers to thermoelectric modules 450 being electrically connected in series and being activated at a same time, such, as when the electrical circuit is energized and the thermoelectric modules 450 receive power. As such, "simultaneously" as used herein ignores small delays that can exist within the circuit.

Furthermore, as shown in FIG. 27A, a thermally capacitive spacer block or capacitance spacer block 458 can be disposed between each of the at least three thermoelectric modules 450. In an embodiment, each thermoelectric module 450 can include a height, or a distance between cold side 460 and hot side 462, in a range of about 0.38-0.89 cm or about 0.64 cm (i.e., about 0.25 inches). The capacitance spacer blocks 458 disposed between each thermoelectric module 450 can include a height, or a distance between opposing hot and cold sides in a range of about 1.2-1.6 cm, or about 1.4 cm (i.e., about 9/16 inches). Accordingly, an overall height of stack 470*a* comprising four identical thermoelectric modules 450 and three interleaved capacitance spacer blocks 458, as shown in FIG. 27A, can be in a range of about 2-10 cm or approximately 6.35 cm (or about 2.5 inches). By creating an offset or distance of about 6.35 cm between vessel 454 and heat sink 456, insulation can be added around the stack 470 between vessel 454 and the ambient temperature outside the vessel from which the container is being heated or cooled to further increase an efficiency of thermal protections system 464. Alternatively, an overall height of stack 470 can also be in a range of about 0.5-5 cm or approximately 2.5 cm (or about 1 inch). By creating an offset or distance of about 2.5 cm between vessel 454 and heat sink 456, insulation can be added around the stack 470 between vessel 454 and the ambient temperature outside the vessel from which the container is being heated or cooled to further increase an efficiency of thermal protections system 464.

Additionally, because capacitance spacer blocks 458 can store heat to provide a time delay or temporal buffer with respect to heat transfer between a cold side of a first thermoelectric module 450 and a hot side of a second adjacent thermoelectric module 450, continuous or constant operation of the thermoelectric modules is not required. Instead, microcontroller 466 can turn off thermoelectric modules 450 to provide periods in which the thermoelectric modules are not actively using the Peltier effect to transfer heat between or among the thermoelectric modules and without significantly effecting a temperature differential established between the hold and cold sides of a single unit or between adjacent units during operation because of the thermal capacitive effect of the thermally capacitive spacer blocks.

Capacitance spacer blocks 458 are disposed between each of the plurality of thermoelectric modules 450 and help facilitate the simultaneous transfer of heat through thermoelectric modules 450 between vessel 454 and heat sink 456. An energy source 452 is coupled in series to stack 470*a* of the plurality of thermoelectric modules 450 and is configured to provide a current source to each of the thermoelectric units. As shown in FIG. 27A, thermoelectric modules 450 and capacitance spacer blocks 458 can be interleaved to form sandwich layers, as shown and described above with respect to FIG. 8. As described above, a thermal adhesive can be disposed between each thermoelectric module and capacitance spacer block to increase thermal conductivity and performance. The thermal adhesive can include silver-filled two-component epoxy 132, wherein thermal conductance between essentially all such attached sandwich layers is greater than 10 watts per meter per degree centigrade; and wherein thermal conductance between essentially all such attached sandwich layers is greater than 10 watts per meter per degree centigrade). In some embodiments, thermal conductance between essentially all such attached sandwich layers can be less than 10 watts per meter per degree centigrade, and can be in a range of 5-10 watts per meter per degree centigrade, and can be, without limitation, approximately 6, 7, 8, or 9 watts per meter per degree centigrade.

A microcontroller 466 is operatively associated with energy source 452 to direct current from the energy source to the plurality of thermoelectric modules 450. Operation of microcontroller 466 differs from the microcontroller used in conjunction with FIGS. 20A-23B in that instead of using the microcontroller to control at least one relay or electromechanical latch to change among various configurations of different series and parallel connected thermoelectric modules, the arrangement of the stack of thermoelectric modules 450 does not change, but remains in series and configured for simultaneously use the Peltier effect. Microcontroller 466, is not limited to electromechanical relays, but can include metal-oxide-semiconductor field-effect transistors (MOSFETs) or other suitable components or combinations of components as understood in the art to control an amount and duration of power simultaneously applied to the series connected stack 470 of thermoelectric modules 450.

Microcontroller 466 can define a Tsp and compare the Tsp to a Tc of vessel 454 and activate a simultaneous use of the Peltier effect for a duration of time in order to reduce a difference in temperature between the Tsp and Tc. Microcontroller 466 can compare the Tsp and Tc with a resolution of approximately 0.0625 degrees Celsius, using microcontroller 466 in a system comprising 12 bit resolution. As such, a temperature of vessel 454 can be controlled within approximately 0.0625 degrees Celsius, if desired. In another embodiment, microcontroller 466 compare the Tsp and Tc with a resolution of approximately 0.0325 degrees Celsius, using microcontroller 466 in a system comprising 16 bit resolution. As such, a temperature of vessel 454 can be controlled within approximately 0.0325 degrees Celsius, if desired. In yet another embodiment, microcontroller 466 can compare the Tsp and Tc with a resolution of approximately 0.01 degrees Celsius (or multiples thereof such as 0.02, 0.03, etc.), using microcontroller 466 in a system comprising 24 bit resolution and platinum resistance temperature detectors (RTDs) and other suitable components that can sample a temperature of vessel 454 25 times per second and adjust thermoelectric modules 450 up to once every 40 milliseconds. As such, a temperature of vessel 454 can be controlled within approximately 0.01 degrees Celsius, if desired. In some applications, temperature of vessel 454 is controlled to within less than 1.0 degree Celsius or within a range of approximately 0.5-1.0 degrees Celsius.

In an embodiment, microcontroller 466 is optionally configured to receive a user defined Tsp. The Tsp can be defined as a range of temperatures that can be arbitrarily selected by a user, manufacturer, or provider, to correspond to anticipated needs for a particular use of thermoelectric transport or storage device 102, or to correspond to a particular standard. For example, in the United States, the Food and Drug Administration (FDA) sets standards for temperature control for various pharmaceuticals. As a non-limiting example, the FDA has a Pharmaceutical Cold Chain Protocol that requires a substance to remain within a temperature range of 2-8 degrees Celsius. Accordingly, the thermal protections system can be configured to provide temperature control within the range of 2-8 degrees Celsius or within a tolerance of less than about six degrees Celsius. As a further non-limiting example, the FDA has a room Temperature Protocol that requires a substance to remain within a temperature range of 15-30 degrees Celsius.

Accordingly, the thermal protections system can be configured to provide temperature control within the range of 15-30 degrees Celsius or within a tolerance of less than about 15 degrees Celsius. While vessel 454 comprises a temperature within the specified range or tolerance, microcontroller 466 does not need to activate a simultaneous use of the Peltier effect for each of the thermoelectric modules 450 to transfer heat with respect to the vessel.

When vessel 454 comprises a temperature near or outside a specified range or tolerance, microcontroller 466 can activate simultaneous use of the Peltier effect for each of the thermoelectric modules 450 to transfer heat between each thermoelectric modules 450. For example, a first thermoelectric unit can transfer heat from a first thermoelectric module 450 to a second thermoelectric module 450 while the second thermoelectric module 450 transfers heat to a third thermoelectric module 450. Numerical examples of such a configuration are included in the charts of FIGS. 32A-32C.

Capacitance spacer blocks 458 can be disposed between thermoelectric modules 450 to provide thermal capacitance and to provide additional flexibility in allowing for microcontroller 466 to operate with a lower duty cycle or greater off periods when microcontroller 466 does not provide a voltage to thermoelectric modules 450 for active use of the Peltier effect. The duty cycle can be determined by a signal output of microcontroller 466 as part of a pulse-width-modulated (PWM) signal, a pulse-frequency-modulated (PFM) signal, or a thermal modulated signal. For PWM signals, microcontroller 266 can operate in a range of 0.01 hertz (Hz)-10 megahertz (MHz), or in a range of 0.1 Hz-10 kHz, or at about 1 kHz. Unlike conventional systems that do not include capacitive spacer blocks, can operate efficiently with duty cycles measured on the order of seconds rather than milliseconds. For pulse-frequency-modulated (PFM) signals, microcontroller 266 can operate in a range of 0.01 Hz-10 MHz, or in a range of 0.1 Hz-10 kHz, or at about 1 kHz. The operation of microcontroller 266 can also vary an duty cycle for applying a voltage to thermoelectric modules 450 based on the thermal capacitance provided by the configuration of capacitance spacer blocks 458, including a size and number of the capacitance spacer blocks as well as operating conditions of thermal protection system 464 including, for example, an ambient temperature outside the thermal protection system, Tc, and Tsp. The range of efficient operation of thermoelectric modules 450, and an ability to operate within a "sweet spot" as disclosed herein, can be facilitated, at least in part, by the inclusion of capacitance spacer blocks 458 within stack 470 of thermoelectric modules 450. Without capacitance spacer blocks 458, thermal protection system 464 requires a duty cycle with more on time and could be required to be constantly on or supplying a voltage from energy source 452 to stack 470 of thermoelectric modules 450 such that the thermoelectric modules 450 are actively engaged in using the Peltier effect to transfer heat without pauses or breaks. Storage and slowed release of heat from capacitance spacer blocks 458 to and from thermoelectric modules 450 allows for the thermal protections system 464 to adjust a duty cycle of the voltage supplied by microcontroller 466 and to switch between on and off modes due to the thermal delay resulting from capacitance spacer blocks 458.

Use of a stack 470 of thermoelectric modules 450 and capacitance spacer blocks 458, including at least three thermoelectric modules and four thermoelectric modules 450*a*-450*d*, as shown in FIG. 27A, can allow for a smaller temperature gradient or temperature differential (delta T) between thermoelectric modules 450 while having a larger temperature differential or gradient between vessel 454 and heat sink 456. Additional detail with respect to the above configuration is also presented in the charts shown in FIGS. 32A-32C.

Even without the use of capacitance spacer blocks 458, use of multiple thermoelectric modules such as two, three, four, or more thermoelectric modules allows for better performance of thermal protection systems 464, such as thermal protection systems 464*a*, than is achieved with a single thermoelectric module. First, multilayer stacks 470 can perform more efficiently than a single thermoelectric module because multilayer stacks can run at a lower percentage of capacity and at lower voltage, which results in the thermoelectric modules operating at a higher coefficient of performance than single thermoelectric modules. Single thermoelectric modules, as conventionally used, will generally operate at higher percentage of capacity and at higher voltage. The industry has typically recommended running a thermoelectric unit near capacity (Q max), so that a less expensive unit with less capacity can be selected to save money in purchasing the thermoelectric module such that the thermoelectric module is then used to operate near capacity (Q max). As an example of an industry manufacturer recommending thermoelectric module capacity base on operating conditions, see for example, "Aztec Thermoelectric Cooler Analysis" software, made by Laird Technologies. However, by operating a single thermoelectric or stack of thermoelectric modules at or near maximum capacity (Q max) for much of the time heating or cooling is desired, such as at a duty cycle of greater than about 50%, performance efficiencies of the thermoelectric module or modules are decreased.

Better performance of thermal protection systems 464 can also result from use of multiple thermoelectric modules such as two, three, four, or more thermoelectric modules for at least another reason. As a second reason, a temperature differential or delta T between a hot side 462 and cold side 460 of a thermoelectric module 450 in a stack 470 will be less than a temperature differential or delta T between a hot side 462 and cold side 460 of a single thermoelectric module 450 not part of a stack. An entire temperature differential or delta T between vessel 454 and heat sink 458 is present across a single thermoelectric module, while the entire temperature differential can be shared among thermoelectric modules in a stack 470. Quantitative examples of how a temperature differential or delta T is divided among a plurality of thermoelectric modules 450 in a stack 470, as illustrated in FIG. 27A, is provided in the charts of FIGS. 32A-32C. Because the thermoelectric modules are connected in series and receive an approximately equal voltage while the amount of heat transferred (Qc) by each thermoelectric module 450 increases as heat is transferred from vessel 454 to heat sink 456, the delta T between hot side 462 and cold side 460 of each thermoelectric module 450 decreases from vessel 454 to heat sink 456. In other words, a delta T that increases for each thermoelectric module 450 in a first direction along stack 470 is inversely related to an amount of heat transferred by each corresponding thermoelectric module, which increases for each thermoelectric module in a second direction opposite the first direction.

Smaller temperature gradients or delta Ts allow for higher efficiency and higher coefficients of performance from thermoelectric modules 450 within stacks 470. Performance of a stack 470 of thermoelectric modules 450 without any capacitance spacer blocks 458 can include an efficiency in a range of only 60-80% or 65-75% of the performance of a configuration including the capacitance spacer blocks. Stacks 470 of thermoelectric modules 450 are less efficient without the inclusion of interleaved capacitance spacer blocks 458 for a number of reasons. First, efficiency is decreased without the capacitance spacer blocks 458 because of an increased duty cycle, operation, or on-time of thermoelectric modules 450. For greater duty cycles, the higher percentage of time thermoelectric modules 450 are required to be active increases a corresponding amount of power that is consumed by the thermoelectric modules, which reduces a COP of the thermoelectric modules. Second, efficiency is decreased without the capacitance spacer blocks because of a reduction in thermal capacitance that prevents heat from transferring back in a direction along stack 470 in a direction opposite from a direction in which the heat or Qc was initially transferred by stack 470 of thermoelectric modules 450 during active use of the Peltier effect.

Smaller temperature differentials, or delta T, between adjacent thermoelectric modules 450 and hot sides 462 and cold sides 460 of the same thermoelectric module 450 can reduce thermal stress on the thermoelectric modules. Reduction of thermal stress within thermoelectric modules 450 reduces incidents of cracking at the nodes of the thermocouples. Thus, by reducing the thermal stress that can lead to cracking, wear on thermoelectric modules 450 is decreased and a period of operation or a lifetime of the thermoelectric module is increased.

By operating thermal protection systems 464 with smaller temperature differentials or delta Ts between adjacent thermoelectric modules 450 and hot sides 462 and cold sides 460 of the same thermoelectric module 450, a smaller temperature differential or delta T also is maintained across heat sink 456 or between a hot side and a cold side of the heat sink. While conventional systems comprising a thermoelectric module and a heat sink might operate at an industry standard temperature differential of about a 15 degrees Celsius between hot and cold sides of the heat sink, the embodiment disclosed in FIG. 27A can produce much smaller temperature differentials between hot and cold sides of the heat sink, which are closer to about 3 degrees Celsius. See, for example, the charts disclosed in FIGS. 32A-32C.

A fan can optionally be disposed adjacent to heat sink 456 to aid in removal of heat from thermal protection system 464 including heat sink 456. In an embodiment, thermal protection system 464 is configured to provide temperature control within a tolerance of less than about one degree centigrade.

Thermoelectric heat pump assembly 464 can also be used in a method of safely transporting temperature sensitive goods at a selected temperature profile during transport. Temperature sensitive goods 139 are placed in vessel 454 within the thermal protection system. Vessel 454 is adapted to thermally isolate the temperature sensitive goods 139 from an outside environment. Vessel 454 is coupled to the stack 470 of thermoelectric modules 450 and thermally capacitive spacer blocks 458. A temperature of vessel 454 is controlled by activating the Peltier effect for stack 470 of the plurality of thermoelectric modules 450 and conducting heat from vessel 454 through the thermoelectric units to heat sink 456.

Figure 27B:
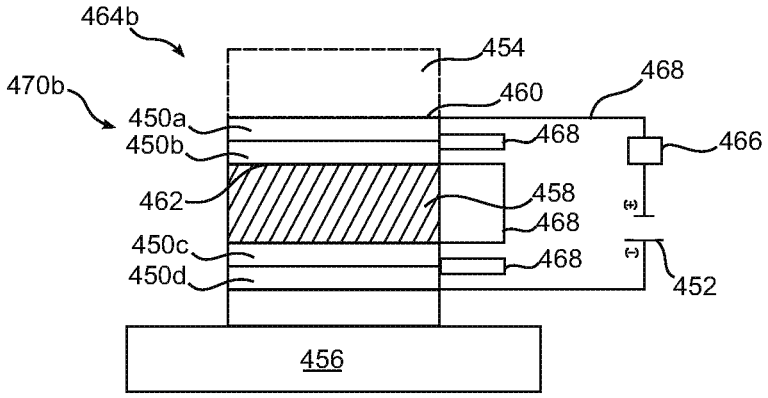

FIG. 27B, shows an embodiment of a thermal protections system 464*b* that is similar to thermal protections system 464*a* shown in FIG. 27A. Thermal protections system 464*b* differs from thermal protections system 464*a* in that every thermoelectric module 450 does not include an interleaved capacitance spacer block 458 to form a sandwich layer. Instead, a number of capacitance spacer blocks 458 can be omitted from being disposed between a corresponding number of adjacent thermoelectric modules 450. Accordingly, an entirety of thermoelectric modules 450, or a portion less than an entirety of the thermoelectric modules can be in direct contact with each other and not include an intervening capacitance spacer block 458.

Thus, FIG. 27B shows generally that in various embodiments, capacitance spacer blocks 458 can be omitted from being disposed between every thermoelectric module 450 such that less than an entirety of the thermoelectric modules are in direct contact with each other and do not include an intervening capacitance spacer block 458. While FIG. 27B shows a single capacitance spacer block 458 disposed between thermoelectric modules 450*b* and 450*c*, a single capacitance spacer block could similarly be disposed between thermoelectric modules 450*a* and 450*b*, or 450*c* and 450*d*. In other embodiments, two capacitance spacer blocks could be disposed between thermoelectric modules, such as between 450*a* and 450*b* as well as between 450*c* and 450*d*; or alternatively, between thermoelectric modules 450*a* and 450*b* as well as between 450*b* and 450*c*; or alternatively, between thermoelectric modules 450*b* and 450*c* as well as between 450*c* and 450*d*.

Figure 27C:
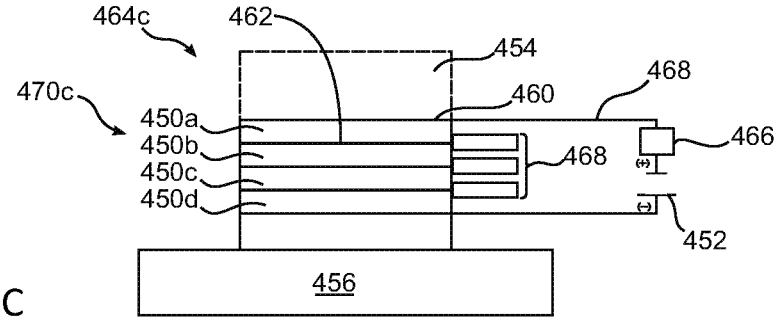

FIG. 27C, shows an embodiment of a thermal protections system 464*c* that is similar to thermal protections system 464*a* or 464*b* shown in FIG. 27A or 27B, respectively. Thermal protection system 464*c* differs from thermal protections systems 464*a* and 464*b* in that no capacitance spacer blocks 458 are interleaved between thermoelectric modules 450, and thermoelectric modules 450 can be in direct contact with each other.

Figure 28:
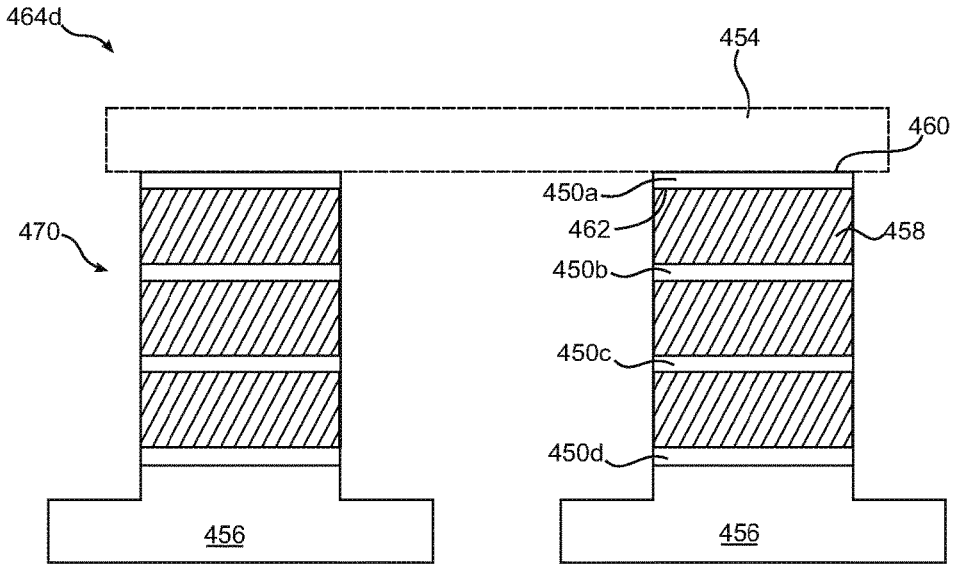
FIG. 28 shows electrical schematic views, in which multiple thermoelectric heat pump assemblies are coupled to a container for transporting temperature sensitive material.

FIG. 28 shows a schematic cross-sectional view, in which multiple stacks 470 of thermoelectric modules 450 and capacitance spacer blocks 450, such as stacks 470*a* from FIG. 27A, can be arranged such that multiple stacks 470 may be placed in parallel and in thermal communication with vessel 454. While two stacks 470 are shown in FIG. 28, any number of any of stacks 470 shown herein, or variations thereof, can be thermally coupled in parallel to vessel 454 to provide additional thermal transport capability.

Figure 29:
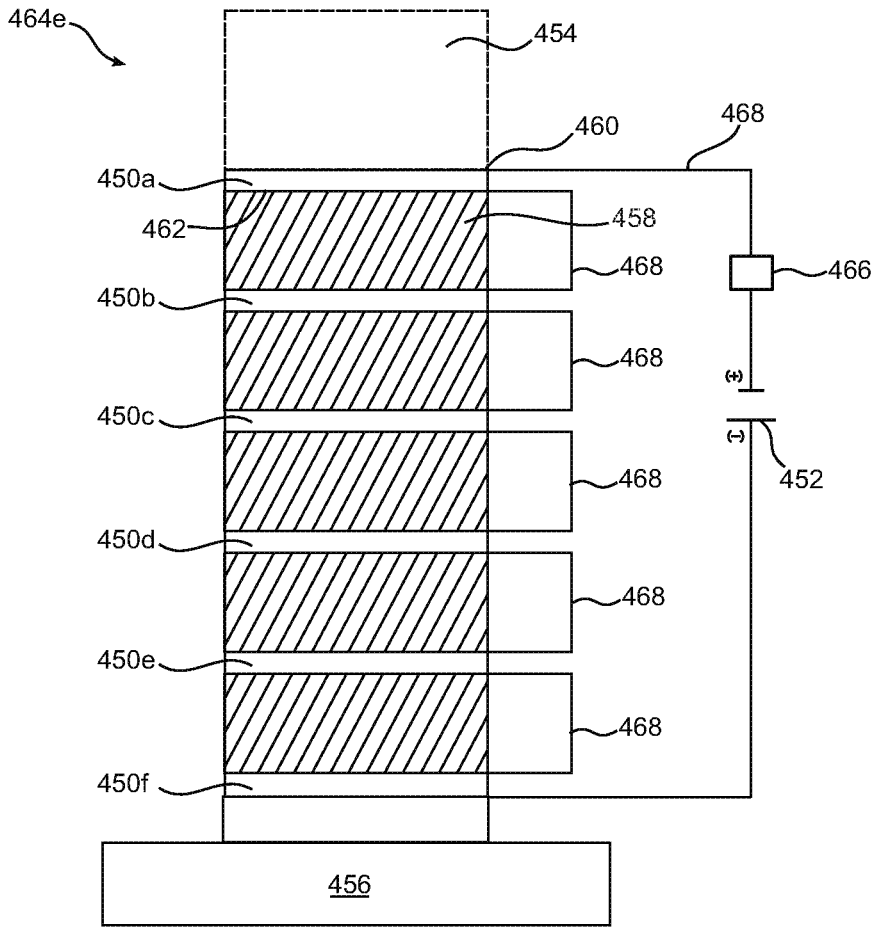
FIG. 29 shows an electrical schematic view of a thermoelectric heat pump assembly that can comprise six thermoelectric units, all of which are arranged electrically and thermally in series.

FIG. 29 shows a schematic cross-sectional view of a thermal protection system 464*e*, similar to thermal protection system 464*a* shown in FIG. 27A. FIG. 29 shows thermal protection system 464*e* is a variation of thermal protection system 464*a* that includes a stack of 6 thermoelectric modules 450*a*-450*f* and 5 capacitance spacer blocks 458 interleaved between the thermoelectric modules instead of the stack of 4 thermoelectric modules 450*a*-450*d* and 3 capacitance spacer blocks 458 shown in FIG. 27A. Similar to the variations indicated in FIG. 27B or 27C, not every thermoelectric module 450 in FIG. 29 needs to include an interleaved capacitance spacer block 458 to form a sandwich layer. Instead, a number of capacitance spacer blocks 458 can be omitted from being disposed between a corresponding number of adjacent thermoelectric modules 450. Accordingly, an entirety of adjacent thermoelectric modules 450, or a portion less than an entirety of the thermoelectric modules can be in direct contact with each other and not include an intervening capacitance spacer block 458.

Figure 30:
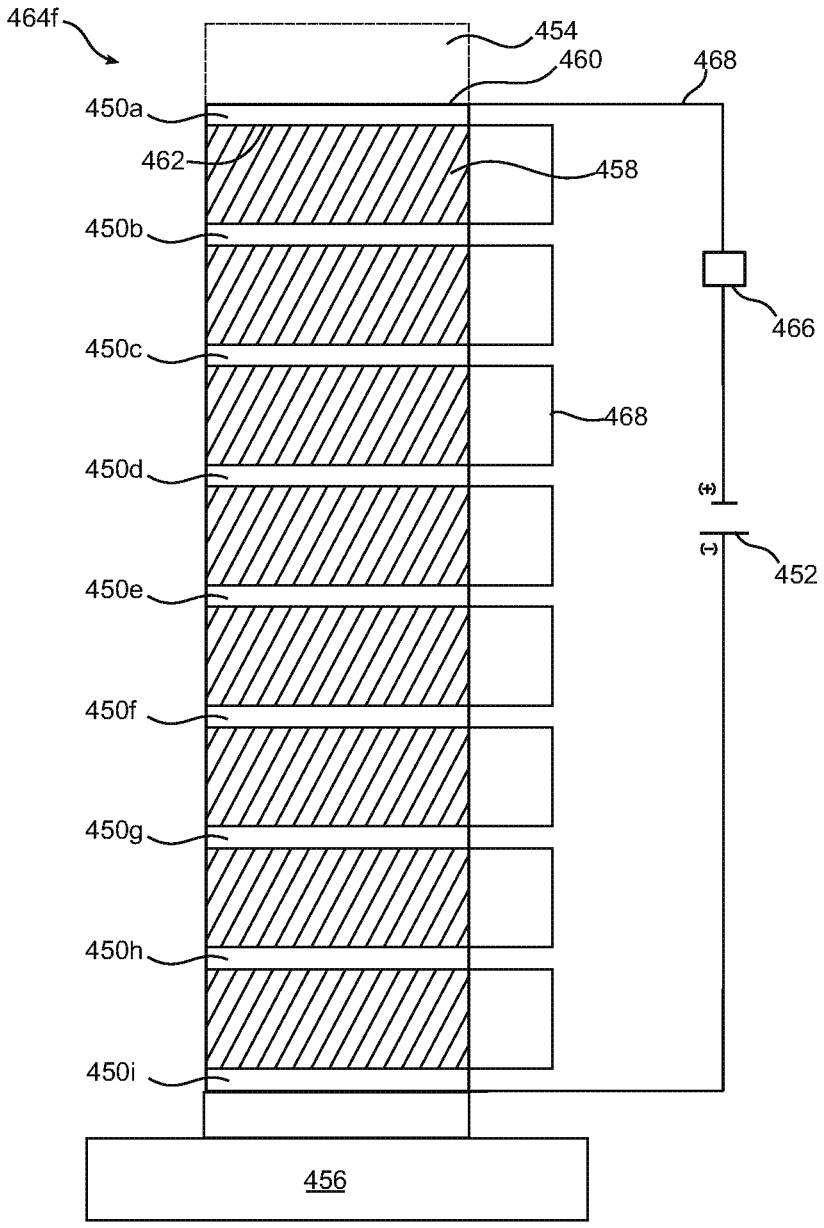
FIG. 30 shows an electrical schematic view of a thermoelectric heat pump assembly that can comprise nine thermoelectric units, all of which are arranged electrically and thermally in series.

FIG. 30 shows a schematic cross-sectional view of a thermal protection system 464*f*, similar to thermal protection system 464*a* shown in FIG. 27A. FIG. 30 shows thermal protection system 464*f* is a variation of thermal protection system 464*a* that includes a stack of 9 thermoelectric modules 450*a*-450*i* and 8 capacitance spacer blocks 458 interleaved between the thermoelectric modules instead of the stack of 4 thermoelectric modules 450*a*-450*d* and 3 capacitance spacer blocks 458 shown in FIG. 27A. Similar to the variations indicated in FIG. 27B or 27C, not every thermoelectric module 450 in FIG. 30 needs to include an interleaved capacitance spacer block 458 to form a sandwich layer. Instead, a number of capacitance spacer blocks 458 can be omitted from being disposed between a corresponding number of adjacent thermoelectric modules 450, such that an entirety, or a portion less than an entirety, of the thermoelectric modules can be in direct contact with each other and not include an intervening capacitance spacer block 458.

Figure 31:
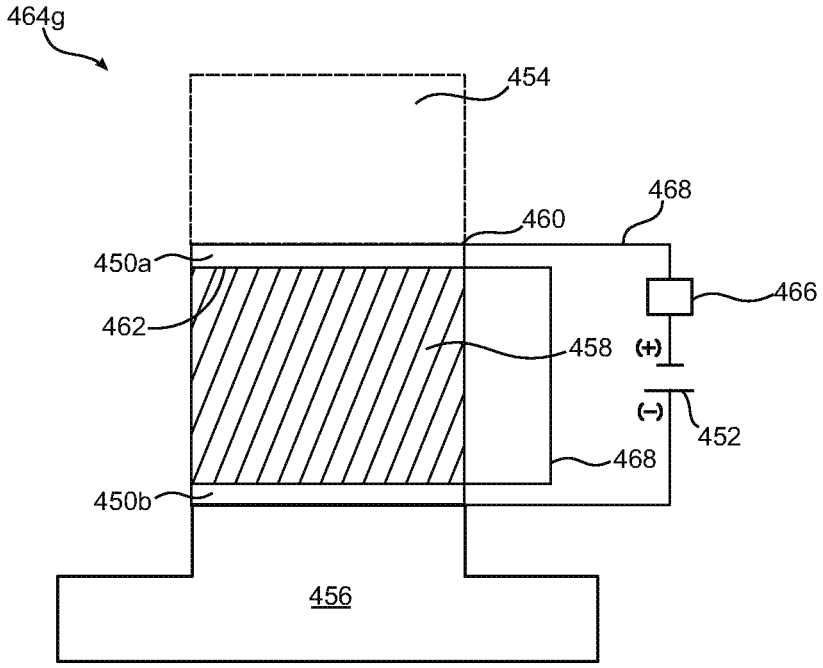
FIG. 31 shows an electrical schematic view of a thermoelectric heat pump assembly that can comprise two thermoelectric units, both of which are arranged electrically and thermally in series.

FIG. 31 shows a schematic cross-sectional view of a thermal protection system 464*g*, similar to thermal protection system 464*a* shown in FIG. 27A. FIG. 31 shows thermal protection system 464*g* is a variation of thermal protection system 464*a* that includes a stack of 2 thermoelectric modules 450*a* and 450*b* and 1 capacitance spacer block 458 interleaved between the thermoelectric modules instead of the stack of 4 thermoelectric modules 450*a*-450*d* and 3 capacitance spacer blocks 458 shown in FIG. 27A. Similar to the variations indicated in FIG. 27B or 27C, not every thermoelectric module 450 in FIG. 30 needs to include an interleaved capacitance spacer block 458 to form a sandwich layer. Instead, the capacitance spacer block 458 can be omitted from being disposed between both thermoelectric modules 450*a* and 450*b*, such that an entirety of the thermoelectric modules can be in direct contact with each other and not include an intervening capacitance spacer block 458.

FIGS. 32A-32C show charts, each of which illustrate how various embodiments maximize efficiency of operation compared to previously available thermoelectric heat pump systems. The charts further illustrate how various embodiments can be configured to maximize heat pumped per unit of input power during overall use, while minimizing the ratio of input current to maximum available current at a given steady-state temperature.

FIGS. 32A-32C further emphasize advantages of thermoelectric transport or storage device 102 or thermal protection system 464 in which the maximum current, current, maximum Delta-T, Delta-T, transferred heat, voltage, ratio of current to maximum current, ratio of Delta-T to maximum Delta-T, are displayed. The maximum values indicated within FIGS. 32A-32C, such as Imax and Qmax, are those values provided by a manufacturer in the specifications for a particular part or thermoelectric module. Determining a size or capacity for a particular component can based on design constraints and manufacturer specifications for particular component features or parameters such as Imax and Qmax. Sizing components based on manufacturer recommendations can also be accomplished using automated systems and software programs such as "Aztec Thermoelectric Cooler Analysis" software, made by Laird Technologies.

FIG. 32A shows further details for the configuration of thermal protection system 464*a* from FIG. 27A when consuming approximately 1 watt of power during operation. FIG. 24B shows further details for the configuration of thermal protection system 464*a* from FIG. 27A consuming approximately 3 watts of power during operation. FIG. 24C shows further details for the configuration of thermal protection system 464*a* from FIG. 27A consuming approximately 5 watts of power during operation.

As indicated previously, the COP is defined as the amount of heat transferred from thermal vessel 454 divided by the amount of power (voltage multiplied by current) required to operate thermoelectric transport or storage device 102 or protections system 464. As can be seen from a comparison of FIGS. 32A-32C, as voltage increases for a given thermoelectric module 450, delta T, or a temperature difference between a cold side 460 and a hot side 462, also increases and a COP decreases along a same direction of stack 470. However, as seen in FIGS. 32A-32C, the operating point coefficient of performance for thermal protections system 464 is well above the typical operating point coefficient of performance. That is, thermal protection system 464 is able to pump more heat from vessel 454 to heat sink 456 using less current and ultimately less power than typical thermoelectric systems.

Although applicant has described various embodiment of the disclosure, it will be understood that the broadest scope of the disclosure includes modifications. Such scope is limited only by the below claims as read in connection with the above specification. Further, many other advantages of applicant's invention will be apparent to those skilled in the art from the above descriptions and the below claims.

What is claimed is:

1. A thermal protection system, relating to thermally protecting temperature-sensitive goods, comprising:

a vessel sized and shaped to contain the temperature sensitive goods;

a stack of at least two thermoelectric unit layers capable of active use of the Peltier effect in thermal conduction with the vessel, each thermoelectric unit layer having a cold side and a hot side, the hot side of the first thermoelectric unit layer being arranged to face the cold side of the second thermoelectric unit layer;

an energy source electrically coupled to each of the at least two thermoelectric unit layers; control logic operably coupled to the energy source and the stack of at least two thermoelectric unit layers, the control logic controls delivery of a current to the stack of at least two thermoelectric unit layers at a first duty cycle between 0.01 hertz (Hz) and 10 megahertz (MHz), wherein the thermal protection system is configured so that each individual thermoelectric module has a ratio of input current to maximum available current (I/Imax) of 0.35 or less at a steady-state when heat removal (Q) is about 0 Watts; and a capacitance spacer block coupled to and between the first and second thermoelectric unit layers, the capacitance spacer block formed substantially of a thermally conducting material, the capacitance spacer block storing heat and delaying heat transfer from the first thermoelectric unit layer to the second thermoelectric unit layer during operation of the thermal protection system.

2. The thermal protection system of claim 1, wherein the control logic maintains a preselected temperature for the temperature sensitive goods for at least 72 hours to within a tolerance of ±5° C.

3. The thermal protection system of claim 1, wherein the microcontroller defines a setpoint temperature (Tsp) and compares the Tsp to a temperature (Tv) of the vessel and activates a simultaneous use of the Peltier effect for a duration to reduce a difference in temperature between the Tsp and Tv.

4. The thermal protection system of claim 3, wherein the Tsp is defined as a range of temperatures; and the Tsp and Tv are compared with a resolution greater than or equal to 0.0625 degrees Celsius.

5. The thermal protection system of claim 1, wherein the first thermoelectric unit layer is capable of pumping heat at a different rate than the second thermoelectric unit layer.

6. A thermal protection system, relating to thermally protecting temperature-sensitive goods, comprising:

a vessel sized and shaped to contain the temperature sensitive goods;

a stack of at least two thermoelectric unit layers capable of active use of the Peltier effect in thermal conduction with the vessel, each thermoelectric unit layer having a cold side and a hot side, the hot side of the first thermoelectric unit layer being arranged to face the cold side of the second thermoelectric unit layer;

an energy source electrically coupled to each of the at least two thermoelectric unit layers; and control logic operably coupled to the energy source and the stack of at least two thermoelectric unit layers, the control logic controls delivery of a current to the stack of at least two thermoelectric unit layers at a first duty cycle between 0.1 hertz (Hz) and 10 kilohertz (kHz), wherein the thermal protection system is configured so that each individual thermoelectric module has a ratio of input current to maximum available current (I/Imax) of 0.35 or less at a steady-state when heat removal (Q) is about 0 Watts.

7. The thermal protection system of claim 6, wherein the stack of at least two thermoelectric unit layers comprise:

a delta T that increases for each thermoelectric unit layer in a first direction along the stack of at least two thermoelectric unit layers; and an amount of heat transferred by the thermoelectric module (Qc) that increases for each thermoelectric unit layer in a second direction along the stack of at least two thermoelectric unit layers, the second direction being opposite the first direction.

8. The thermal protection system of claim 7, further comprising:

a capacitance spacer block coupled to and between the first and second thermoelectric unit layers, the capacitance spacer block formed substantially of a thermally conducting material having a thermal conductivity higher than a thermal conductivity of each individual thermoelectric unit layer, the capacitance spacer block storing heat and delaying heat transfer from the first thermoelectric unit layer to the second thermoelectric unit layer during operation of the thermal protection system.

9. The thermal protection system of claim 8, wherein the control logic maintains a preselected temperature for the temperature sensitive goods to within a tolerance of ±10° C. at the steady-state, wherein the difference between the preselected temperature of the temperature sensitive goods compared to the ambient temperature is at least 30° C.

10. The thermal protection system of claim 8, wherein each thermoelectric unit layer has a maximum change in temperature (ΔTmax) potential and is configured so that each thermoelectric unit layer operates at less than 40% of the ΔTmax at steady-state when change in temperature (ΔT) of the stack of at least two thermoelectric unit layers at opposing ends of the stack of at least two thermoelectric unit layers is about 40° C.

11. The thermal protection system of claim 8, wherein each hot side of each thermoelectric unit layer in the stack of at least two thermoelectric unit layers has a level of heat conductivity that approximates the thermal conductivity of aluminum.

12. The thermal protection system of claim 11, wherein each of the at least two thermoelectric unit layers are electrically and thermally connected in series.

13. A thermal protection system, relating to thermally protecting temperature-sensitive goods, comprising:

a vessel sized and shaped to contain the temperature sensitive goods;

a stack of at least two thermoelectric unit layers capable of active use of the Peltier effect in thermal conduction with the vessel, each thermoelectric unit layer having a cold side and a hot side, the hot side of the first thermoelectric unit layer being arranged to face the cold side of the second thermoelectric unit layer;

an energy source electrically coupled to each of the at least two thermoelectric unit layers; and control logic operably coupled to the energy source and the stack of at least two thermoelectric unit layers, the control logic controls delivery of a current to the stack of at least two thermoelectric unit layers at a first duty cycle between 0.01 hertz (Hz) and 10 megahertz (MHz), wherein the thermal protection system is configured so that each individual thermoelectric module has a ratio of input current to maximum available current (I/Imax) of 0.35 or less at a steady-state when heat removal (Q) is about 0 Watts, and wherein the control logic causes delivery of the current to each of the thermoelectric layers to activate the Peltier effect simultaneously in each of the thermoelectric layers.

14. The thermal protection system of claim 13, wherein each thermoelectric unit layer in the stack of at least two thermoelectric unit layers has a heat pumping capability of between 15 Watts and 20 Watts.

15. The thermal protection system of claim 13, wherein the stack of at least two thermoelectric unit layers comprise:

a delta T that increases for each thermoelectric unit layer in a first direction along the stack of at least two thermoelectric unit layers; and an amount of heat transferred by the thermoelectric module (Qc) that increases for each thermoelectric unit layer in a second direction along the stack of at least two thermoelectric unit layers, the second direction being opposite the first direction.

16. The thermal protection system of claim 13, wherein the control logic defines a setpoint temperature (Tsp) and compares the Tsp to a temperature (Tv) of the vessel and activates a simultaneous use of the Peltier effect for a duration to reduce a difference in temperature between the Tsp and Tv.

17. The thermal protection system of claim 16, wherein the control logic maintains a preselected temperature for the temperature sensitive goods to within a tolerance of ±10° C. at the steady-state, wherein the difference between the preselected temperature of the temperature sensitive goods compared to the ambient temperature is at least 40° C.

18. The thermal protection system of claim 13, further comprising:

a capacitance spacer block coupled to and between the first and second thermoelectric unit layers, the capacitance spacer block formed substantially of a thermally conducting material having a thermal conductivity higher than a thermal conductivity of each individual thermoelectric unit layer, the capacitance spacer block storing heat and delaying heat transfer from the first thermoelectric unit layer to the second thermoelectric unit layer during operation of the thermal protection system, wherein the thermal conductivity of the stack of at least two thermoelectric unit layers together with the capacitance space block is at least 5 watts per meter degree Kelvin (W/m·K) or higher.

19. The thermal protection system of claim 18, wherein the capacitance spacer block is formed substantially of a thermally conducting material having a thermal conductivity at least as high as aluminum alloy 6061.

20. The thermal protection system of claim 18, wherein each thermoelectric unit layer comprises at least 127 coupled pairs of thermocouples and a resistance of at least 1 ohm.

* * * * *